US007413295B2

(12) United States Patent
Takata et al.

(10) Patent No.: US 7,413,295 B2
(45) Date of Patent: Aug. 19, 2008

(54) INKJET PRINTER WITH DELIVERY CHAMBER

(75) Inventors: Masayuki Takata, Nagoya (JP); Yoichiro Shimizu, Kasugai (JP); Naoya Okazaki, Hashima-gun (JP); Kazuaki Iwatsuki, Chita-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 399 days.

(21) Appl. No.: 11/082,088

(22) Filed: Mar. 17, 2005

(65) Prior Publication Data

US 2005/0206691 A1 Sep. 22, 2005

(30) Foreign Application Priority Data

| | | |
|---|---|---|
| Mar. 19, 2004 | (JP) | 2004-080388 |
| Mar. 22, 2004 | (JP) | 2004-082364 |
| Mar. 23, 2004 | (JP) | 2004-084746 |
| Mar. 26, 2004 | (JP) | 2004-092215 |
| Mar. 29, 2004 | (JP) | 2004-095226 |
| Mar. 29, 2004 | (JP) | 2004-096802 |

(51) Int. Cl.
*B41J 2/17* (2006.01)
*B41J 2/175* (2006.01)

(52) U.S. Cl. ..... 347/84; 347/85

(58) Field of Classification Search ..... 347/84, 347/37, 92, 94, 49, 85, 17, 86
See application file for complete search history.

(56) References Cited

U.S. PATENT DOCUMENTS

| | | | | |
|---|---|---|---|---|
| 6,257,712 | B1 | 7/2001 | Haigo | |
| 6,540,313 | B2 | 4/2003 | Suzuki | |
| 6,729,717 | B2 | 5/2004 | Ito et al. | |
| 2002/0030715 | A1 * | 3/2002 | Takata et al. | 347/37 |
| 2002/0057320 | A1 | 5/2002 | Kaga et al. | |
| 2003/0038868 | A1 * | 2/2003 | Arai et al. | 347/94 |
| 2003/0090540 | A1 * | 5/2003 | Shimizu | 347/49 |
| 2004/0165028 | A1 | 8/2004 | Ito et al. | |

(Continued)

FOREIGN PATENT DOCUMENTS

| | | | |
|---|---|---|---|
| EP | 1 285 761 | A1 | 2/2003 |

(Continued)

*Primary Examiner*—Stephen D. Meier
*Assistant Examiner*—Carlos A Martinez, Jr.
(74) *Attorney, Agent, or Firm*—Oliff & Berridge, PLC

(57) ABSTRACT

An inkjet printer including: (a) a recording head operable to eject an ink onto a recording medium so as to perform a recording operation on the recording medium; (b) an ink source unit provided to store the ink that is to be supplied to the recording head; and (c) an ink delivery unit provided to delivery the ink supplied from the ink source unit, to the recording head. The ink delivery unit has a delivery chamber which has a delivery chamber inlet and a delivery chamber outlet, such that the ink can be delivered through the delivery chamber inlet from the ink source unit, and such that the ink can be delivered through the delivery chamber outlet toward the recording head. The delivery chamber is defined by a wall held in substantially parallel with a horizontal plane, and is elongated in a direction parallel with the wall. The delivery chamber inlet and outlet of the delivery chamber are positioned in respective positions which are substantially diagonal relative to each other.

48 Claims, 22 Drawing Sheets

U.S. PATENT DOCUMENTS

| | | | | |
|---|---|---|---|---|
| 2004/0263596 | A1* | 12/2004 | Watanabe et al. | 347/94 |
| 2005/0088494 | A1* | 4/2005 | Shimizu et al. | 347/85 |
| 2005/0168508 | A1* | 8/2005 | Hilton et al. | 347/17 |

FOREIGN PATENT DOCUMENTS

| | | | |
|---|---|---|---|
| JP | A 63-017056 | | 1/1988 |
| JP | B2 07-121583 | | 12/1995 |
| JP | A 2000-103084 | | 4/2000 |
| JP | A 2001-219560 | | 8/2001 |
| JP | A 2001-260388 | | 9/2001 |
| JP | A 2002-067312 | | 3/2002 |
| JP | A 2002-160372 | | 6/2002 |
| JP | A 2002-166568 | | 6/2002 |
| JP | A 2003-237037 | | 8/2003 |
| WO | WO2004/069545 | * | 8/2004 |

* cited by examiner

INKJET PRINTER WITH DELIVERY CHAMBER

This application is based on Japanese Patent Applications No. 2004-080388 filed on Mar. 19, 2004, No. 2004-082364 filed on Mar. 22, 2004, No. 2004-084746 filed on Mar. 23, 2004, No. 2004-092215 filed on Mar. 26, 2004 and Nos. 2004-095226 and 2004-096802 filed on Mar. 29, 2004, the contents of which are incorporated hereinto by reference.

BACKGROUND OF THE INVENTION

1. Field of the Invention

The present invention relates to an inkjet printer including (i) a recording head operable to eject ink onto a recording medium so as to perform a recording operation on the recording medium, and (ii) an ink source unit provided to store the ink that is to be supplied to the recording head.

2. Discussion of Related Art

There is known an inkjet printer of so-called tube supply type in which the ink is supplied via a flexible tube to the recording head mounted on a movable carriage, from an ink supply source fixed in a stationary body of the inkjet printer, as disclosed in JP-A-S63-17056 and JP-B2-H07-121583.

JP-A-S63-17056 discloses an inkjet printer including a recording head in which a plurality of nozzles are arranged in a vertically extending row. The recording head has recesses formed in its side surface and opening in the side surface, such that the formed recesses define ink delivery passages and a common ink chamber (damper chamber), through which the ink is delivered to the nozzles. The ink passages are all held in communication with the common ink chamber, to which the ink is supplied from an ink tank as the ink source unit fixed to the stationary body of the printer, via the flexible tube. The opening of the recess defining the common ink chamber is sealed with a flexible film (absorber film) which is bonded to the above-described side surface. An oscillator, which is provided by a piezoelectric element, is disposed in a predetermined position in each of the ink passages, so as to be opposed to the above-described side surface. With the oscillator being actuated, the ink in the corresponding ink passages is pressurized, so that the thus pressurized ink is ejected through the corresponding nozzle toward a paper sheet as the recording medium.

JP-B2-H07-121583 discloses an inkjet printer including a recording head in which a plurality of nozzles and ink are arranged in vertically extending rows. On vertically extending, opposite side surfaces of the recording head, there are fixedly disposed piezoelectric elements. Each of the piezoelectric elements is deflected upon application of a drive voltage thereto, whereby the ink is ejected through a corresponding one of the nozzles. On the movable carriage, there is mounted a damper unit (damper-chamber definer), to which the ink is delivered from an ink tank held stationary in a predetermined position, via a flexible tube. The ink delivered to the damper unit is then delivered from the damper unit to ink delivery channels which are defined in the recording head. The damper unit is principally constituted by a first member having an opening in its vertically extending side surface, and a second member having openings in its vertically extending side surfaces. The second member is fixed at one of the vertically extending side surfaces to the first member, with a filter member being gripped by and between the first and second members. The opening in the other vertically extending side surface (which is parallel with the above-described one of the vertically extending side surfaces) of the second member is sealed by a flexible film. The above-described flexible tube is connected at one of its opposite ends to the above-described stationary ink tank, and is connected at the other end to an ink inlet which is formed in a lower portion of the first member, so that the ink tank is held in communication with the ink inlet of the first member. The ink delivery channels of the recording head are held in communication with an ink outlet which is formed in a lower portion of the second member.

In either of the above-described inkjet printers disclosed by JP-A-S63-17056 and JP-B2-H07-121583, the flexible film partially defining the damper chamber serves as a damper wall to damp pressure fluctuation in the ink, which fluctuation is induced as a result of reciprocating motion of the carriage (particularly, upon returning of the carriage), due to an inertia force acting on the ink within the tube connecting the ink tank and the recording head. That is, the flexible film is deformed to absorb the unnecessary change of the ink pressure acting in a direction toward the recording head (nozzles), for enabling the ink to be ejected through the nozzles under substantially a constant pressure.

In either of the above-described inkjet printers in which the damper chamber is of vertical type, one of the vertically extending sides of the damper chamber is defined or sealed by the flexible film, namely, one of vertically extending walls is provided by the flexible film. Where a plurality of recording heads are provided to eject respective different color inks, the damper chambers for the respective different color inks are arranged in a row. In this arrangement, the damper chambers have to be arranged with a predetermined spacing interval between each adjacent pair of those, for allowing the flexible film of each of the damper chambers to be deformed. The arrangement of the damper chambers with the spacing intervals leads to an increase in size of a device to be mounted on the carriage and also an increase in the manufacturing cost due to an increased number of required components. That is, the damper unit equipped with the plurality of damper chambers suffers from these problems.

For solving such problems, the present inventors have designed an arrangement in which one of the damper chambers is adapted to have a relatively small height and a relatively large width while each of the other damper chambers is adapted to have a relatively large height and a relatively small width. The other damper chambers, each having the large height and small width, are arranged in parallel with each other, and are disposed on an upper side of the damper chamber having the small height and large width. In this designed arrangement, a bottom wall of the lower damper chamber having the small height and large width is provided by a flexible film, while upper walls of the above-described other chambers is provided by a flexible film or films. This arrangement enables the damper unit as a whole to be made compact in size and also enables the pressure change in each of the different color inks to be effectively absorbed.

However, in this arrangement, the lower damper chamber disposed under the above-described other chambers has to be to be thin, namely, has to have a sufficiently small height for allowing the other damper chambers to be disposed on the upper side of the lower damper chamber. Due to the small dimension in its height, there is encountered a delay of delivery of the ink in a region which is deviated from a shorted route of the ink flow from an inlet of the lower damper chamber to an outlet of the lower damper chamber. In addition to such a regional poor flow of the ink, the arrangement suffers from a lack of stability in the flow of the ink in the entirety of the lower damper chamber.

Where this arrangement is employed in an inkjet printer arranged to eject four color inks (e.g., black, cyan, yellow and magenta inks), each of three damper chambers as the above-described other chambers disposed on the upper side of another damper chamber as the lower damper chamber has to have a sufficiently small width for allowing the three chambers to be arranged in parallel with each other. Off course, where four or more damper chambers are arranged in parallel with each other, each of the chambers has to have an even smaller width.

Where each of the damper chambers serving as ink delivery chambers or ink storage chambers has such a small width, namely, where each ink passage defined by the chamber has a small width, a liquid is unlikely to rapidly flow along the ink passage, due to a surface tension of the liquid. Such a phenomenon is problematic when a liquid (e.g., an ink, a solution that is temporally stored during transportation of the inkjet printer as a product) is initially introduced into the ink passage, since the introduced liquid is stopped before reaching a downstream end of the ink passage.

Further, in the inkjet printer of tube supply type, since the ink tube has to be displaced in response to movement of the carriage, the ink tube is made of a flexible material. Such a flexible ink tube is likely to allow an atmospheric air to pass therethrough so that the ink within the ink tube is likely to contain the air which takes the form of bubbles. The bubbles, having been once introduced together with the ink into the damper chamber, remain in the damper chamber, even if the damper chamber is subjected to a discharging operation to discharge the bubbles therefrom. That is, in absence of a certain arrangement enabling the bubbles to be immediately discharged from the damper chamber through the outlet, the bubbles remain in the damper chamber, and the bubbles are delivered together with the ink to the ink delivery channels of the recording head, thereby problematically affecting an ink ejection performance of the inkjet printer.

Further, in the inkjet printer of tube supply type, when the carriage is accelerated or decelerated during its reciprocating motion, the acceleration or deceleration is given to the ink within the tube, generating a pressure wave in the ink. The thus generated pressure wave is propagated to the recording head, and the propagated pressure wave affects a meniscus formed at each nozzle of the recording head, thereby resulting in a deterioration in a recording quality.

U.S. Patent Application Publication US 2002/0057320 A1 (corresponding to JP-A-2002-166568) discloses an inkjet printer including a bubble trapper unit (damper unit) which is mounted on the carriage such that the ink is delivered toward the recording head through the bubble trapper unit. The bubble trapper unit has a construction, which separates the bubbles from the ink and accumulates therein, and which absorbs dynamic pressure exerted by the ink. Specifically described, the bubble trapper unit has, in its lower portion, an ink inlet and an ink outlet, such that the ink is delivered from an ink source unit into an inner space of the bubble trapper unit through the ink inlet, and such that the ink is delivered from the inner space of the bubble trapper unit toward the recording head through the ink outlet (see FIG. 3 of US 2002/0057320 A1). The inner space of the bubble trapper unit is sectioned into first and second sections which the above-described ink inlet and outlet face, respectively. The first and second sections are located on respective opposite sides of a metallic net wall which extends upwardly from a bottom wall of the inner space, and are held in communication with each other through a clearance defined by and between an upper wall of the inner space and a top end of the net wall. The first section includes a recessed portion which is formed in the upper wall of the inner space and which is located right above the ink inlet. The recessed portion opens downwardly and serves as a bubble retainer. In a process of manufacturing this trapper unit, the metallic net wall is heat welded to a second member defining the second section, and a first member defining the first section is then ultrasonic welded to a sub-assembly of the second member and the metallic net wall.

In the bubble trapper unit constructed as described above, the dynamic pressure of the ink introduced through the ink inlet is absorbed by the bubbles retained by the bubble retainer provided by the recessed portion. At the same time, the bubbles contained in the ink are floated up toward the upper wall of the inner space, so as to be accumulated in the inner space. When an amount of the accumulated bubbles exceeds a predetermined threshold, a purging operation is carried out. In the purging operation, the bubbles are sucked from a nozzle opening surface of the recording head, so as to be discharged together with the ink out from the bubble trapper unit through the recording head.

In the bubble trapper unit, since the first and second section of the inner space are located on the respective opposite sides of the net wall which serves as a first filter, large bubbles are floated up toward the upper wall of the inner space rather than passing through the net wall. However, small bubbles could be driven by flow of the ink, to pass through the net wall so as to be delivered together with the ink toward the recording head.

As described above, since the bubble trapper unit serves also as a damper unit for absorbing the dynamic pressure of the ink, the inkjet printer as a whole can be made compact in size. However, where the damper unit is used for a considerably frequently used ink such as a black color ink which is supplied to the recording head more in amount than the other color inks, the damper unit is required to have a construction capable of more reliably and effectively absorbing or damping the dynamic pressure of the ink, since the pressure wave propagated through the ink becomes larger as the amount of the supplied ink becomes larger.

Further, since the above-described bubble trapper unit is constituted by the first and second members which are connected with each other with the net wall being interposed therebetween, namely, since the bubble trapper unit is provided by three members to be combined together, a cumbersome operation is required in its manufacturing process. In this sense, there has been a demand for a bubble trapper unit having such a construction that simplifies its manufacturing process.

The above-described bubble trapper unit further has, in addition to the first filter, a second filter which is provided in the ink outlet formed through a lower end of a side wall defining the second section of the inner space (see FIG. 3 of US 2002/0057320 A1). Since the bubble trapper unit is positioned relative to the recording head such that the vertical direction of the second section of the inner space of the bubble trapper unit is held in parallel with the recording head, the ink outlet horizontally extends from a lower end part of the second section toward the recording head. The second filter is disposed in a distal end of the horizontally extending ink outlet, so that an ink passage from the second section toward the second filter includes a bent part. The bent part of the ink passage impedes rapid floatation of the bubbles trapped by the second filter, toward the upper wall of the inner space of the bubble trapper unit. Therefore, the trapped bubbles are likely to remain in vicinity of the second filter and grow to become larger in size. Consequently, the second filter is clogged with the bubbles, thereby impeding flow of the ink through the second filter. If a required amount of the ink is not delivered toward the recording head, the printer would become incapable of satisfactorily ejecting the ink.

Further, while the dynamic pressure of the ink is absorbed by the bubbles retained by the bubble retainer provided in the upper wall of the inner space in the above-described bubble trapper unit, there has been a demand for a still simpler arrangement enabling absorption of the dynamic pressure of the ink with a still higher efficiency.

As described above, if the ink having delivered to the recording head contains bubbles, the bubbles contained in the ink would cause failure in the ink ejection and the consequent deterioration in the quality of the printed image. For avoiding such a deterioration, an bubble trapper such as the above-described bubble trapper unit is provided to separate the bubbles from the ink and accumulate therein. It is therefore necessary to discharge the bubbles accumulated in the bubble trapper.

As a technique of discharging the bubbles from the bubble trapper, JP-A-2000-103084 discloses an inkjet printer including: a recording head mounted on a carriage; a manifold serving as the bubble trapper and disposed on an upper side of the recording head; an ink tank; and a circulation pump. The ink tank and the circulation pump are disposed on a stationary body of the inkjet printer. The circulation pump is operable to circulate the ink between the manifold and the ink tank, so that the bubbles are separated or removed from the ink within the ink tank, which ink has been collected from the manifold. The bubbles remaining in the ink, which has been delivered to the recording head, are sucked from a nozzle opening surface of the recording head, with execution of a purging operation. The bubbles are thus discharged together with the ink from the recording head through the nozzle opening surface.

Further, JP-A-2001-260388 discloses an inkjet printer including: a recording head; a buffer tank disposed on an upper side of the recording head; and an ink tank having a large capacity. In this inkjet printer, the ink is supplied to the buffer tank through a tube, and the bubbles are then separated from the ink in the buffer tank. The ink separated from the bubbles is delivered to the recording head. The bubbles accumulated in the buffer tank is sucked by a pump through a tube which is disposed in an upper portion of the buffer tank. The bubbles are thus discharged from the buffer tank.

Further, in the above-described bubble trapper unit of the inkjet printer disclosed in U.S. Patent Application Publication US 2002/0057320 A1 (corresponding to JP-A-2002-166568), the recessed portion is formed in the upper wall of the inner space of the bubble trapper unit, so that the dynamic pressure of the ink is absorbed by the bubbles retained by the bubble retainer provided by the recessed portion, as described above. The accumulated bubble are discharged from the bubble trapper unit in the purging operation which is effected with the carriage being positioned in a maintenance position. In the purging operation, the bubbles are sucked from the nozzle opening surface of the recording head, so as to be discharged together with the ink from the bubble trapper unit through the recording head. This US Patent Application Publication also teaches that the bubble trapper unit defines a plurality of mutually independent inner spaces (each of which corresponds to the above-described inner space) serving for respective different color inks, wherein the plurality of inner spaces are separated from each other by partition walls and are arranged in parallel with each other.

Where the plurality of mutually independent inner spaces or ink delivery channels are defined in a single body, it is common that the single body is provided by two members. A first member as one of the two members is configured to include a partition wall or walls which separate the ink delivery channels from each other. A second member as the other of the two members is attached to the first member, so as to close openings of the respective ink delivery channels. In this arrangement, if there is a gap between the second member and an end of the partition wall of the first member, there is caused a leakage between two adjacent ink delivery channels which are located on respective opposite sides of the partition wall in question. It is therefore necessary to check if there is a leakage in the unit, by measuring an air pressure within each of the ink delivery channels. The air pressure within each ink delivery channel is measured, while a predetermined amount of pressure is being applied into the ink delivery channel subjected to the measurement, for example, by supplying a pressurized air into the ink delivery channel.

If the above-described single body defines, in addition to the plurality of ink delivery channels, a plurality of bubble discharging channels or ink circulation channels each of which is held in communication with a corresponding one of the ink delivery channels, as disclosed in JP-A-2000-103084 and JP-A-2001-260388, the bubble discharging or ink circulation channels could extend substantially in a direction in which the ink delivery channels are arranged, so that one of the bubble discharging or ink circulation channels could have a part located to be adjacent to at least one of the plurality of ink delivery channels. In this case, it is not possible to simultaneously check a leakage of the at least one of the ink delivery channels and a leakage of one of the ink delivery channels that is held in communication with the above-described one of the bubble discharging or ink circulation channels including the adjacent part. Thus, the number of leakage checking steps required for the plurality of ink delivery channels is inevitably increased.

Meanwhile, there is known an arrangement (see JP-A-2003-237037) in which a driver circuit (operable to activate the recording head) is mounted on the carriage which carries the recording head and which is reciprocatable in a primary scanning direction (i.e., direction perpendicular to a direction in which a recording medium is to be fed). In the inkjet printer having this arrangement, a printing or recording operation is performed by ejecting the ink onto the recording medium through selected ones of the nozzles in response to a drive signal outputted from the driver circuit to the recording head. In the printing operation, each time the signal is outputted from the driver circuit to the recording head, a large amount of electric current momentarily flows through the driver circuit, thereby inducing an abrupt increase in temperature at the driver circuit. Since the number of the nozzles provided in the head unit has been increased for attending a need for printing a higher density of image at a higher speed, the driver circuit has to be equipped with an increased number of driver elements each serving exclusively for a corresponding one of the nozzles. That is, as a result of provision of the increased number of the nozzles, the number of the driver elements provided in the driver circuit has become larger, so that the temperature increase induced at the driver circuit has become more considerable. The considerable temperature increase caused deterioration and instability in electrical properties of the driver circuit, thereby impeding a stable ejection of the ink.

In view of this problem rising from the temperature increase, there has been designed an arrangement, as disclosed in JP-A-2003-237037, in which a heat dissipation unit (heat conductive body) is mounted on the carriage so that heat generated at the diver circuit can be dissipated. In the arrangement disclosed in JP-A-2003-237037, the heat dissipation unit is provided by a plate member which is bent to have a U shape in its cross section, and is fixed relative to the carriage, such that its central bottom portion is held in contact with the driver circuit which is mounted on the carriage, and such that major surfaces of its respective opposite end portions are held in substantially perpendicular to the primary scanning direction (in which the carriage is movable), whereby the generated heat can be effectively dissipated.

In the inkjet printer adapted to perform a full-color printing operation, the recording head is provided with a plurality of ink delivery channels, and the ink delivery unit is provided with a plurality of ink delivery channels which are held communication with the respective ink delivery channels of the recording head. It is preferable that the driver circuit for driving the recording head is positioned relative to the recording head such that a distance therebetween is minimized for minimizing electrical loss caused by an electric resistance. The driver circuit as a heat source is disposed on one of opposite sides of the plurality of ink delivery channels, which sides are opposite to each other in a direction in which the ink delivery channels are arranged. Therefore, the ink delivery channels are distant from the driver circuit by respective different distances, so as to be unevenly affected by the heat generated by the driver circuit. That is, there is inevitably caused difference between the plurality of ink delivery channels in degree of influence exerted thereto by the generated heat. Consequently, the bubbles within the delivery channel close to the driver circuit as the heat source are made to grow faster than those within the other delivery channel or channels.

Where the plurality of ink delivery channels are simultaneously subjected to the bubble discharging operation executed by activation of the circulation pump (as taught by JP-A-2000-103084) or by activation of a suction cap (which is brought into contact with the nozzle opening surface of the recording head), the bubble discharging operation has to be initiated at a point of time at which an amount or volume of bubbles accumulated in the delivery channel close to the driver circuit reaches a predetermined threshold, even if an amount of volume of bubbles accumulated in any other delivery channel has not yet reached the predetermined threshold. This means that the bubble discharging operation has to be executed very frequently. Further, even where the ink delivery channels are individually or independently subjected to the bubble discharging operation, the required number of times of the execution of the discharging operation is inevitably increased with increase of the number of the ink delivery channels. In either of theses cases, therefore, the bubble discharging operation has to be executed such a large number of times, resulting in a poor maneuverability of the inkjet printer. In addition, the large number of times of the execution of the bubble discharging operation leads to an increase in an amount of the ink which is discharged rather than being used for a recording operation.

SUMMARY OF THE INVENTION

The present invention was made in view of the background prior art discussed above. It is therefore a primary object of the invention to provide an inkjet printer which has a construction providing an improved maneuverability without suffering from the conventionally encountered problems as described above and which can be made in compact in size. It is a secondary object of the invention to provide an inkjet printer which has a plurality of ink delivery channels and which has a construction making it possible to reliably check the plurality of ink delivery channels for leakage for a short length of time. It is a tertiary object of the invention to provide a method of reliably checking the leakage of the plurality of ink delivery channels of the inkjet printer for a short length of time. The primary object may be achieved by an inkjet printer constructed according to any one of modes (1)-(46) and (49)-(83) as described below. The secondary object may be achieved by an inkjet printer constructed according to any one of modes (37)-(46) and (74)-(83) as described below. The tertiary object may be achieved by an inkjet printer constructed according to any one of modes (47), (48), (84) and (85) as described below. Each of the below-described modes is each of which is numbered like the appended claims and depends from the other mode or modes, where appropriate, to indicate and clarify possible combinations of elements or technical features. It is to be understood that the present invention is not limited to the technical features or any combinations thereof which will be described for illustrative purpose only. It is to be further understood that a plurality of elements or features included in any one of the following modes of the invention are not necessarily provided all together, and that the invention may be embodied without some of the elements or features described with respect to the same mode.

(1) An inkjet printer including: (a) a recording head operable to eject an ink onto a recording medium so as to perform a recording operation on the recording medium; (b) an ink source unit provided to store the ink that is to be supplied to the recording head; and (c) an ink delivery unit provided to delivery the ink supplied from the ink source unit, to the recording head, wherein the ink delivery unit has a delivery chamber which has a delivery chamber inlet and a delivery chamber outlet, such that the ink can be delivered through the delivery chamber inlet from the ink source unit, and such that the ink can be delivered through the delivery chamber outlet toward the recording head, wherein the delivery chamber is defined by a wall held in substantially parallel with a horizontal plane, and is elongated in a direction parallel with the wall, and wherein the delivery chamber inlet and outlet of the delivery chamber are positioned in respective positions which are substantially diagonal relative to each other.

(2) The inkjet printer according to mode (1), wherein the ink delivery unit includes a damper unit defining at least a part of an ink delivery channel through which the ink is to be delivered from the ink source unit to the recording head, so as to damp pressure fluctuation in the ink delivered through the ink delivery channel, wherein the damper unit has a damper chamber as the delivery chamber which has a damper chamber inlet as the delivery chamber inlet and a damper chamber outlet as the delivery chamber outlet, and wherein the damper chamber is defined by a damper wall as the wall.

(3) The inkjet printer according to mode (2), wherein the damper chamber inlet and outlet of the damper chamber are formed through a wall of the damper chamber which is opposed to the damper wall, and wherein the damper chamber inlet and outlet of the damper chamber are positioned in the respective positions which cooperate with each other to maximize a distance between the damper chamber inlet and outlet.

(4) The inkjet printer according to mode (2) or (3), wherein the damper unit has a guide rib which projects from one of mutually opposed walls of the damper chamber toward the other of the mutually opposed walls, and which defines an ink path through which the ink is to flow in a direction away from the damper chamber inlet toward the damper chamber outlet.

(5) The inkjet printer according to mode (4), wherein the damper chamber inlet and outlet of the damper chamber are formed through a wall of the damper chamber which is opposed to the damper wall, and wherein the guide rib projects from the wall of the damper chamber which is opposed to the damper wall, toward the damper wall.

(6) The inkjet printer according to mode (5), wherein the damper wall is provided by a flexible film, and wherein the rib has a distal end which is spaced apart from the flexible film.

(7) The inkjet printer according to mode (6), wherein the damper chamber is defined by rigid walls as upper and circumferential side walls thereof, and the damper wall as a bottom wall thereof, and wherein the rib projects from the upper wall and is formed integrally with the upper wall.

(8) The inkjet printer according to any one of modes (2)-(7), wherein the damper chamber outlet has an opening area larger than that of the damper chamber inlet.

(9) The inkjet printer according to any one of modes (1)-(8), wherein the ink delivery unit includes a buffer unit having a buffer chamber which accumulates, in a bubble trapper region of an inner space thereof, bubbles contained in the ink, wherein the buffer chamber has a buffer chamber inlet and a buffer chamber outlet formed through a wall thereof, such that the ink can be delivered through the buffer chamber inlet into the buffer chamber, and such that the ink can be delivered through the buffer chamber outlet from the buffer chamber toward the recording head, wherein the ink delivery unit further has a partition rib which projects inwardly from the wall of the buffer chamber, and wherein the partition rib divides a part of an inner space of the buffer chamber into an upstream-side region and a downstream-side region which the buffer chamber inlet and outlet face, respectively.

(10) The inkjet printer according to mode (9), wherein the ink delivery unit includes a damper unit defining at least a part of an ink delivery channel through which the ink is to be delivered from the ink source unit to the recording head, so as to damp pressure fluctuation in the ink delivered through the ink delivery channel, wherein the damper unit has a damper chamber as the delivery chamber, wherein the buffer chamber is disposed in a downstream side of the damper chamber, so as to accumulate, in the bubble trapper region of the inner space thereof, the bubbles contained in the ink having passed through the damper chamber, and wherein the buffer chamber inlet of the buffer chamber serves as the delivery chamber outlet of the delivery chamber.

(11) The inkjet printer according to mode (10), wherein the wall of the buffer chamber is provided by a partition wall which separates the buffer chamber and the damper chamber from each other, and wherein the damper chamber is defined by a flexible film providing a wall of the damper chamber opposed to the partition wall.

(12) The inkjet printer according to mode (11), wherein the wall of the buffer chamber provided by the partition wall corresponds to a bottom wall of the buffer chamber which is parallel with a horizontal plane, and wherein the bubble trapper region of the inner space of the buffer chamber is a region adjacent to an upper wall of the buffer chamber.

(13) The inkjet printer according to mode (11) or (12), wherein at least a part of the buffer chamber overlaps the damper chamber in a plan view of the ink damper unit, and wherein the buffer chamber is smaller in cross sectional area as measured along a horizontal plane, than the damper chamber.

(14) The inkjet printer according to mode (9), wherein the ink delivery unit is provided by a lower casing member having an upper opening, and an upper casing member covering the upper opening of the lower casing member, wherein the lower and upper casing members of the ink delivery unit cooperate with each other to define the buffer chamber and the delivery chamber, wherein the buffer chamber inlet and the buffer chamber outlet are formed through a bottom wall of the buffer chamber, and wherein the partition rib inwardly projecting from the bottom wall of the buffer chamber has a distal end that is spaced from the upper casing member.

(15) The inkjet printer according to mode (14), wherein the recording head has a nozzle opening surface in which nozzles open, such that the ink can be ejected through the nozzles onto the recording medium, wherein the ink delivery unit has the delivery chamber which is held in communication with the ink source unit and which is located on a lower side of the bottom wall of the buffer chamber, wherein at least a part of the delivery chamber overlaps the upstream-side region of the divided part of the inner space of the buffer chamber in a plan view of the ink delivery unit, and wherein at least a portion of the recording head overlaps the downstream-side region of the divided part of the inner space of the buffer chamber in the plan view, such that the nozzle opening surface is held in parallel with the bottom wall of the buffer chamber.

(16) The inkjet printer according to mode (15), wherein the delivery chamber is defined by the bottom wall of the buffer chamber and a flexible film which is spaced apart from the bottom wall, such that pressure fluctuation in the ink is damped in the delivery chamber serving as a damper chamber.

(17) The inkjet printer according to any one of modes (1)-(16), further including a heat emitter or source which emits or generates heat when operated in association with ink ejecting action of the recording head, wherein the ink delivery unit has a main body defining a plurality of first delivery channels each of which is held in communication with a corresponding one of a plurality of second delivery channels defined in the recording head, wherein the first delivery channels extend substantially in parallel with each other and are separated from each other by partition walls, wherein the heat source is disposed on a side of the main body of the ink delivery unit, and wherein one of the first delivery channels, which is closer to the heat source than the other of the first delivery channels, is larger in volume than the other of the first delivery channels. It is noted that the above-described delivery chamber may or may not be held in communication with at least one of the first delivery channels.

(18) The inkjet printer according to mode (17), wherein a ratio of the volume of the one of the first delivery channels to the volume of each of the other of the first delivery channels is at least 110%.

(19) The inkjet printer according to mode (17) or (18), wherein the heat source includes a driver chip having a driver circuit which is operable to generate an electric signal for causing the ink to be ejected through at least one of nozzles of the recording head.

(20) The inkjet printer according to mode (19), further including a flexible wiring cable which is connected to the recording head, wherein the driver chip is disposed on the flexible wiring cable such that the electric signal generated by the driver circuit of the driver chip is supplied to the recording head through the flexible wiring cable, wherein the main body of the ink delivery unit is disposed on one of opposite sides of the recording head that is remote from a nozzle opening surface of the recording head in which the nozzles open, such that the main body is held substantially in parallel with the recording head, wherein the flexible wiring cable extends from the recording head substantially in a direction in which the first delivery channels are arranged, and wherein the driver chip is held substantially in parallel to a direction in which the first delivery channels extend.

(21) The inkjet printer according to mode (19) or (20), further including a heat dissipation unit which is disposed in thermally conductive communication with the driver chip and which includes a major portion held substantially in parallel to a direction in which the first delivery channels extend.

(22) The inkjet printer according to any one of modes (17)-(21), wherein each of the first delivery channels defined in the main body has a part serving as a damper chamber which damps pressure fluctuation in the ink that is to be delivered to the recording head.

(23) The inkjet printer according to mode (21) or (22), further including a bubble discharger unit which is operable to bring each of the first delivery channels into communication with an exterior of the main body of the ink delivery unit, for discharging bubbles accumulated in each of the first delivery channels, and which is positioned relative to the heat dissipation unit such that the first delivery channels are located between the bubble discharger unit and the heat dissipation unit.

(24) The inkjet printer according to any one of modes (1)-(23), wherein the recording head is disposed on a carriage which is movable relative to the recording medium, wherein the ink source unit is disposed in a stationary body of the inkjet printer, wherein the ink delivery unit is disposed on the carriage, such that the ink can be delivered to the ink delivery unit through an ink tube from the ink source unit, and such that the ink can be delivered to the recording head from the ink delivery unit, wherein the ink delivery unit has an ink storage chamber sectioned into a damper section and a bubble trapper section which is held in communication with the damper section and which accumulates bubbles contained in the ink, wherein the ink storage chamber has an air discharging hole such that the bubbles accumulated in the bubble trapper section can be discharged through the discharging hole to an exterior of the ink delivery unit, wherein the ink storage chamber has an ink storage chamber inlet and an ink storage chamber outlet, such that the ink can be delivered through the ink storage chamber inlet into the damper section from the ink tube, and such that the ink can be delivered through the ink storage chamber outlet from the bubble trapper section toward the recording head, and wherein the bubble trapper section and the air discharging hole are located substantially right above the ink storage chamber outlet. It is noted that the damper section may be provided to serve as the above-described delivery chamber as in mode (25), or alternatively may be provided in addition to the delivery chamber.

(25) The inkjet printer according to mode (24), wherein the damper section of the ink storage chamber serves as the delivery chamber.

(26) The inkjet printer according to mode (24) or (25), wherein the damper section of the ink storage chamber is defined by a damper unit which is included in the ink delivery unit.

(27) The inkjet printer according to any one of modes (24)-(26), wherein the damper section of the ink storage chamber retains air, and is defined by a flexible film which provides an upper wall thereof.

(28) The inkjet printer according to any one of modes (24)-(27), wherein the air discharging hole is positioned in vicinity of a portion of a circumferential side wall defining the ink storage chamber, which portion defines a downstream-side region of the ink storage chamber.

(29) The inkjet printer according to any one of modes (24)-(28), wherein the ink delivery unit has an air retainer rib which projects downwardly from an upper wall of the ink storage chamber and which surrounds at least a part of the damper section, and wherein the air retainer rib has a distal end which is spaced apart from a bottom wall of the ink storage chamber.

(30) The inkjet printer according to any one of modes (24)-(29), wherein the ink delivery unit has first and second partition walls which project downwardly from an upper wall of the ink storage chamber and which have respective distal ends spaced apart from a bottom wall of the ink storage chamber, and wherein the first partition wall is disposed between the ink storage chamber inlet and the damper section, while the second partition wall is disposed between the damper section and the bubble trapper section, such that the damper section is defined by and between the first and second partition walls.

(31) The inkjet printer according to any one of modes (24)-(30), wherein the ink delivery unit has a plurality of ink storage chambers each of which corresponds to the ink storage chamber and each of which stores a corresponding one of different inks, wherein the ink storage chambers extend substantially in parallel with each other, wherein the ink storage chambers have respective ink storage chamber outlets each of which corresponds to the ink storage chamber outlet and each of which is formed through a bottom wall of a corresponding one of the ink storage chambers, and wherein each of the ink storage chamber outlets is located in one of opposite end portions of a corresponding one of the ink storage chambers, such that the ink storage chamber outlets are adjacent to each other so as to be connected to respective ink inlets of the recording head.

(32) The inkjet printer according to any one of modes (1)-(31), wherein the recording head is disposed on a carriage which is movable relative to a recording medium, wherein the ink source unit is disposed in a stationary body of the inkjet printer, wherein the ink delivery unit is disposed on the carriage, such that the ink can be delivered to the ink delivery unit through an ink tube from the ink source unit, and such that the ink can be delivered to the recording head from the ink delivery unit, wherein the ink delivery unit defines an ink storage chamber having, in an upper part thereof, a damper section which retains air, wherein the ink storage chamber has an ink storage chamber inlet which is located on an upstream side of the damper section, wherein the ink storage chamber has an ink storage chamber outlet which is located on a downstream side of the damper section and which is formed through a bottom wall of the ink storage chamber, and wherein the bottom wall of the ink storage chamber has at least one groove formed in an inside surface thereof and extending in a direction away from the ink storage chamber inlet toward ink storage chamber outlet.

(33) The inkjet printer according to mode (32), wherein the damper section of the ink storage chamber is defined by a damper unit which is included in the ink delivery unit, and wherein the ink delivery unit defines, in addition to the ink storage chamber having the ink storage chamber inlet and outlet, the delivery chamber having the delivery chamber inlet and outlet.

(34) The inkjet printer according to mode (32) or (33), wherein the ink delivery unit has an air retainer rib which projects from an upper wall of the ink storage chamber toward a bottom wall of the ink storage chamber, and which defines the damper section of the ink storage chamber.

(35) The inkjet printer according to any one of modes (32)-(34), wherein the at least one groove includes a pair of grooves which are formed in respective opposite end portions of the inside surface of the bottom wall of the ink storage chamber.

(36) The inkjet printer according to any one of modes (32)-(35), wherein the ink storage chamber has, in the upper part thereof, a bubble trapper section which is located on a downstream side of the damper section and which accumulates bubbles contained in the ink, and wherein at least a portion of each of the at least one groove is located right below the damper section.

(37) The inkjet printer according to any one of modes (1)-(36), wherein the ink delivery unit has a main body defining at least three first delivery channels which extend substantially in parallel with each other and which are separated from each other by partition walls, wherein the ink delivery unit further has a cover member which is fixed to a surface of the main body, wherein the recording head defines at least three second delivery channels, wherein the first delivery channels are held in communication with the respective second delivery channels and respective third delivery channels which are defined in the main body of the ink delivery unit, wherein the first and third delivery channels open in the surface of the main body which is covered by the cover member, wherein one of the third delivery channels held in communication with one of the first delivery channels is closer to the first delivery channels than the other of the third delivery channels, wherein the main body has a recess formed in the surface thereof, such that the recess has a part which is located between the one of the third delivery channels and another one of the first delivery channels, and wherein at least one of the first delivery channels, which is other than the one and another one of the first delivery channels, is located between the one and another one of the first delivery channels. It is noted that the above-described delivery chamber may or may not be held in communication with at least one of the first delivery channels.

(38) The inkjet printer according to mode (37), wherein the recess is held in communication with an atmosphere.

(39) The inkjet printer according to modes (37) or (38), wherein the one of the first delivery channels held in communication with the one of the third delivery channels is an endmost one of the first delivery channels as viewed in an arrangement direction in which the first delivery channels are arranged, and wherein the one of the third delivery channels extends, at least at a part thereof closer to the first delivery channels than the other part thereof, in the arrangement direction.

(40) The inkjet printer according to mode any one of modes (37)-(39), wherein the first casing member has, in a portion thereof, a plurality of openings which are defined by the partition walls, such that at least a part of each of the first delivery channels opens through a corresponding one of the openings, wherein each of the third delivery channels is held in communication at an end part thereof with a corresponding one of the first delivery channels, and wherein each of at least one of the third delivery channels has a closer part which is closer to the openings than the end part thereof and which extends in an arrangement direction in which the first delivery channels are arranged.

(41) The inkjet printer according to any one of modes (37)-(40), wherein the main body of the ink delivery unit is provided by first and second casing members which are connected to cooperate with each other to define the first delivery channels, wherein the first casing member has, in a portion thereof, a plurality of openings which are defined by the partition walls, such that a part of each of the first delivery channels opens through a corresponding one of the openings, and such that another part of each of the first delivery channels is covered by another portion of the first casing member, wherein the third delivery channels are provided by respective grooves which open in the another portion of the first casing member, and wherein the openings and the grooves are covered by a single cover member as the cover member.

(42) The inkjet printer according to any one of modes (37)-(41), wherein each of the first delivery channels defined in the main body has a part serving as a damper chamber which damps pressure fluctuation in the ink that is to be delivered from the ink source unit to the second delivery channels of the recording head.

(43) The inkjet printer according to mode (42), wherein the cover member is provided by a flexible film which is deformable by the pressure fluctuation in the ink.

(44) The inkjet printer according to mode (42) or (43), wherein each of the third delivery channels is a discharging passage which is provided to discharge bubbles accumulated in the damper chamber.

(45) The inkjet printer according to mode (44), further including a bubble discharger unit which is operable to bring the discharging passage into communication with an exterior of the main body of the ink delivery unit, and which is provided in an end portion of the main body as viewed in an arrangement direction in which the first delivery channels are arranged.

(46) The inkjet printer according to any one of modes (37)-(45), wherein each of the first delivery channels is an ink delivery channel through which the ink is to be delivered from the ink source unit to the second delivery channels of the recording head.

(47) A method of checking if there is a leakage in the delivery unit of the inkjet printer defined in any one of modes (37)-(46), the method including: a step of supplying a positively or negatively pressurized fluid into at least two of the first delivery channels and the third delivery channels each of which is held in communication with a corresponding one of the at least two of the first delivery channels, wherein the at least two of the first delivery channels are located on opposite sides of at least one of the first delivery channels which is other than the at least two of the first delivery channels.

(48) The method according to mode (47), wherein each of the first delivery channels has first, second and third opening ends, wherein each of the first delivery channels is connected at the second opening end with a corresponding one of the second delivery channels, wherein each of the first delivery channels is connected at the third opening end with one of opposite opening ends of a corresponding one of the third delivery channels, and wherein the step is implemented by supplying the pressurized fluid simultaneously into the at least two of the first delivery channels and the third delivery channels, through the first opening end of each of the at least two of the first delivery channels, while the second opening end of each of the at least two of the first delivery channels and the other of the opposite opening ends of each of the third delivery channels are closed.

(49) An inkjet printer including: (a) a recording head operable to eject an ink onto a recording medium so as to perform a recording operation on the recording medium; (b) an ink source unit provided to store the ink that is to be delivered to the recording head; and (c) a damper unit defining at least a part of an ink delivery channel through which the ink is to be delivered from the ink source unit to the recording head, so as to damp pressure fluctuation in the ink delivered through the ink delivery channel, wherein the damper unit includes a buffer unit having a buffer chamber which accumulates, in a region of an inner space thereof, bubbles contained in the ink, wherein the buffer chamber has a buffer chamber inlet and a buffer chamber outlet formed through a wall thereof, such that the ink can be delivered through the buffer chamber inlet into the buffer chamber, and such that ink can be delivered through the buffer chamber outlet from the buffer chamber toward the recording head, wherein the damper unit further has a partition rib which projects inwardly from the wall of the buffer chamber, and wherein the partition rib divides a part of an inner space of the buffer chamber into an upstream-side region and a downstream-side region which the buffer chamber inlet and outlet face, respectively.

(50) An inkjet printer including: (a) a recording head operable to eject an ink onto a recording medium so as to perform a recording operation on the recording medium; (b) an ink source unit provided to store the ink that is to be delivered to the recording head; and (c) a damper unit defining at least a part of an ink delivery channel through which the ink is to be delivered from the ink source unit to the recording head, so as to damp pressure fluctuation in the ink delivered through the ink delivery channel, wherein the damper unit has a damper chamber and a buffer chamber which is disposed in a downstream side of the damper chamber and which accumulates, in a bubble trapper region of an inner space thereof, bubbles contained in the ink having passed through the damper chamber, wherein the buffer chamber has a buffer chamber inlet and a buffer chamber outlet formed through a wall thereof, such that the ink can be delivered through the buffer chamber inlet into the buffer chamber from the damper chamber, and such that the ink can be delivered through the buffer chamber outlet from the buffer chamber toward the recording head, wherein the damper unit further has a partition rib which projects inwardly from the wall of the buffer chamber, and wherein the partition rib divides a part of an inner space of the buffer chamber into an upstream-side region and a downstream-side region which the buffer chamber inlet and outlet face, respectively.

(51) The inkjet printer according to mode (50), wherein the wall of the buffer chamber is provided by a partition wall which separates the buffer chamber and the damper chamber from each other, and wherein the damper chamber is defined by a flexible film providing a wall of the damper chamber opposed to the partition wall.

(52) The inkjet printer according to mode (51), wherein the wall of the buffer chamber provided by the partition wall corresponds to a bottom wall of the buffer chamber which is parallel with a horizontal plane, and wherein the bubble trapper region of the inner space of the buffer chamber is a region adjacent to an upper wall of the buffer chamber.

(53) The inkjet printer according to mode (51) or (52), wherein at least a part of the buffer chamber overlaps the damper chamber in a plan view of the ink damper unit, and wherein the buffer chamber is smaller in cross sectional area as measured along a horizontal plane, than the damper chamber.

(54) An inkjet printer including: (a) a recording head operable to eject an ink onto a recording medium so as to perform a recording operation on the recording medium; (b) an ink source unit provided to store the ink that is to be delivered to the recording head; and (c) a damper unit defining at least a part of an ink delivery channel through which the ink is to be delivered from the ink source unit to the recording head, so as to damp pressure fluctuation in the ink delivered through the ink delivery channel, wherein the damper unit is provided by a lower casing member having an upper opening, and an upper casing member covering the upper opening of the lower casing member, wherein the lower and upper casing members cooperate with each other to defines a buffer chamber which accumulates, in a bubble trapper region of an inner space thereof, bubbles contained in the ink, wherein the buffer chamber has a buffer chamber inlet and a buffer chamber outlet formed through a bottom wall thereof, such that the ink can be delivered through the buffer chamber inlet into the buffer chamber, and such that the ink can be delivered through the buffer chamber outlet from the buffer chamber toward the recording head, wherein the damper unit further has a partition rib which inwardly projects from the bottom wall of the buffer chamber and which has a distal end that is spaced from the upper casing member, and wherein the partition rib divides a part of an inner space of the buffer chamber into an upstream-side region and a downstream-side region which the buffer chamber inlet and outlet face, respectively.

(55) The inkjet printer according to mode (54), wherein the recording head has a nozzle opening surface in which nozzles open, such that the ink can be ejected through the nozzles onto the recording medium, wherein the damper unit has a delivery channel or chamber which is held in communication with the ink source unit and which is located on a lower side of the bottom wall of the buffer chamber, wherein at least a part of the delivery chamber overlaps the upstream-side region of the divided part of the inner space of the buffer chamber in a plan view of the damper unit, and wherein at least a portion of the recording head overlaps the downstream-side region of the divided part of the inner space of the buffer chamber in the plan view, such that the nozzle opening surface is held in parallel with the bottom wall of the buffer chamber.

(56) The inkjet printer according to mode (55), wherein the delivery channel or chamber is defined by the bottom wall of the buffer chamber and a flexible film which is spaced apart from the bottom wall, such that pressure fluctuation in the ink is damped in the delivery chamber serving as a damper chamber.

(57) An inkjet printer including: (a) a recording head operable to eject an ink onto a recording medium so as to perform a recording operation on the recording medium; (b) an ink delivery unit provided to delivery the ink to the recording head, and (c) a heat emitter or source which emits or generates heat when operated in association with ink ejecting action of the recording head, wherein the ink delivery unit has a main body defining a plurality of first delivery channels each of which is held in communication with a corresponding one of a plurality of second delivery channels defined in the recording head, wherein the first delivery channels extend substantially in parallel with each other and are separated from each other by partition walls, wherein the heat source is disposed on a side of the main body of the ink delivery unit, and wherein one of the first delivery channels, which is closer to the heat source than the other of the first delivery channels, is larger in volume than the other of the first delivery channels.

(58) The inkjet printer according to mode (57), wherein a ratio of the volume of the one of the first delivery channels to the volume of each of the other of the first delivery channels is at least 110%, and is preferably at least 120%.

(59) The inkjet printer according to mode (57) or (58), wherein the heat source includes a driver chip having a driver circuit which is operable to generate an electric signal for causing the ink to be ejected through at least one of nozzles of the recording head.

(60) The inkjet printer according to mode (59), further including a flexible wiring cable which is connected to the recording head, wherein the driver chip is disposed on the flexible wiring cable such that the electric signal generated by the driver circuit of the driver chip is supplied to the recording head through the flexible wiring cable, wherein the main body of the ink delivery unit is disposed on one of opposite sides of the recording head that is remote from a nozzle opening surface of the recording head in which the nozzles open, such that the main body is held substantially in parallel with the recording head, wherein the flexible wiring cable extends from the recording head substantially in a direction in which the first delivery channels are arranged, and wherein the driver chip is held substantially in parallel to a direction in which the first delivery channels extend.

(61) The inkjet printer according to mode (59) or (60), further including a heat dissipation unit which is disposed in thermally conductive communication with the driver chip and which includes a major portion held substantially in parallel to a direction in which the first delivery channels extend.

(62) The inkjet printer according to any one of mode (57)-(61), wherein each of the first delivery channels defined in the main body has a part serving as a damper chamber which damps pressure fluctuation in the ink that is to be delivered to the recording head.

(63) The inkjet printer according to mode (61) or (62), further including a bubble discharger unit which is operable to bring each of the first delivery channels into communication with an exterior of the main body of the ink delivery unit, for discharging bubbles accumulated in each of the first delivery channels, and which is positioned relative to the heat dissipation unit such that the first delivery channels are located between the bubble discharger unit and the heat dissipation unit.

(64) An inkjet printer including: (a) a recording head disposed on a carriage which is movable relative to a recording medium; (b) an ink source unit disposed in a stationary body of the inkjet printer and storing the ink that is to be delivered to the recording head; and (c) a damper unit disposed on the carriage, such that the ink can be delivered to the damper unit through an ink tube from the ink source unit, and such that the ink can be delivered to the recording head from the damper unit, wherein the damper unit has an ink storage chamber sectioned into a damper section and a bubble trapper section which is held in communication with the damper section and which accumulates bubbles contained in the ink, wherein the ink storage chamber has an air discharging hole such that the bubbles accumulated in the bubble trapper section can be discharged through the discharging hole to an exterior of the damper unit, wherein the ink storage chamber has an ink storage chamber inlet and an ink storage chamber outlet, such that the ink can be delivered through the ink storage chamber inlet into the damper section from the ink tube, and such that the ink can be delivered through the ink storage chamber outlet from the bubble trapper section toward the recording head, and wherein the bubble trapper section and the air discharging hole are located substantially right above the ink storage chamber outlet.

(65) The inkjet printer according to mode (64), wherein the damper section of the ink storage chamber retains air, and is defined by a flexible film which provides an upper wall thereof.

(66) The inkjet printer according to mode (64) or (65), wherein the air discharging hole is positioned in vicinity of a portion of a circumferential side wall defining the ink storage chamber, which portion defines a downstream-side region of the ink storage chamber.

(67) The inkjet printer according to any one of modes (64)-(66), wherein the ink delivery unit has an air retainer rib which projects downwardly from an upper wall of the ink storage chamber and which surrounds at least a part of the damper section, and wherein the air retainer rib has a distal end which is spaced apart from a bottom wall of the ink storage chamber.

(68) The inkjet printer according to any one of modes (64)-(67), wherein the ink delivery unit has first and second partition walls which project downwardly from an upper wall of the ink storage chamber and which have respective distal ends spaced apart from a bottom wall of the ink storage chamber, and wherein the first partition wall is disposed between the ink storage chamber inlet and the damper section, while the second partition wall is disposed between the damper section and the bubble trapper section, such that the damper section is defined by and between the first and second partition walls.

(69) The inkjet printer according to any one of modes (64)-(68), wherein the ink delivery unit has a plurality of ink storage chambers each of which corresponds to the ink storage chamber and each of which stores a corresponding one of different inks, wherein the ink storage chambers extend substantially in parallel with each other, wherein the ink storage chambers have respective ink storage chamber outlets each of which corresponds to the ink storage chamber outlet and each of which is formed through a bottom wall of a corresponding one of the ink storage chambers, and wherein each of the ink storage chamber outlets is located in one of opposite end portions of a corresponding one of the ink storage chambers, such that the ink storage chamber outlets are adjacent to each other so as to be connected to respective ink inlets of the recording head.

(70) An inkjet printer including: (a) a recording head disposed on a carriage which is movable relative to a recording medium; (b) an ink source unit disposed in a stationary body of the inkjet printer and storing the ink that is to be delivered to the recording head; and (c) a damper unit disposed on the carriage, such that the ink can be delivered to the damper unit through an ink tube from the ink source unit, and such that the ink can be delivered to the recording head from the damper unit, wherein the damper unit has an ink storage chamber having, in an upper part thereof, a damper section which retains air, wherein the ink storage chamber has an ink storage chamber inlet which is located on an upstream side of the damper section, wherein the ink storage chamber has an ink storage chamber outlet which is located on a downstream side of the damper section and which is formed through a bottom wall of the ink storage chamber, and wherein the bottom wall of the ink storage chamber has at least one groove formed in an inside surface thereof and extending in a direction away from the ink storage chamber inlet toward ink storage chamber outlet.

(71) The inkjet printer according to mode (70), wherein the ink delivery unit has an air retainer rib which projects from an upper wall of the ink storage chamber toward a bottom wall of the ink storage chamber, and which defines the damper section of the ink storage chamber.

(72) The inkjet printer according to mode (70) or (71), wherein the at least one groove includes a pair of grooves which are formed in respective opposite end portions of the inside surface of the bottom wall of the ink storage chamber.

(73) The inkjet printer according to any one of modes (70)-(72), wherein the ink storage chamber has, in the upper part thereof, a bubble trapper section which is located on a downstream side of the damper section and which accumulates bubbles contained in the ink, and wherein at least a portion of each of the at least one groove is located right below the damper section.

(74) An inkjet printer including: (a) a recording head operable to eject an ink onto a recording medium so as to perform a recording operation on the recording medium; and (b) an ink delivery unit provided to delivery the ink to the recording head, wherein the ink delivery unit has a main body defining at least three first delivery channels which extend substantially in parallel with each other and which are separated from each other by partition walls, wherein the ink delivery unit further has a cover member which is fixed to a surface of the main body, wherein the recording head defines at least three second delivery channels, wherein the first delivery channels are held in communication with the respective second delivery channels and respective third delivery channels which are defined in the main body of the ink delivery unit, wherein the first and third delivery channels open in the surface of the main body which is covered by the cover member, wherein one of the third delivery channels held in communication with one of the first delivery channels is closer to the first delivery channels than the other of the third delivery channels, wherein the main body has a recess formed in the surface thereof, such that the recess has a part which is located between the one of the third delivery channels and another one of the first delivery channels, and wherein at least one of the first delivery channels, which is other than the one and another one of the first delivery channels, is located between the one and another one of the first delivery channels.

(75) The inkjet printer according to mode (74), wherein the recess is held in communication with an atmosphere.

(76) The inkjet printer according to mode (74) or (75), wherein the one of the first delivery channels held in communication with the one of the third delivery channels is an endmost one of the first delivery channels as viewed in an arrangement direction in which the first delivery channels are arranged, and wherein the one of the third delivery channels extends, at least at a part thereof closer to the first delivery channels than the other part thereof, in the arrangement direction.

(77) The inkjet printer according to any one of modes (74)-(76), wherein the first casing member has, in a portion thereof, a plurality of openings which are defined by the partition walls, such that at least a part of each of the first delivery channels opens through a corresponding one of the openings, wherein each of the third delivery channels is held in communication at an end part thereof with a corresponding one of the first delivery channels, and wherein each of at least one of the third delivery channels has a closer part which is closer to the openings than the end part thereof and which extends in an arrangement direction in which the first delivery channels are arranged.

(78) The inkjet printer according to any one of modes (74)-(77), wherein the main body of the ink delivery unit is provided by first and second casing members which are connected to cooperate with each other to define the first delivery channels, wherein the first casing member has, in a portion thereof, a plurality of openings which are defined by the partition walls, such that a part of each of the first delivery channels opens through a corresponding one of the openings, and such that another part of each of the first delivery channels is covered by another portion of the first casing member, wherein the third delivery channels are provided by respective grooves which open in the another portion of the first casing member, and wherein the openings and the grooves are covered by a single cover member as the cover member.

(79) The inkjet printer according to any one of modes (74)-(78), wherein each of the first delivery channels defined in the main body has a part serving as a damper chamber which damps pressure fluctuation in the ink that is to be delivered from the ink source unit to the second delivery channels of the recording head.

(80) The inkjet printer according to mode (79), wherein the cover member is provided by a flexible film which is deformable by the pressure fluctuation in the ink.

(81) The inkjet printer according to mode (79) or (80), wherein each of the third delivery channels is a discharging passage which is provided to discharge bubbles accumulated in the damper chamber.

(82) The inkjet printer according to mode (81), further including a bubble discharger unit which is operable to bring the discharging passage into communication with an exterior of the main body of the ink delivery unit, and which is provided in an end portion of the main body as viewed in an arrangement direction in which the first delivery channels are arranged.

(83) The inkjet printer according to any one of modes (74)-(82), wherein each of the first delivery channels is an ink delivery channel through which the ink is to be delivered from the ink source unit to the second delivery channels of the recording head.

(84) A method of checking if there is a leakage in the delivery unit of the inkjet printer defined in any one of modes (74)-(83), the method including: a step of supplying a positively or negatively pressurized fluid into at least two of the first delivery channels and the third delivery channels each of which is held in communication with a corresponding one of the at least two of the first delivery channels, wherein the at least two of the first delivery channels are located on opposite sides of at least one of the first delivery channels which is other than the at least two of the first delivery channels.

(85) The method according to mode (84), wherein each of the first delivery channels has first, second and third opening ends, wherein each of the first delivery channels is connected at the second opening end with a corresponding one of the second delivery channels, wherein each of the first delivery channels is connected at the third opening end with one of opposite opening ends of a corresponding one of the third delivery channels, and wherein the step is implemented by supplying the pressurized fluid simultaneously into the at least two of the first delivery channels and the third delivery channels, through the first opening end of each of the at least two of the first delivery channels, while the second opening end of each of the at least two of the first delivery channels and the other of the opposite opening ends of each of the third delivery channels are closed.

TECHNICAL EFFECTS OF THE MODES OF THE INVENTION

In the inkjet printer constructed according to any one of the above-described modes (1)-(46), although the delivery chamber is flat or elongated in the direction parallel with the wall which defines the delivery chamber, the flow of the ink within the delivery chamber is stabilized, owing to the positional relationship between the delivery chamber inlet and outlet which are positioned in the respective positions which are substantially diagonal relative to each other. As a result of the stabilization in the ink flow within the delivery chamber, the ink and bubbles contained in the ink can easily flow out of the delivery chamber through the delivery chamber outlet.

In the inkjet printer constructed according to any one of the above-described modes (2)-(8), the damper chamber as the delivery chamber is defined by the damper wall and is elongated in the direction parallel with the damper wall. Where the thus constructed damper chamber is used in combination with other damper chamber or chambers, namely, where the damper unit is constituted by the thus constructed damper chamber and the other damper chamber or chambers for enabling the inkjet printer to eject a plurality of different color inks, the damper unit as a whole can be made in compact in size.

In the inkjet printer constructed according to any one of the above-described modes (4)-(7), the flow of the ink from the damper chamber inlet as the delivery chamber inlet toward the damper chamber outlet as the delivery chamber outlet is further stabilized owing to the guide rib serving to guide the ink along the ink path which is defined by the guide rib.

In the inkjet printer constructed according to any one of the above-described modes (5)-(7), since the damper chamber inlet is formed through the wall opposed to the damper wall, the ink flowing into the damper chamber can be received directly by the damper wall, whereby the dynamic pressure of the ink can be effectively absorbed or damped. Further, the guide rib, which is arranged to project from the wall opposed to the damper wall, serves to prevent the damper wall (such as the flexible film) from being brought in contact with the opposed wall, so as to maintain the fluid passage between the damper chamber inlet and outlet. Without the thus arranged guide rib, the delivery of the ink and bubbles could be impeded by possible contact of the damper wall with the opposed wall, thereby causing problematic delay of the flow of the ink and bubbles. Still further, since the damper chamber inlet and outlet are both formed through the same wall (opposed to the damper wall), the ink path therebetween can be continuously defined by the rib which extends therebetween.

In the inkjet printer constructed according to the above-described mode (6) or (7) in which the distal end of the rib is spaced apart from the flexible film as the damper wall, the ink can be distributed over an entirety of the flexible film in a region of an inner space within the damper chamber which region is adjacent to the flexible film. That is, the distribution of the ink over the entirety of the flexible film in that region is not impeded by the rib, thereby allowing the dynamic pressure of the ink introduced into the damper chamber through damper chamber inlet, to be absorbed by the entire flexible film which has a wide area, namely, making it possible to assure a high degree of damping performance of the damper chamber.

In the inkjet printer constructed according to the above-described mode (7) in which the rib projects from the wall, the bubbles floated upwardly can be efficiently guided by the guide rib, toward the damper chamber outlet.

In the inkjet printer constructed according to the above-described mode (8) in which the opening of the damper chamber outlet is larger than that of the damper chamber inlet, the bubbles contained in the ink can be discharged from the damper chamber through an increased efficiency.

In the inkjet printer constructed according to any one of the above-described modes (9)-(16) and (49)-(56), the inner space of the buffer chamber is partially divided by the partition rib into the upstream-side region and the downstream-side region which the buffer chamber inlet and outlet face, respectively. Therefore, irrespective of sizes of the bubbles, the bubbles contained in the ink is delivered from the buffer chamber inlet toward the buffer chamber out, bypassing the partition rib. This arrangement avoids the bubbles from being delivered directly from the inlet to the outlet, thereby making it possible to prevent the bubbles from being delivered toward the recording head. Further, even where the shortest distance between the inlet and outlet is small, the fluid passage (along which the ink actually flows) can be lengthen owing to the partition rib, whereby the bubbles are more likely to be separated from the ink and floated up toward the bubble trapper region of the inner space of the buffer chamber. Thus, the increase in the length of the fluid passage within the chamber facilitates accumulation of the bubbles in the bubble trapper region.

In the inkjet printer constructed according to any one of the above-described modes (10)-(13) and (50)-(53), since the ink is delivered into the buffer chamber after having passed through the damper chamber which is located in an upstream side of the buffer chamber, namely, since the damper chamber is formed independently of the buffer chamber, the damper chamber can be formed to have such a construction that provides a high degree of damping effect, without a limitation given by construction of other component such as the buffer chamber.

In the inkjet printer constructed according to any one of the above-described modes (11)-(13) and (51)-(53), since the flexible film sealing or defining the damper chamber constitutes the wall of the damper chamber (that is opposed to the partition wall), the flexible film may be provided by a film having a wide area, thereby making it possible to provide a high capacity of absorbing the dynamic pressure of the ink. Further, since the partition wall provides a wall which is common to the buffer and damper chambers, the ink delivery unit can be made compact in size, even where the ink delivery unit includes the buffer and damper chamber which are formed individually from each other.

In the inkjet printer constructed according to the above-described mode (12) or (52), the wall of the buffer chamber through which the buffer chamber inlet and outlet are formed corresponds to the bottom wall of the buffer chamber, while the partition rib projects inwardly from the bottom wall. Therefore, the ink flowing into the buffer chamber is made to pass through the region adjacent to the upper wall of the buffer chamber so as to bypass the partition rib, and is discharged from the buffer chamber through the buffer chamber outlet. This arrangement causing the ink to pass through the region adjacent to the upper wall of the buffer chamber facilitates flotation of each bubble as a gas and accumulation of the bubbles in the bubble trapper region which is provided by the region adjacent to the upper wall of the buffer chamber.

In the inkjet printer constructed according to the above-described mode (13) or (53) in which at least a part of the buffer chamber overlaps the damper chamber in the plan view, the ink delivery unit or an assembly of the buffer and damper units can be made compact in size as seen in the plan view.

In the inkjet printer constructed according to any one of the above-described modes (14)-(16) and (54)-(56), the inner space of the buffer chamber is partially divided by the partition rib into the upstream-side region and the downstream-side region which the buffer chamber inlet and outlet face, respectively. Therefore, irrespective of sizes of the bubbles, the bubbles contained in the ink is delivered from the buffer chamber inlet toward the buffer chamber, bypassing the partition rib. This arrangement avoids the bubbles from being delivered directly from the inlet to the outlet, thereby making it possible to prevent the bubbles from being delivered toward the recording head. Further, since the partition rib is formed to project inwardly from the bottom wall of the buffer chamber, namely, the partition wall is formed integrally with the bottom wall, the buffer chamber having the partition rib in its inner space can be easily formed by simply fixedly superposing the upper and lower casing members onto each other.

In the inkjet printer constructed according to any one of the above-described modes (15), (16), (55) and (56), at least a part of the delivery channel or chamber overlaps the upstream-side region of the divided part of the inner space of the buffer chamber in the plan view, while at least a portion of the recording head overlaps the downstream-side region of the divided part of the inner space of the buffer chamber in the plan view, such that the bottom wall of the buffer chamber is held in parallel with the nozzle opening surface of the recording head. i.e., rows of the nozzles arranged on the nozzle opening surface. This arrangement permits the ink delivery unit or damper unit as a whole to be made in compact in its vertical dimension.

In the inkjet printer constructed according to the above-described mode (16) or (56), since the delivery channel or chamber is defined by the bottom wall of the buffer chamber and the flexible film which is spaced apart from the bottom wall, the delivery channel or chamber can serve as the damper chamber.

In the inkjet printer constructed according to any one of the above-described modes (17)-(23) and (57)-(63), the heat source such as the driver chip generates the heat when operated in association with the ink ejecting action of the recording head, while one of the first delivery channels, which is closer to the heat source than the other first delivery channel or channels, is larger in volume than the other first delivery channel or channels. This arrangement is effective to enable the first delivery channels to be substantially equalized to each other in ratio of an amount of bubbles generated therein with respect to the volume thereof. That is, if a larger amount of bubbles are generated in the above-described one of the first delivery channels closer to the heat source, the larger amount of generated bubbles can be accumulated in the one of the first delivery channels which has a relatively large volume. In other words, this arrangement is effective to enable the first delivery channels to be substantially equalized to each other in point of time at which the above-described bubble discharging operation has to be initiated, thereby making it possible to reduce the required number of times of the execution of the discharging operation and accordingly resulting in an improved maneuverability of the inkjet printer. In addition, the reduced number of times of the execution of the bubble discharging operation leads to a reduction in an amount of the ink which is discharged rather than being used for a recording operation. For assuring theses technical advantages, the ratio of the volume of the above-described closer one of the first delivery channels with respect to the volume of each of other of the first delivery channels is preferably at least 110%, and more preferably at least 120%.

The above-described arrangement can be employed in the inkjet printer as defined in each of modes (19) and (59) in which the heat source includes the driver chip having the driver circuit which is operable to generate the electric signal for causing the ink to be ejected through a selected one or ones of nozzles of the recording head. Further, in the inkjet printer as defined in each of modes (20) and (60), the recording head, the main body of the ink delivery unit, the flexible wiring cable and the driver chip can be assembled into an assembly which is made compact in size. Although the driver chip as the heat source would be located closer to the ink delivery unit in the assembly thus made compact, it is possible to avoid increase in the required number of times of the execution of the discharging operation, owing to the above-described arrangement.

In the inkjet printer constructed according to the above-described mode (21) or (61), since the major portion of the heat dissipation unit is held substantially in parallel to the direction in which the first delivery channels extend, the assembly including the heat dissipation unit can be made compact in size. Further, the heat generated by the driver chip can be dissipated to a wide open space through the heat dissipation unit, thereby making it possible to restrain the first delivery channels from being thermally affected.

In the inkjet printer constructed according to the above-described mode (22) or (62), in which each of the first delivery channels at least partially serves as the damper chamber, the first delivery channels can be given substantially the same capacity of damping the pressure fluctuation in the ink through the bubbles. Further, in the inkjet printer constructed according to the above-described mode (23) or (63), the assembly including the heat dissipation unit and the bubble discharger unit can be made compact in size.

In the inkjet printer constructed according to any one of the above-described modes (24)-(31) and (64)-(69), since the ink storage chamber inlet of the inn storage chamber is located in such a position that enables the ink to be delivered from the ink tube through the ink storage chamber inlet to the damper section of the ink storage chamber, namely, since the ink storage chamber inlet is provided by an opening of the damper section of the ink storage chamber, the dynamic pressure of the ink is immediately absorbed in the damper section of the ink storage chamber as soon as the ink flows into the ink storage chamber. Further, since the bubble trapper section of the ink storage chamber is located substantially right above the ink storage chamber outlet, the bubbles can be spontaneously and easily separated from the ink when the ink is about to flow out of the ink storage chamber toward the recording head. The separated bubbles are floated upwardly and easily reach the bubble trapper section of the ink storage chamber, without the floatation of the bubbles being impeded before its arrival in the bubble trapper section. It is therefore possible to prevent the ink storage chamber outlet from being clogged with the bubbles, thereby enabling the ink to be delivered to the recording head without delay.

In the inkjet printer constructed according to the above-described mode (27) or (65), the damper section of the ink storage chamber is given a high capacity of damping the active pressure of the ink, owing to the corporation of the air retained therein and the flexible film providing the upper wall thereof.

In the inkjet printer constructed according to the above-described mode (28) or (66), the air discharging hole is positioned in vicinity of the downstream-side portion of the circumferential side wall defining the ink storage chamber. Owing to this positioning of the air discharging hole, an area defined by and between the discharging hole and the downstream-side portion of the circumferential side wall is made extremely small, so that a majority of the bubbles can be efficiently discharged out of the ink storage chamber, while a large amount of the ink can be stored in the ink storage chamber.

In the inkjet printer constructed according to the above-described mode (29) or (67), since the damper section of the ink storage chamber is at least partially surrounded by the air retainer rib which projects downwardly from the upper wall of the ink storage chamber, it is possible to reliably store a certain amount of the air which amount is defined by a distance by which the air retainer rib projects downwardly from the upper wall. Further, since a clearance or gap is formed between the lower distal end of the air retainer rib and the bottom wall of the ink storage chamber, the ink and the bubbles can be freely moved in a region adjacent to the bottom wall of the ink storage chamber.

In the inkjet printer constructed according to the above-described mode (30) or (68), the first partition wall is disposed between the ink storage chamber inlet and the damper section, while the second partition wall is disposed between the damper section and the bubble trapper section. This arrangement makes it possible to reliably store a certain amount of the bubbles which amount is defined by a distance by which each of the first and second partition walls project downwardly from the upper wall of the ink storage chamber.

In the inkjet printer constructed according to the above-described mode (31) or (69), the plurality of ink storage chambers provided to store the respective different inks can be provided by a definer which defines the plurality of ink storage chambers and which is made compact in size.

In the inkjet printer constructed according to any one of the above-described modes (32)-(36) and (70)-(73), at least one groove is formed in the inside surface of the bottom wall of the ink storage chamber, so as to extend in the direction away from the ink storage chamber inlet toward the ink storage chamber outlet. When a liquid such as the ink is introduced into the ink storage chamber through the ink storage chamber inlet, the liquid enters the groove and is rapidly moved along the groove toward the ink storage chamber outlet, without the movement being impeded by a surface tension of the liquid.

In the inkjet printer constructed according to the above-described mode (34) or (71), the damper section of the ink storage chamber is defined by the air retainer rib which projects from the upper wall of the ink storage chamber toward the bottom wall of the ink storage chamber. Since a part of the ink storage chamber located on a lower side of the damper section has a height that is made small by the downwardly projecting air retainer rib, an ink passage defined by that part of the ink storage chamber has a reduced cross sectional area. However, even in the ink passage having the reduced cross sectional area, the liquid such as the ink can be rapidly moved along the groove toward the ink storage chamber outlet.

In the inkjet printer constructed according to the above-described mode (35) or (72), since the pair of grooves are formed in the respective widthwise opposite end portions of the inside surface of the bottom wall of the ink storage chamber, the liquid is given a higher degree of flowability, so as to be further easily moved on the inside surface of the bottom wall toward the ink storage chamber outlet.

In the inkjet printer constructed according to the above-described mode (36) or (73) in which the bubble trapper section is located on the downstream side of the damper section, the flow of the liquid in a direction away from the damper section toward the bubble trapper section is facilitated by the groove which is at least partially located right below the damper section.

In the inkjet printer constructed according to any one of the above-described modes (37)-(46) and (74)-(83), one of the third delivery channels held in communication with one of the first delivery channels is closer to the first delivery channels than the other of the third delivery channels, and the recess is formed in the surface of the main body to which the cover member is fixed, such that the recess has the part which is located between the above-described one of the third delivery channels and another one of the first delivery channels, and such that at least one of the first delivery channels (which is other than the above-described one and another one of the first delivery channels) is located between the above-described one and another one of the first delivery channels. This construction makes it possible to check the ink delivery unit for leakage, by applying a positively or negatively pressurized fluid simultaneously into at least two of the first delivery channels and at least two of the third delivery channels each of which is held in communication with a corresponding one of the at least two of the first delivery channels, wherein outer peripheries of the above-described at least two of the first delivery channels and the above-described at least two of the third delivery channels (to which the cover member is fluid-tightly attached) are not contiguous to each other. That is, the construction permits at least two of the first delivery channels and the third delivery channels communicated with the at least two of the first delivery channels, to be checked simultaneously at a single checking step. Therefore, the required number of leakage checking steps can be made smaller than where the plurality of first delivery channels are checked independently of each other.

This inkjet printer makes it possible to check the ink delivery unit for leakage, by implementing the leakage checking step whose number is smaller than the number of the first delivery channels of the ink delivery unit. Thus, a length of time required to carry out a process of checking the leakage of the ink delivery unit can be remarkably reduced, and the checking process can be easily carried out, even where the first and third delivery channels are arranged with high density so as to make the entirety of the ink delivery unit compact in size to meet a demand for reduction in a floor space required for installation of the inkjet printer.

In the inkjet printer constructed according to the above-described mode (38) or (75) in which the recess is held in communication with the atmosphere, if there is a leakage or communication between each of the first and third delivery channels and the recess, the fluid supplied into the first and third delivery channels exhibits a pressure change, which is different from that exhibited in case of absence of the leakage. Thus, it is possible to reliably detect the presence of the leakage in the ink delivery unit, i.e., a defect in connection of the cover member and the main body of the ink delivery unit.

In the inkjet printer constructed according to the above-described mode (39) or (76), the one of the first delivery channels held in communication with the one of the third delivery channels is the endmost one of the first delivery channels as viewed in the arrangement direction in which the first delivery channels are arranged, and the one of the third delivery channels extends, at least at its part closer to the first delivery channels than the other part thereof, in the arrangement direction. This arrangement permits the other third delivery channel or channels to extend substantially in the arrangement direction in which the first delivery channels are arranged, thereby making it possible to efficiently arrange the plurality of third delivery channels as well as the plurality of first delivery channels within a limited area in the ink delivery unit.

In the inkjet printer constructed according to the above-described mode (41) or (78), the third delivery channels are provided by the respective grooves which open in the above-described another portion of the first casing member (by which the above-described another part of each of the first delivery channels is covered). This arrangement is effective to save the space for the provision of the third delivery channels in the ink delivery unit. Further, since the openings of the first delivery channels and the grooves of the third delivery channels are covered or sealed by the single cover member, an operation to seal the openings and the grooves can be easily made, and a cost of manufacture of the inkjet printer can be reduced.

In the inkjet printer constructed according to the above-described mode (42) or (79), each of the first delivery channels defined in the main body has the part serving as the damper chamber which damps the pressure fluctuation in the ink that is to be delivered from the ink source unit to the second delivery channels of the recording head. This arrangement is effective to prevent considerable pressure fluctuation in the ink that is being delivered toward the recording head, and to cause the ink to be ejected under a constant pressure from the recording head which is located on the downstream side of the first delivery channels.

In the inkjet printer constructed according to the above-described mode (43) or (80), the cover member is provided by the flexible film, namely, the surface in which the plurality of first and third delivery channels open can be covered by the flexible film, so that the pressure fluctuation in the ink can be reliably damped by deformation of the flexible film.

In the inkjet printer constructed according to the above-described mode (44) or (81) in which each of the third delivery channels is the discharging passage which is provided to discharge the bubbles accumulated in the damper chamber, the bubbles separated from the ink can be discharged from the damper chamber or the first delivery channel toward an exterior of the ink delivery unit through the discharging passage, thereby making it possible to avoid failure in the ink ejection and deterioration in the recording quality which could be caused if the ink having delivered to the recording head contains the bubbles.

In the inkjet printer constructed according to the above-described mode (45) or (82), the bubble discharger unit is provided in the end portion of the main body as viewed in the arrangement direction in which the first delivery channels are arranged. The bubble discharger unit is operable to bring the discharging passage into communication with the exterior of the main body of the ink delivery unit, so as to discharge the bubbles accumulated in the damper chamber or the first delivery channel.

In the leakage checking method according to any one of the above-described modes (47), (48), (84) and (85), the positively or negatively pressurized fluid is supplied into at least two of the first delivery channels (which are located on opposite sides of at least one of the first delivery channels which is other than the at least two of the first delivery channels) and the third delivery channels each of which is held in communication with a corresponding one of the at least two of the first delivery channels. If there is a leakage or communication between each of the at least two of the first delivery channels and any one of the at least one of the first delivery channels (which is other than the at least two of the first delivery channels), the above-described supplied fluid exhibits a pressure change, which is different from that exhibited in case of absence of the leakage. Thus, by detecting the pressure change of the supplied fluid, it is possible to easily and reliably determine if there is a leakage in the at least two of the first delivery channels and the third delivery channels communicated with the at least two of the first delivery channels, i.e., a defect in fluid tightness between the cover member and the outer peripheries of these first and third delivery channels. In the present method, while the at least two of the first delivery channels are simultaneously checked for the leakage, the other of the first delivery channels may be checked independently of each other, or alternatively, may be checked simultaneously with each other if possible.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which.

DETAILED DESCRIPTION OF THE PREFERRED EMBODIMENT

Figure 1:
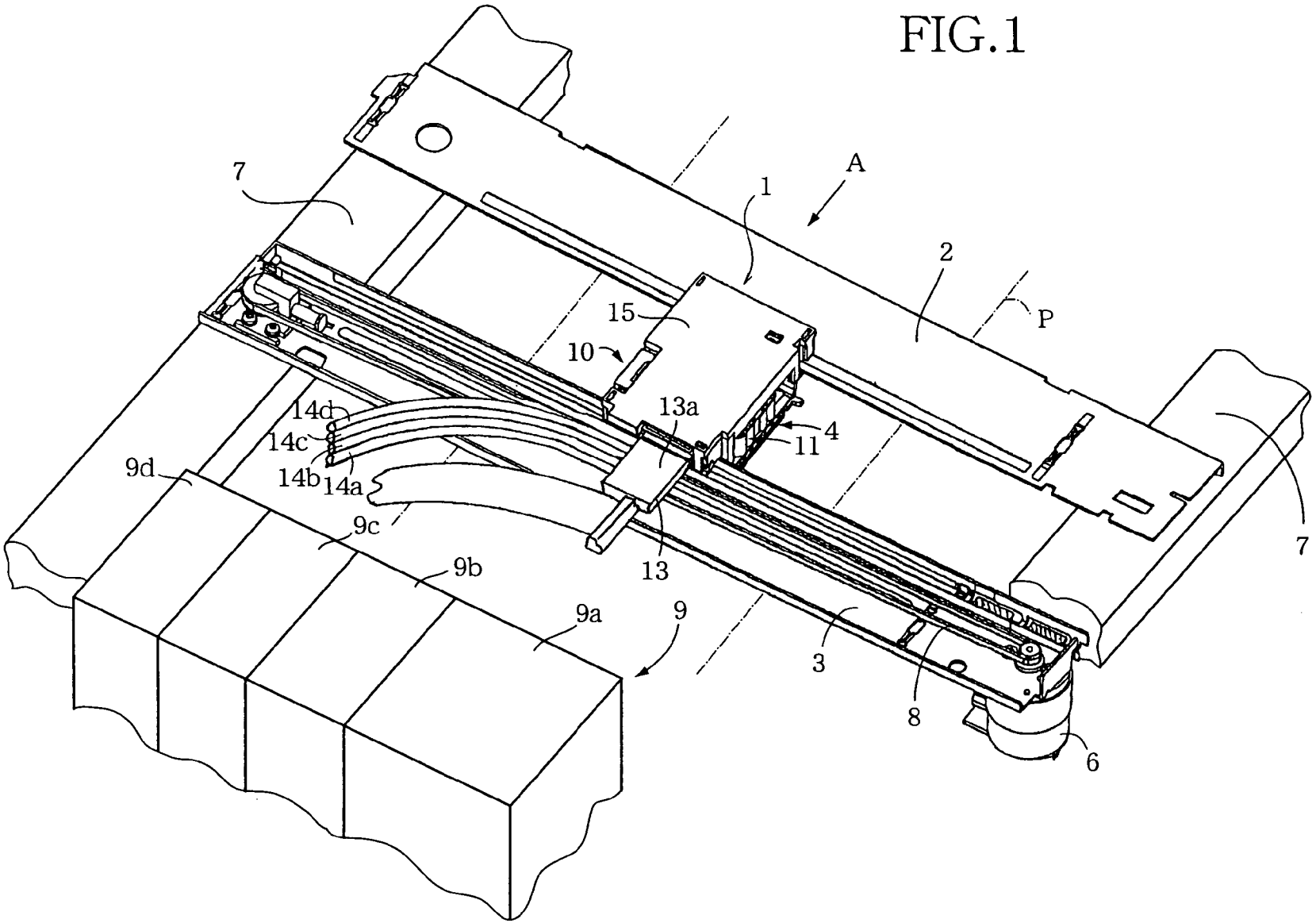
FIG. 1 is a perspective view of a recording portion of an inkjet printer constructed according to a first embodiment of the invention.

Referring first to FIGS. 1-15, there will be described an inkjet printer constructed according to a first embodiment of the invention. As shown in FIG. 1, the inkjet printer is equipped with a recording portion 1 which is disposed fixedly relative to its main stationary frame 7 as a stationary body and which is operable to eject an ink toward a recording medium such as a paper sheet. This inkjet printer is to be incorporated in a multifunction device (MFD) which has various functions such as facsimile, scanner, copier and printer functions. That is, this inkjet printer constitutes a portion of the multifunction device which provides the printer function.

The recording portion 1 includes a recording head unit 4 having a portion which serves as a carriage slidably mounted on guide rails 2,3 each provided by a horizontally elongated plate-like member extending in Y-axis direction (corresponding to a primary scanning direction that is perpendicular to a feed direction in which the paper sheet is to be fed), so as to be reciprocatable along the guide rails 2, 3. The recording portion 1 further includes an endless timing belt 8 and a CR (carriage) motor 6. The timing belt 8 is wound around two pulleys located on opposite end portions of one 3 of the guide rails 2, 3 which is located on a downstream side of the other guide rail 2 as viewed in the feed direction (corresponding to X-axis direction and a secondary scanning direction), such that the timing belt 8 extends in a parallel with the guide rail 3. The CR motor 6 is operable to drive one of the two pulleys so as to circulate the timing belt 8 around the pulleys, so that the recording head unit 4 which is held in engagement with a portion of the timing belt 8 is moved along the guide rails 2, 3.

Figure 2:
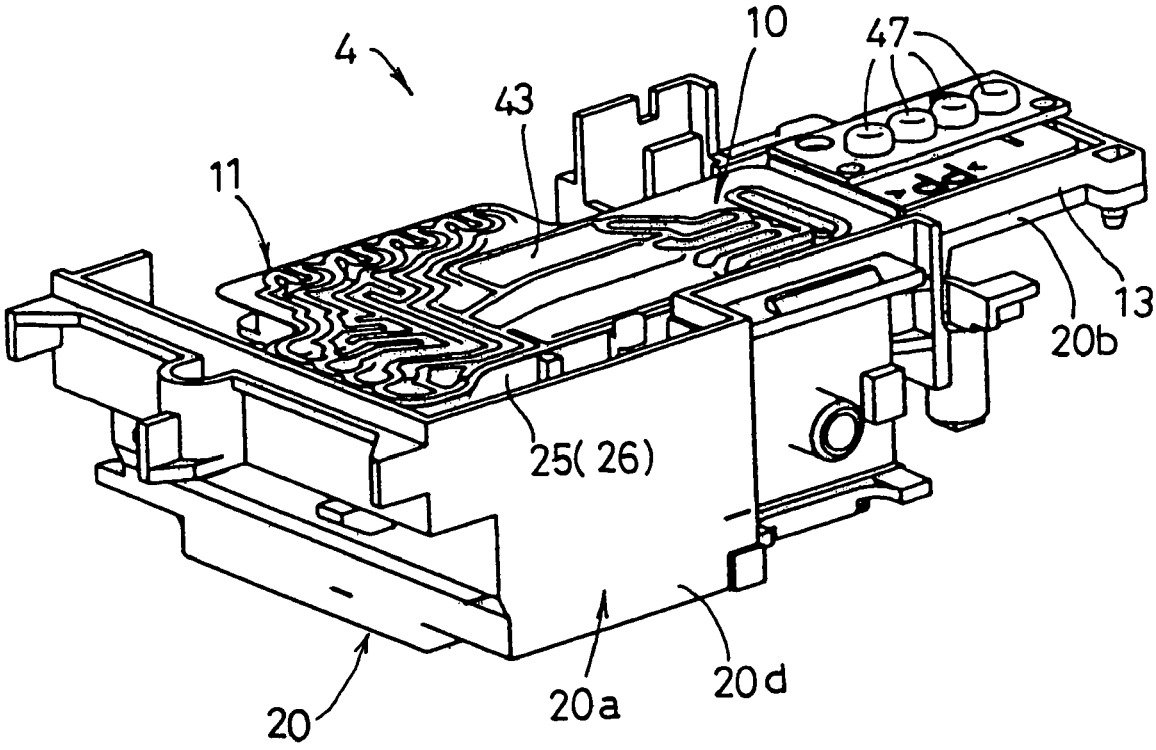
FIG. 2 is a perspective view of a head unit of the recording portion of the inkjet printer of FIG. 1.
Figure 3:
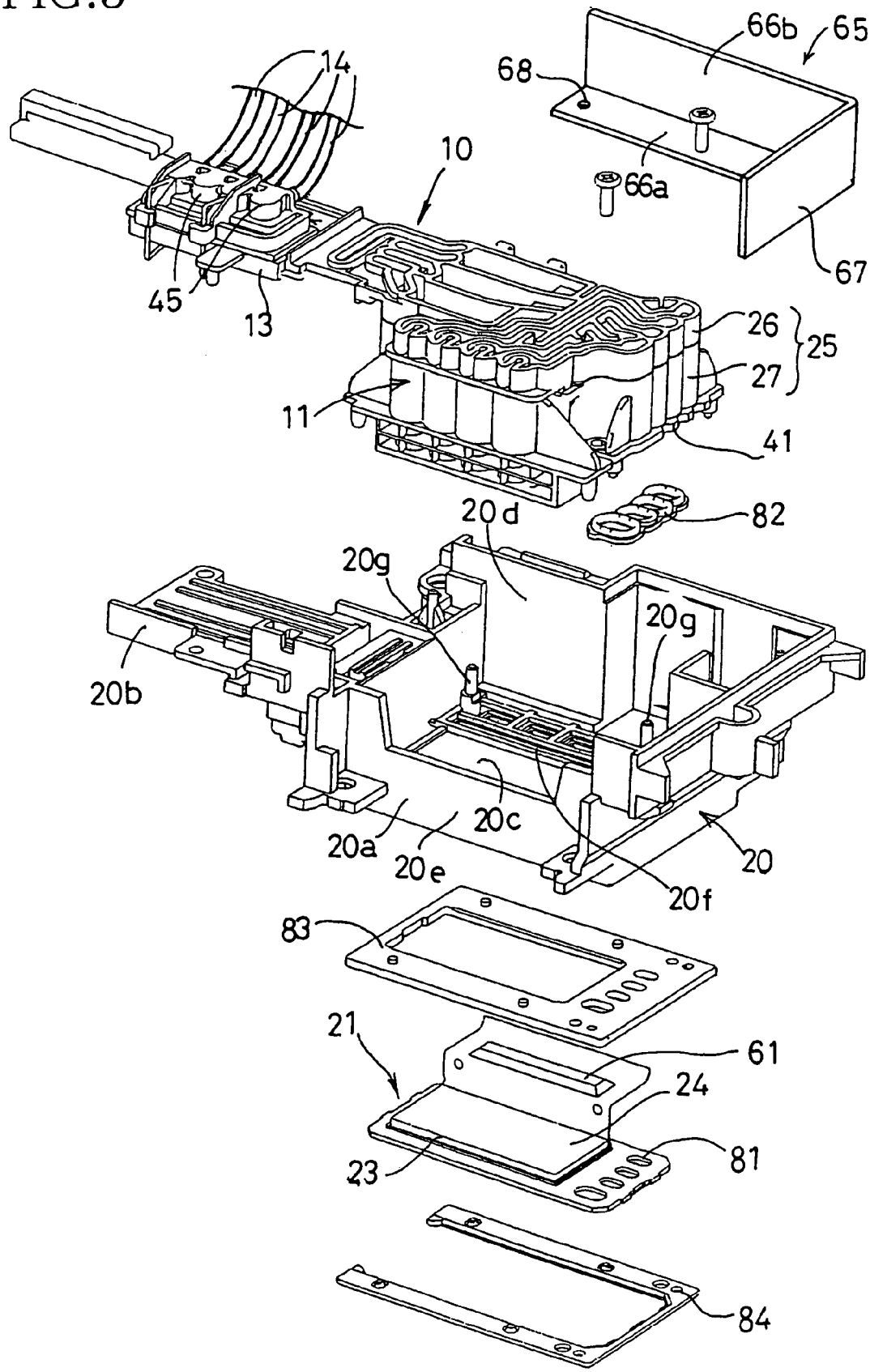
FIG. 3 is a perspective and exploded view of the head unit of FIG. 2.

The recording head unit 4 includes a head holder 20, a recording head 21, an ink delivery unit 10, a bubble discharger unit 11 and a heat dissipation unit 65, as shown in FIGS. 2 and 3. The head holder 20 constitutes the above-described portion serving as the carriage, and includes a box-like main body portion 20*a* and an extension portion 20*b* which extends from the main body portion 20*a* in the feed direction (that is indicated by arrow A in FIG. 1). The recording head 21 is of an inkjet type, and is fixed to a lower surface (outside surface) of a bottom plate 20*c* of the head holder 20. The delivery unit 10 is fixed to an upper surface (inside surface) of the bottom plate 20*c*. The bubble discharger unit 11 is integrally built in the delivery unit 10, and is operable to discharge bubbles contained in the ink stored in the delivery unit 10. The heat dissipation unit 65 is provided to dissipate heat generated by a driver chip 61 which is disposed on a flexible flat cable (flexible wiring board) 24. It is noted that the ink delivery unit 10 may be considered to include a damper unit and a buffer unit, since the unit 10 defines a plurality of chambers including at least one referred to as a damper chamber and at least one referred to as a buffer chamber.

The heat dissipation unit 65, the ink delivery unit 10 and the bubble discharger unit 11 are arranged in the Y-axis direction in a plan view of the head unit 4. In the present embodiment, the heat dissipation unit 65 is disposed on an inner side of a side plate 20*d* of the head holder 20, while the bubble discharger unit 11 is disposed on an outer side of another side plate 20*e* that is opposed to the side plate 20*d* in the primary scanning direction.

The ink delivery unit 10 has an extension portion 13 which horizontally extends from its main body 25 in the feed direction (indicated by arrow A in FIG. 1) and which is superposed on the extension portion 20*b* of the head holder 20. To the extension portion 13 of the delivery unit 10, four ink tubes 14 are connected at their distal end portions. The inkjet printer has an ink source unit 9 including four ink tanks 9*a*, 9*b*, 9*c*, 9*d*, which store a black ink (BK), a cyan ink (C), a yellow ink (Y), and a magenta ink (M), respectively, for carrying out a full-color printing operation. The four ink tanks 9*a*, 9*b*, 9*c*, 9*d* are fixed relative to the stationary frame 7 of the inkjet printer. To the respective four ink tanks 9*a*, 9*b*, 9*c*, 9*d*, the above-described four ink tubes 14 are connected at their proximal end portions, so that the ink tubes 14 cooperate with the ink delivery unit 10 to define ink supply passages through which the inks are to be supplied from the ink tanks 9*a*, 9*b*, 9*c*, 9*d* toward the recording head 21. In the present embodiment, the number of the ink tanks 9 and that of the ink tubes 14 are four, since the number of ink colors are four (BK, C, Y, M). However, the number of the ink tanks and that of the ink tubes 14 are not particularly limited. Further, the kinds (e.g., color, gloss liquid) of the inks may be changed if needed. It is noted that upper surfaces of the main body 25 of the delivery unit 10 and the bubble discharger unit 11 are covered by a cover member 15, while an upper surface of the extension portion 13 of the delivery unit 10 is covered by another cover member 13*a* (see FIG. 1).

Figure 8:
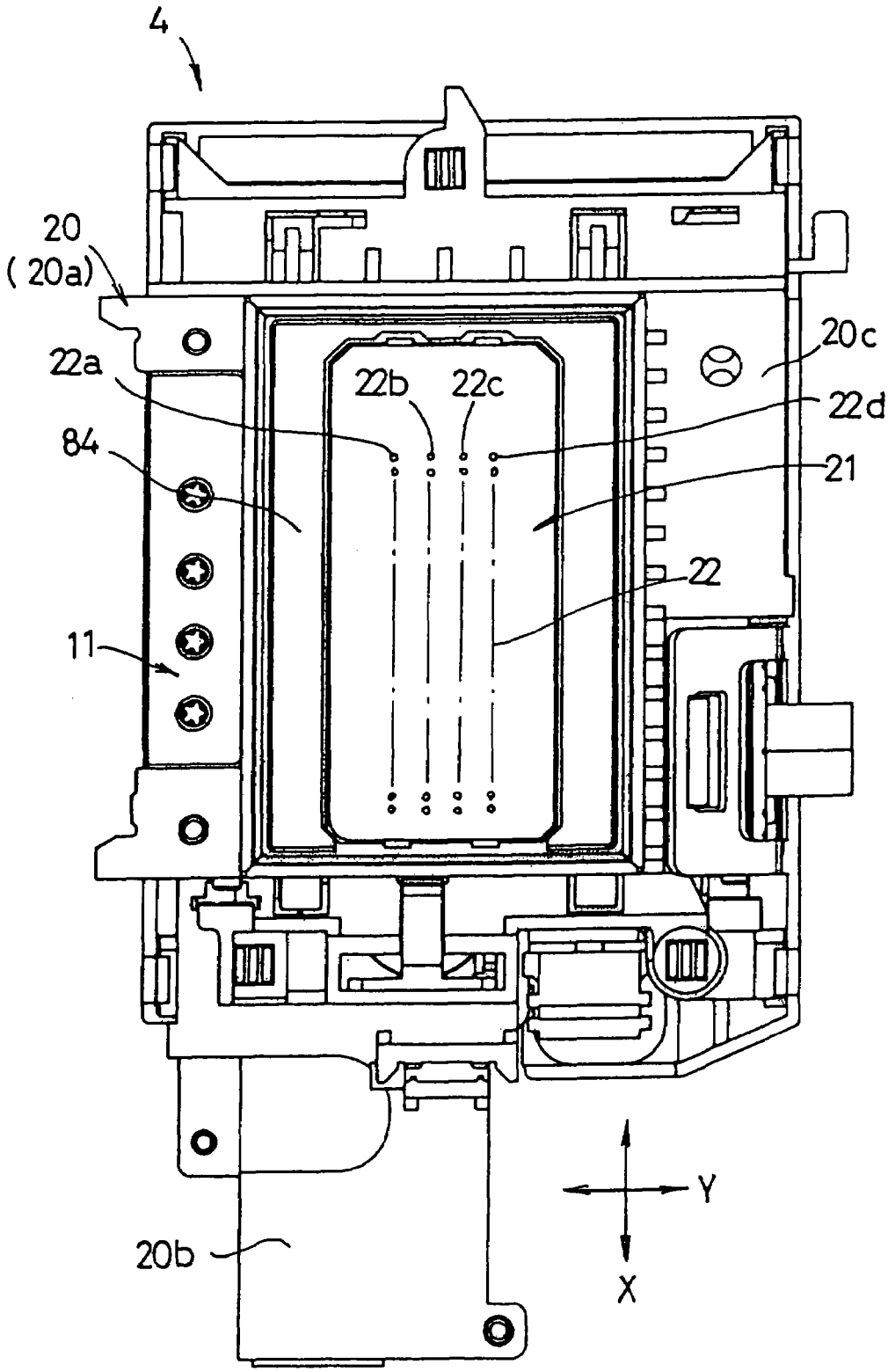
FIG. 8 is a bottom-plan view of the head unit of FIG. 3.

The recording head 21 has a lower surface as a nozzle opening surface in which a multiplicity of nozzles 22 arranged, as shown in FIG. 8. The nozzles 22 consist of nozzles 22*a* arranged in a row assigned to the black ink, nozzles 22*b* arranged in a row assigned to the cyan ink, nozzles 22*c* arranged in a row assigned to the yellow ink, and nozzles 22*d* arranged in a row assigned to the magenta ink. The row of the nozzles 22*a*, the row of the nozzles 22*b*, the row of the nozzles 22*c* and the row of the nozzles 22*d* are arranged in this order of description as viewed from left to right in FIG. 2, and all extend in a direction perpendicular to a direction of movement of the carriage (i.e., the Y-axis direction or primary scanning direction). All the nozzles 22 open in the nozzle opening surface of the recording head 21 that is to be opposed to an upper surface of the paper sheet.

Like recording heads disclosed in U.S. Pat. No. 6,729,717 (corresponding to JP-A-2002-67312) and JP-A-2001-219560, the recording head 21 has four ink inlets 81 which are assigned to the respective color inks and which open in an end portion of its upper surface, as shown in FIG. 3, so that the inks can be introduced into the recording head 21 through the ink inlets 81. The thus introduced inks are distributed to a multiplicity of pressure chambers through second delivery channels extending between the ink inlets 81 and the pressure chambers, so that the inks can be ejected through the nozzles 22 with activation of piezoelectric elements which are disposed adjacent to the respective pressure chambers. Onto an upper surface of an actuator unit 23 which incorporates therein the piezoelectric elements, the above-described flexible flat cable 24 is fixed, so that a drive voltage can be applied to each piezoelectric element through the flat cable 24. The recording head 21 is fixed to a lower surface of the bottom plate 20*c* of the head holder 20. Between the recording head 21 and the bottom plate 20*c* of the head holder 20, there is interposed a reinforcement frame 83, so that the recording head 21 can be prevented by the reinforcement frame 83, from being deflexed in a process of assembling the ink delivery unit 10. The reinforcement frame 83 is fixed to the upper surface of the recording head 21 through an adhesive. A sub-assembly of the recording head 21 and the reinforcement frame 83 is fixed to the lower surface of the bottom plate 20*c* through an adhesive 85 (see FIG. 14). Four outlets 41 of the ink delivery unit 10 are introduced in an opening of the bottom plate 20*c* of the head holder 20, and are connected to the respective four inlets 81 of the recording head 21 through openings of the reinforcement frame 83 and a sealing member 69 which is made of an elastic material such as rubber and which is gripped by and between the delivery unit 10 and the reinforcement frame 83. Further, onto the nozzle opening surface of the recording head 21, a generally U-shaped front frame 84 is fixed so as to avoid formation of step in the nozzle opening surface, namely, so as to maintain a high degree of flatness of the nozzle opening surface. Still further, each of the four ink inlets 81 of the recording head 21 is covered by a filter 62 which is disposed on the upper surface of the recording head 21, for trapping impurities contained in the ink.

The flexible flat cable 24 is provided by a strip-like member having a high degree of flexibility. The above-described driver chip 61 as a heat source is disposed on a longitudinally intermediate portion of a wide surface of the flat cable 24. The driver chip 61 has a driver circuit operable to generate an electric signal for activating the piezoelectric elements of the actuator unit 23. The driver chip 61, like one disclosed in U.S. Pat. No. 6,540,313 (corresponding to JP-A-2002-160372), is provided by an IC chip, and serves as a converter which converts recording data serially transmitted from a controller (not shown) fixed relative to the stationary frame 7, into parallel signals as voltage signals each of which is to be applied to a corresponding one of the piezoelectric elements of the actuator unit 23, so that the ink can be ejected through a corresponding one of the nozzles 22.

Next, the ink delivery unit 10 will be described in detail by reference to FIGS. 3-13. The delivery unit 10 has a primary (horizontal) partition wall 35 and secondary (vertical) partition walls 35*a*, 35*b*, which cooperate with each other to define a total of four mutually-independent ink storage chambers 30 (30*a*, 30*b*, 30*c*, 30*d*) which are assigned to the respective four colors. In the present embodiment, a black ink (BK) delivery or damper chamber (first sub-chamber) 31*a* (which is a part of the black ink (BK) storage chamber 30*a*) is located on a lower side of the primary partition wall 35, while a black ink buffer chamber (second sub-chamber) 60*a* (which is another part of the black ink storage chamber 30*a*), the cyan ink (C) storage chamber 30*b*, yellow ink (Y) storage chamber 30*c* and magenta ink (M) storage chamber 30*d* are located on an upper side of the primary partition wall 35. Thus, the four ink storage chambers 30 are provided in two layers, i.e., in upper and lower layers.

More specifically described, the main body 25 of the delivery unit 10 is constituted by an by an upper casing member 26 and a lower casing member 27 which are fluid-tightly fixed to each other, for example, by ultrasonic welding. The upper casing member 26 is provided by a flat member having a generally rectangular shape in its plan view. The lower casing member 27 is provided by a box-like member having a generally rectangular outer wall, and has a lower opening and an upper opening which is closed by the upper casing member 26 fixedly disposed on the lower casing member 27. The above-described extension portion 13 of the ink delivery unit 10 is provided by an upper portion of the upper casing member 27 which is elongated in the secondary scanning direction.

The above-described primary partition wall 35 is provided by a portion of the lower casing member 27, and is distant from each of upper and lower surfaces of the lower casing member 27. The lower opening of the lower casing member 27 is defined by a recess which is formed in a major portion of the lower surface of the lower casing member 27. The lower opening of the lower casing member 27 is fluid-tightly closed by a lower flexible film 32 (see FIGS. 12 and 13) which is provided by a thin film formed of synthetic resin and inhibiting permeation of air and liquid therethrough. Described specifically, the lower flexible film 32 is fixed at its outer peripheral portion, for example, by an adhesive or ultrasonic welding, to a lower end face of a peripheral wall 33 of the lower casing member 27 which defines the lower opening of the lower casing member 27.

The lower flexible film 32 and the primary partition wall 35 cooperate with each other to define the black ink delivery or damper chamber 31*a* which is a part of the black ink storage chamber 30*a*. The lower flexible film 32, which is opposed to the primary partition wall 35, constitutes a damper wall of the damper chamber 31*a*. The delivery unit 10 is fixed relative to the head holder 20, such that the lower flexible film 32 and the bottom wall 20*c* of the head holder 20 cooperate with each other to define a clearance therebetween which allows deformation of the lower flexible film 32, and such that the damper wall (lower flexible film 32) of the damper chamber 31*a* is held in substantially parallel with a horizontal plane (see FIG. 9). The four outlets 41*a*, 41*b*, 41*c*, 41*d* of the ink delivery unit 10, which are connected to the respective four inlets 81 of the recording head 21, are arranged in a row in the lower surface of the lower casing member 27, and have respective openings which open downwardly and which are located in a height position lower than a height position of the lower flexible film 32 (see FIG. 9).

The black ink delivery or damper chamber 31*a* has a delivery or damper chamber inlet 53*a* and a delivery or damper chamber outlet 42 which are formed through the primary partition wall 35, such that such that the black ink can be delivered through the damper chamber inlet 53*a* from the ink source unit 9, and such that the black ink can be delivered through the damper chamber outlet 42 toward the recording head 21. The damper chamber inlet and outlet 53*a*, 42 are positioned in respective positions which are substantially diagonal relative to each other within the damper chamber 31*a* having a generally rectangular shape, as seen in the plan view. In other words, the damper chamber inlet and outlet 53*a*, 42 are positioned in respective positions which cooperate with each other to maximize a distance therebetween. It is noted that the damper chamber outlet 42 has an opening area larger than that of the damper chamber inlet 53*a* (see FIGS. 5, 6 and 11).

A guide rib 54 is provided to project from one of mutually opposed walls of the damper chamber 31*a* toward the other of the mutually opposed walls, so as to define an ink path through which the ink is to flow in a direction away from the damper chamber inlet 53*a* toward the damper chamber outlet 42. In the present embodiment, the guide rib 54 is provided by two ribs 54 which are formed integrally with a lower surface of the primary partition wall 35. The two ribs 54 extend straightly in a diagonal direction of the generally rectangular-shaped damper chamber 31*a*. The damper chamber inlet and outlet 53*a*, 42 are located between the two ribs 54 which are parallel with each other. Each of the two ribs 54 projects downwardly from the lower surface of the primary partition wall 35 by such a distance that does not cause each rib 54 to be in contact at its distal end with the lower flexible film 32. Since the distal end of each of the two ribs 54 is spaced apart from the lower flexible film 32 by a certain gap spacing, the ink can be distributed over an entirety of a lower region of an inner space within the damper chamber 31*a* which region is adjacent to the lower flexible film 32, although an upper region of the inner space adjacent to the primary partition wall 35 is sectioned by the two ribs 54 into parts. That is, the distribution of the ink over the entirety of the lower flexible film 32 in the lower region of the inner space is not impeded by the ribs 54 (see FIGS. 12 and 13).

The two secondary partition walls 36 and the one secondary partition wall 37 extend upwardly from the upper surface of the primary partition wall 35. Thus, an upper portion of the lower casing member 27 (which portion is located on the upper side of the primary partition wall 35) cooperates with the upper casing member 26 to define the ink storage chambers 30*a*, 30*b*, 30*c*, 30*d* (see FIG. 12).

Figure 4:
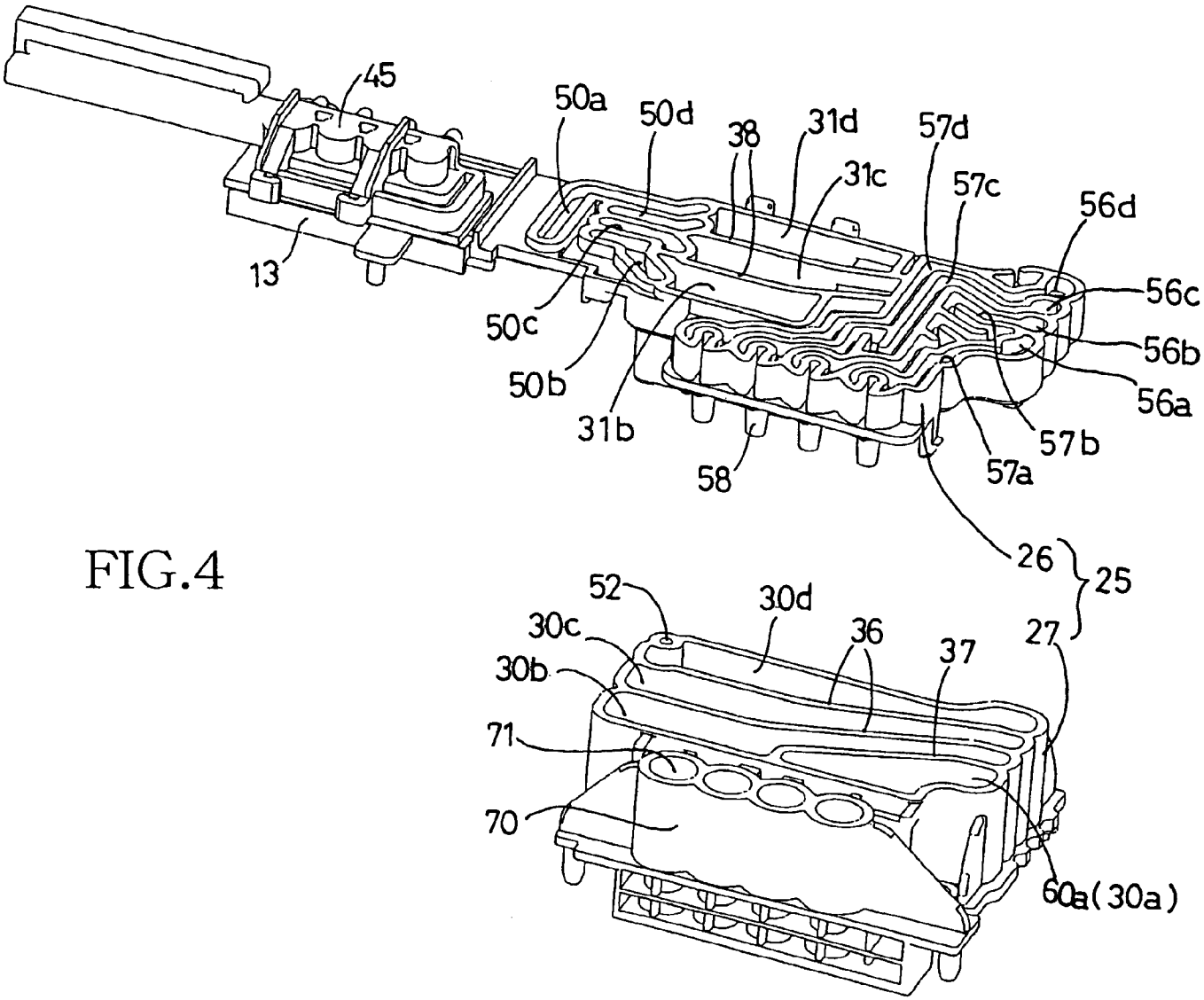
FIG. 4 is an upper perspective and exploded view of an ink delivery unit of the head unit of FIG. 3.
Figure 5:
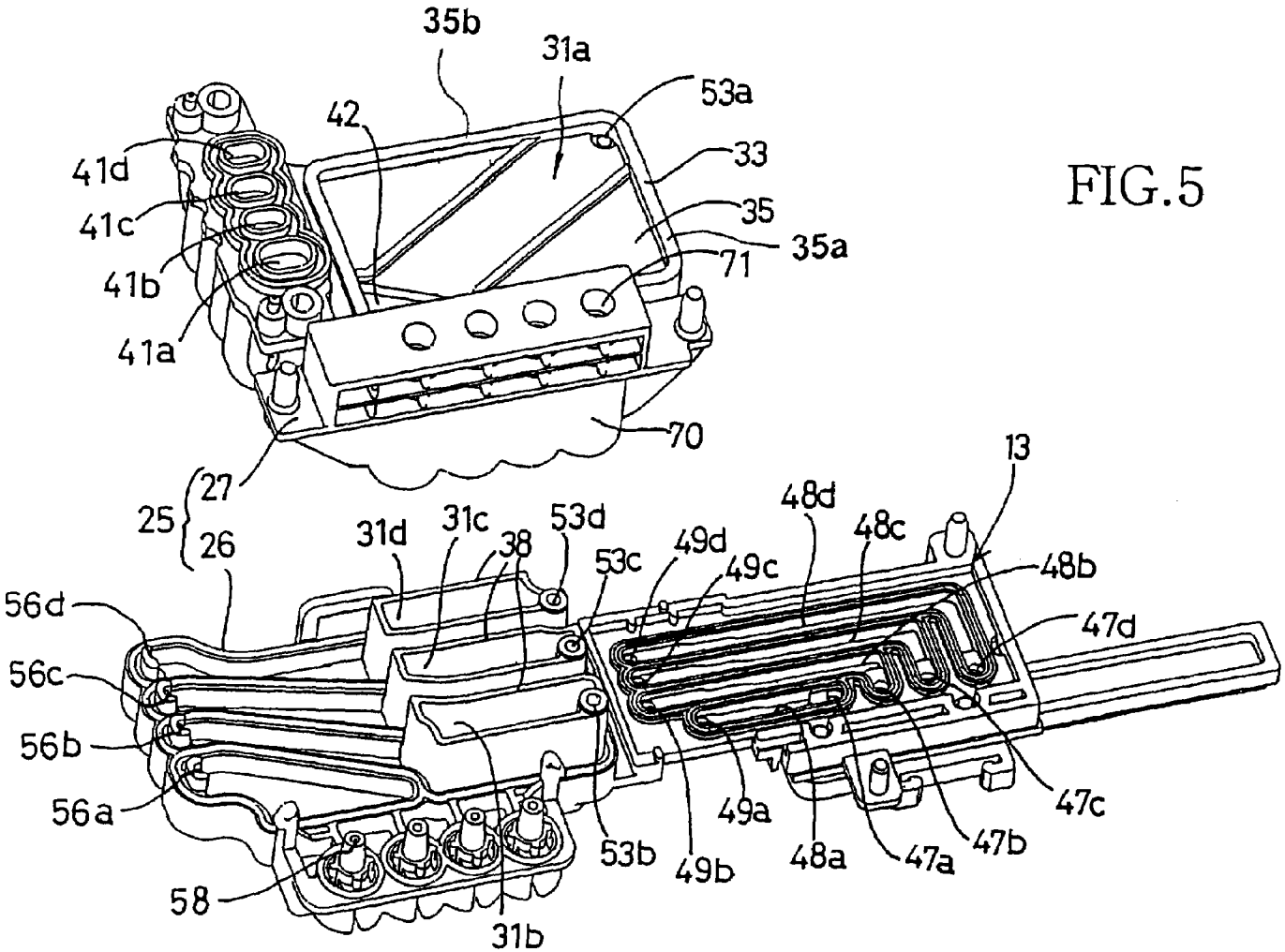
FIG. 5 is a lower perspective and exploded view of the ink delivery unit of the head unit of FIG. 3.

In the present embodiment, the two secondary partition walls 36 which are distant from each other cooperate with a side wall of the lower casing member 27 and the one secondary partition wall 37 to define the three ink storage chambers 30*b*, 30*c*, 30*d* of the cyan ink, yellow ink and magenta ink which serve as the first delivery channels and which extend substantially in parallel with each other and are separated from each other by the two secondary partition walls 36, as shown in FIG. 4. The secondary partition walls 36 extend horizontally over substantially an entire length of the lower casing member 27. The three ink storage chambers 30*b*, 30*c*, 30*d* are held in communication, at respective parts horizontally distant from the upper surface of the primary partition wall 35, with the respective ink outlets 41*b*, 41*c*, 41*d* which are assigned to the cyan ink, yellow ink, and magenta ink, respectively (see FIG. 9).

The secondary partition wall 37 cooperates with the side wall of the lower casing member 27 to define the black ink buffer chamber 60*a* (which is the part of the black ink storage chamber 30*a* and which serves as the first delivery channel), such that the black ink buffer chamber 60*a* is located in a corner portion of the lower casing member 27 adjacent to the outlet 41*a* and has a generally triangular shape in the plan view (see FIG. 4). That is, the black ink storage chamber 30*a* is constituted by the damper chamber 31*a* and the buffer chamber 60*a* which are located on the lower and upper sides of the primary partition wall 35, respectively (see FIG. 12). The buffer chamber 60*a* is smaller in area in the plan view or in cross sectional area as measured along a horizontal plane, than the damper chamber 31*a* which is located on an upstream side of the buffer chamber 60*a*. The buffer chamber 60*a* has a part which overlaps the damper chamber 31*a* in the plan view. The above-described damper chamber outlet 42 of the damper chamber 31*a* which is formed through the primary partition wall 35 serves as a buffer chamber inlet of the buffer chamber 60*a*. The above-described outlet 41*a* of the ink delivery unit 10 which is formed through an end portion of the primary partition wall 35 serves as a buffer chamber outlet of the buffer chamber 60*a*. Thus, the buffer chamber inlet 42 and the buffer chamber outlet 41*a* are both formed through the primary partition wall 35 which serves as a bottom wall of the buffer chamber 60*a*.

The buffer chamber 60*a* serves to temporarily provisionally store the ink in its inner space and also to gradually accumulate bubbles (which have been separated from the ink and floated upwardly) in a bubble trapper region of the inner space adjacent to an upper wall 61*a* of the buffer chamber 60*a* which is provided by a portion of the upper casing member 26. The buffer chamber 60*a* has an air discharging hole 56*a* formed through the portion of the upper casing member 26 which provides the upper wall 61*a* (see FIG. 12). On an inside surface of the bottom wall of the buffer chamber 60*a* which is provided by the primary partition wall 35, a partition rib 55 is provided to project inwardly or upwardly from the bottom wall so as to divide a part of the inner space of the buffer chamber 60*a* into an upstream-side region and a downstream-side region which the buffer chamber inlet and outlet 42, 41*a* face, respectively (see FIG. 12). This partition rib 55 projects upwardly from the inside surface of the bottom wall by such a distance that does not cause the rib 55 to be in contact at its distal end with the upper wall 61*a*, and has such a widthwise dimension (as measured in a direction perpendicular to the drawing sheet of FIG. 12) that causes the part of the inner space (which part is adjacent to the bottom wall) to be completely divided into the above-described upstream-side and downstream-side regions. Therefore, the ink flowing into the buffer chamber 60*a* through the buffer chamber inlet 42 is made to flow upwardly along the partition rib 55 so as to pass through the region adjacent to the upper wall 61*a*. After thus bypassing the partition rib 55, the ink reaches the buffer chamber outlet 41*a*.

In the present embodiment, the three ink storage chambers 30*b*, 30*c*, 30*d* of the cyan ink, yellow ink and magenta ink and the buffer chamber 60*a* of the black ink, which correspond to the respective first delivery channels, extend substantially in parallel with each other and are separated from each other by the secondary partition walls 36, 37. Further, these chambers 30*b*, 30*c*, 30*d*, 60*a* corresponding to the first delivery channels have the respective bottom walls which are commonly provided by the primary partition wall 35 (see FIGS. 4 and 12).

The upper casing member 26 has a plurality of recesses formed in its upper and lower surfaces, and has three generally rectangular-shaped annular ribs 38 formed in its portion adjacent to the above-described extension portion 13. The three annular ribs 38 each serving as an air retainer rib project downwardly, i.e., toward the lower casing member 27, and surround respective three regions which are separated from each other by the ribs 38 (see FIGS. 5 and 6).

Figure 9:
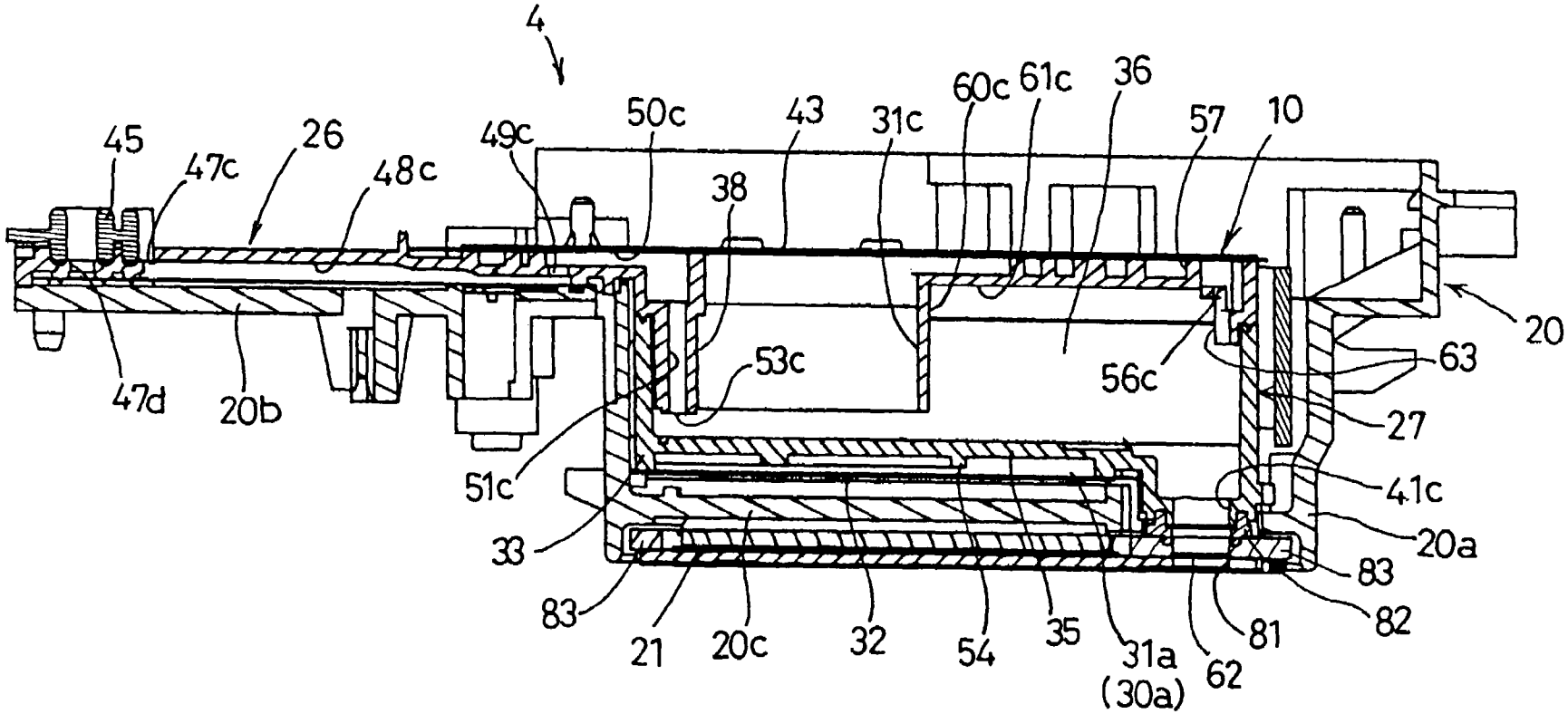
FIG. 9 is a cross sectional view taken along line 9-9 in FIG. 7.
Figure 10:
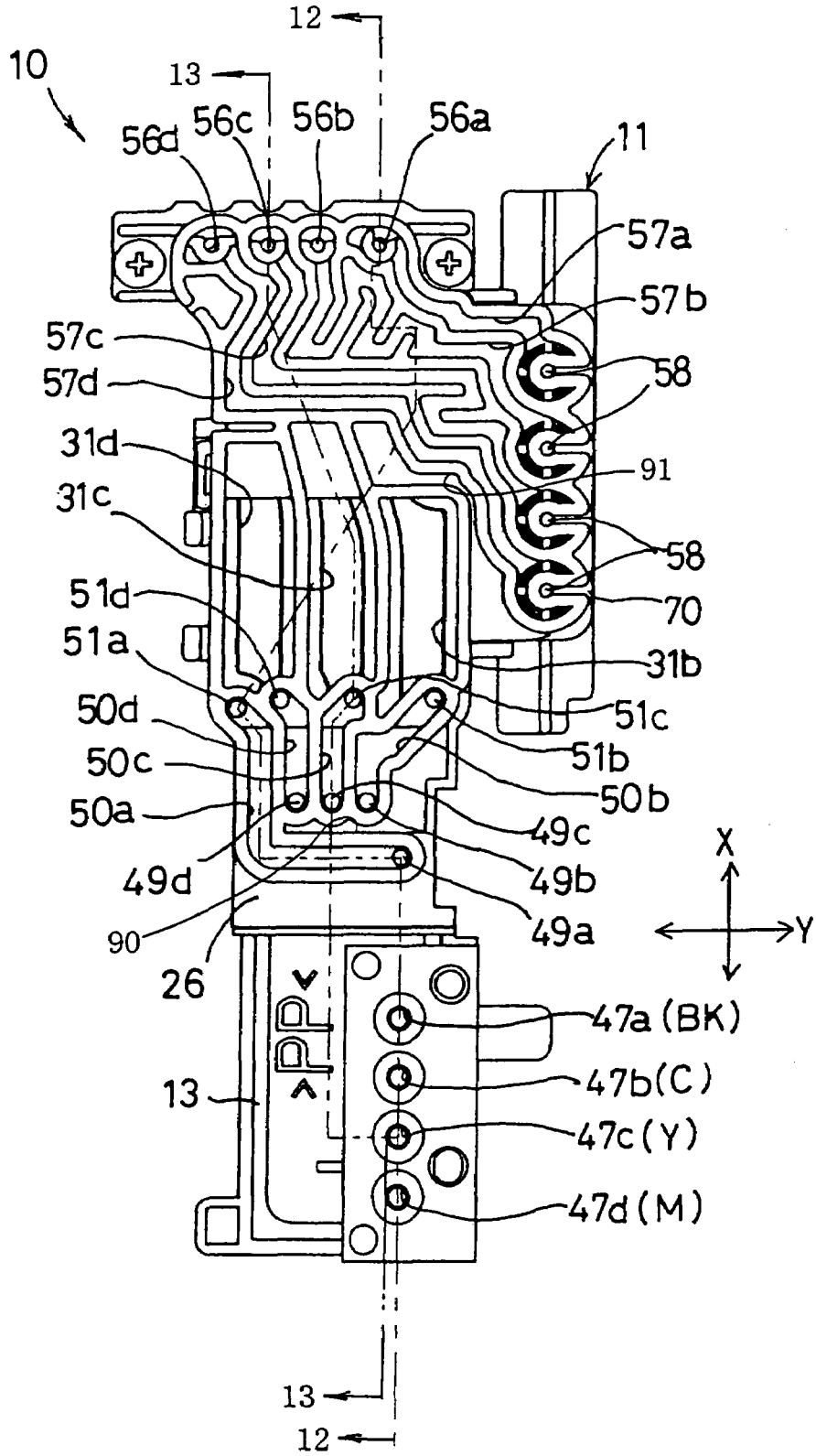
FIG. 10 is a top-plan view of the ink delivery unit of the head unit, in absence of the upper flexible film.
Figure 11:
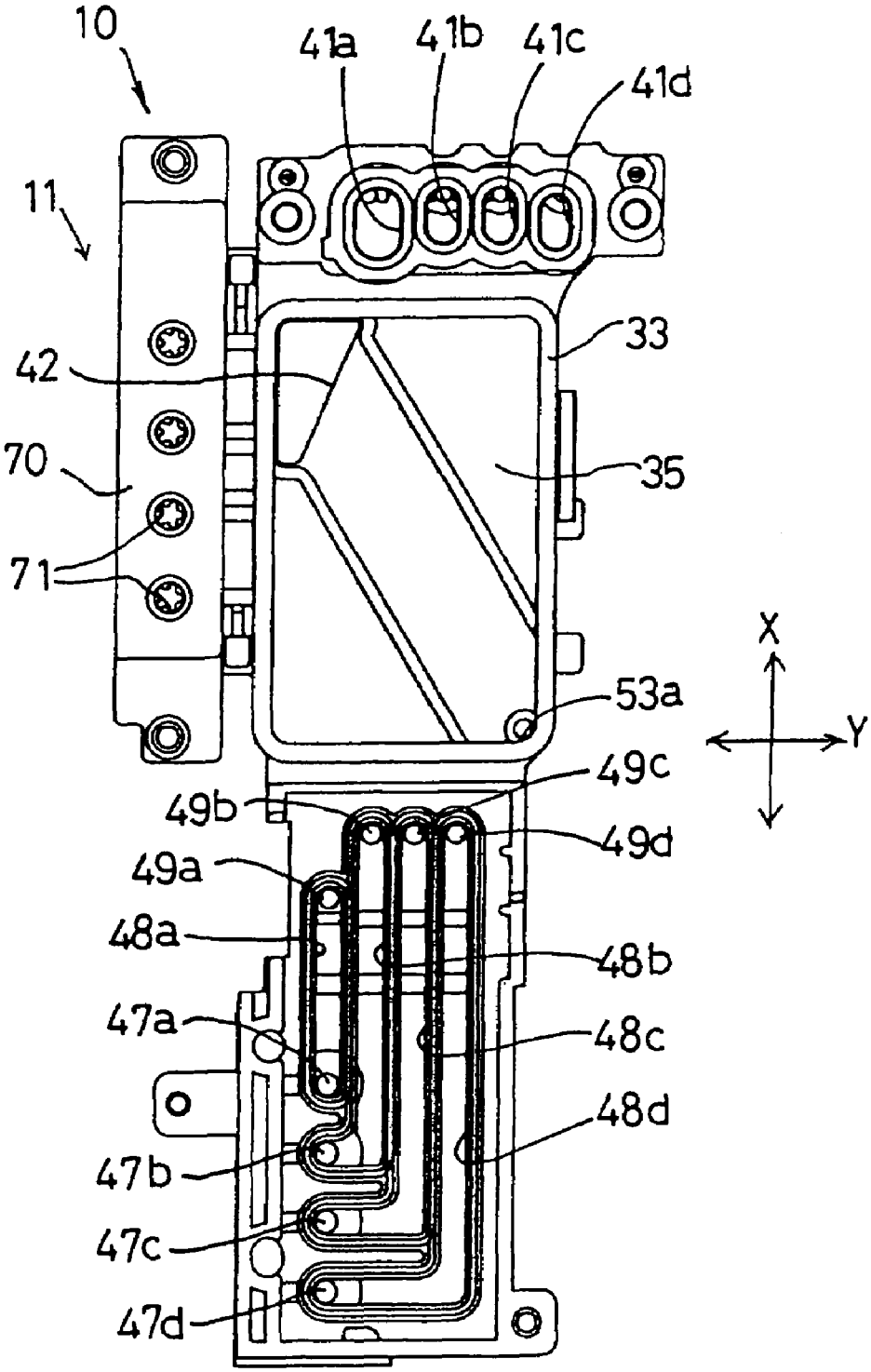
FIG. 11 is a bottom-plan view of the ink delivery unit of the head unit, in absence of a lower flexible film which is to be provided to cover a lower surface of the main body of the ink delivery unit.

Each of the three regions defined by the respective annular ribs 38 opens in the upper and lower surfaces of the upper casing member 26, and is accommodated inside a corresponding one of the three ink storage chambers 30*b*, 30*c*, 30*d* formed in the lower casing member 27, when the upper and lower casing members 26, 27 are connected to each other (see FIG. 9). Each of the three annular ribs 38 downwardly projects by such a distance that does not cause each rib 38 to be in contact at its distal end with the primary partition wall 35, so that the distal end of each rib 38 is spaced apart from the primary partition wall 35 by a certain gap spacing. The three regions surrounded by the ribs 38 serve as damper sections or chambers (first sub-chambers) 31*b*, 31*c*, 31*d* which correspond to parts of the respective ink storage chambers 30*b*, 30*c*, 30*d* storing the cyan ink, yellow ink and magenta ink, respectively. Each of the damper chambers 31*b*, 31*c*, 31*d* is adapted to store a predetermined amount of air or bubbles therein prior to operation of the inkjet printer. The bubbles stored in the damper chamber 31*b*, 31*c*, 31*d* are surrounded by the annular ribs 38, so that the amount of the stored bubbles is reliably increased to a predetermined amount which is defined by the distance by which the annular ribs 38 downwardly project, without the bubbles being discharged through air discharging holes 56*b*, 56*c*, 56*d*. Upper open ends of the three damper chamber 31*b*, 31*c*, 31*d* are commonly closed by a cover member in the form of an upper flexible film 43 which is provided by a single thin film formed of synthetic resin and inhibiting permeation of air or liquid therethrough. Described specifically, the upper flexible film 43 is fixed, for example, by an adhesive or ultrasonic welding, to upper end faces of peripheral walls which define the three damper chamber 31*b*, 31*c*, 31*d*.

In each of the ink storage chambers 30*b*, 30*c*, 30*d* storing the cyan ink, yellow ink and magenta ink, the inner space is sectioned or separated by the annular rib 38, into a corresponding one of the damper section or chamber 31*b*, 31*c*, 31*d* and a corresponding one of bubble trapper sections or chambers 60*b*, 60*c*, 60*d* serving to gradually accumulate therein the bubbles which have been separated from the ink and floated upwardly. Each of the ink storage chamber inlets 53*b*, 53*c*, 53*d* of the respective ink storage chambers 30*b*, 30*c*, 30*d* is located in an upstream side of a corresponding one of the damper chambers 31*b*, 31*c*, 31*d*. Each of the bubble trapper chambers 60*b*, 60*c*, 60*d* located on a downstream side of a corresponding one of the damper chambers 31*b*, 31*c*, 31*d*, i.e., on a side of the corresponding damper chamber 31 closer to the ink outlets 41*b*, 41*c*, 41*d* (see FIG. 13). Upper walls 61*b*, 61*c*, 61*d* of the respective bubble trapper chambers 60*b*, 60*c*, 60*d* are provided by portions of the upper casing member 26 through which the above-described air discharging holes 56*b*, 56*c*, 56*d* are formed (see FIGS. 6 and 13).

Among the three ink storage chambers 30*b*, 30*c*, 30*d* of the cyan ink, yellow ink and magenta ink and the buffer chamber 60*a* of the black ink, the magenta ink storage chamber 30*d* is more distant from the bubble discharger unit 11 than the other chambers 30*b*, 30*c*, 60*a*, and is larger in volume than the other chambers 30*b*, 30*c*, 60*a*. In the present embodiment, the cyan ink storage chamber 30*b* and the yellow ink storage chamber 30*c* have respective volumes which are substantially equal to each other, while the black ink buffer chamber 60*a* has a volume smaller than those of the other chambers 30*b*, 30*c*, 30*d*. In the present embodiment, a ratio among the volumes of the respective chambers 30*b*, 30*c*, 30*d*, 60*a* is about 5:5:6:4.

Figure 6:
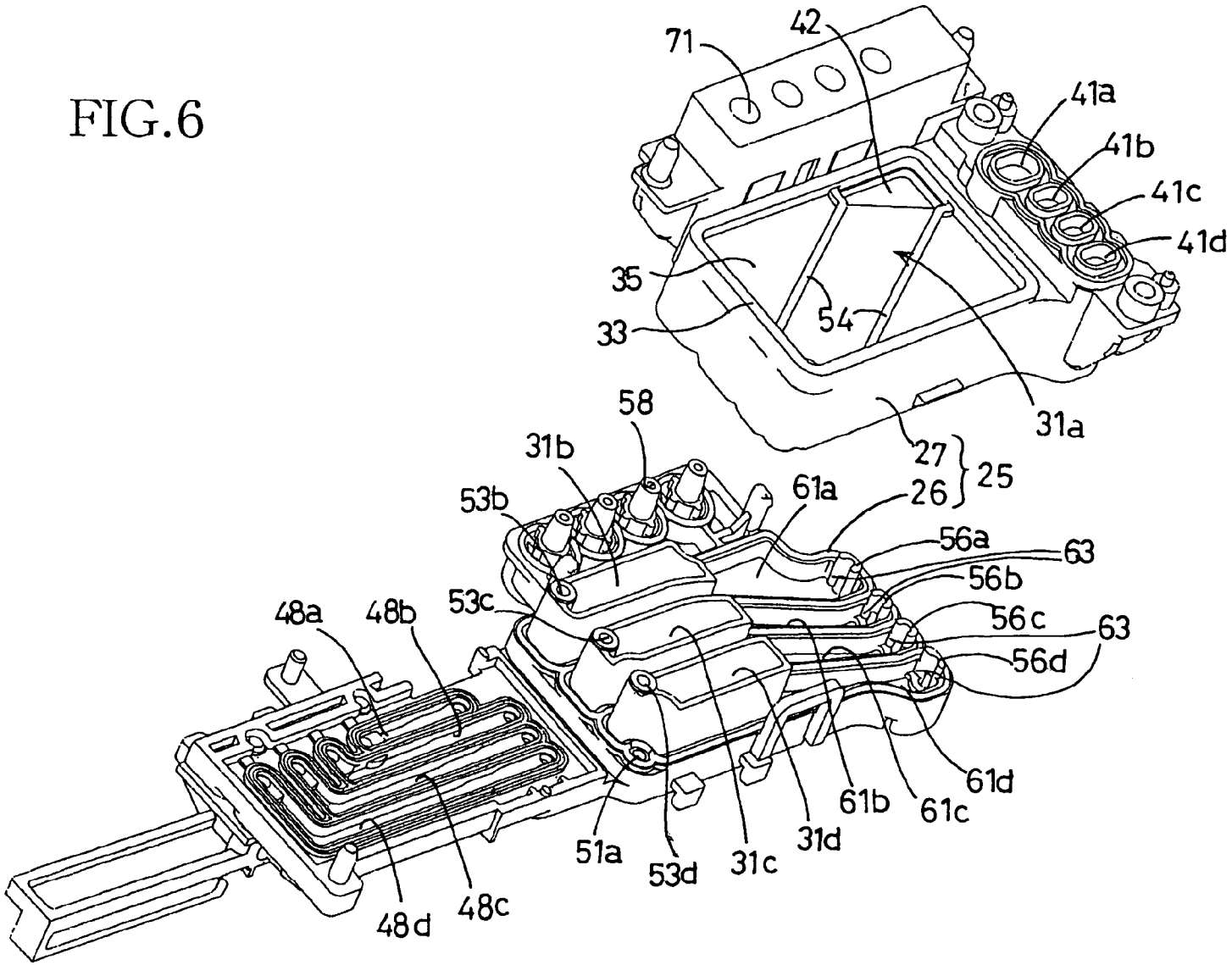
FIG. 6 is another lower perspective and exploded view of the ink delivery unit of the head unit of FIG. 3.
Figure 12:
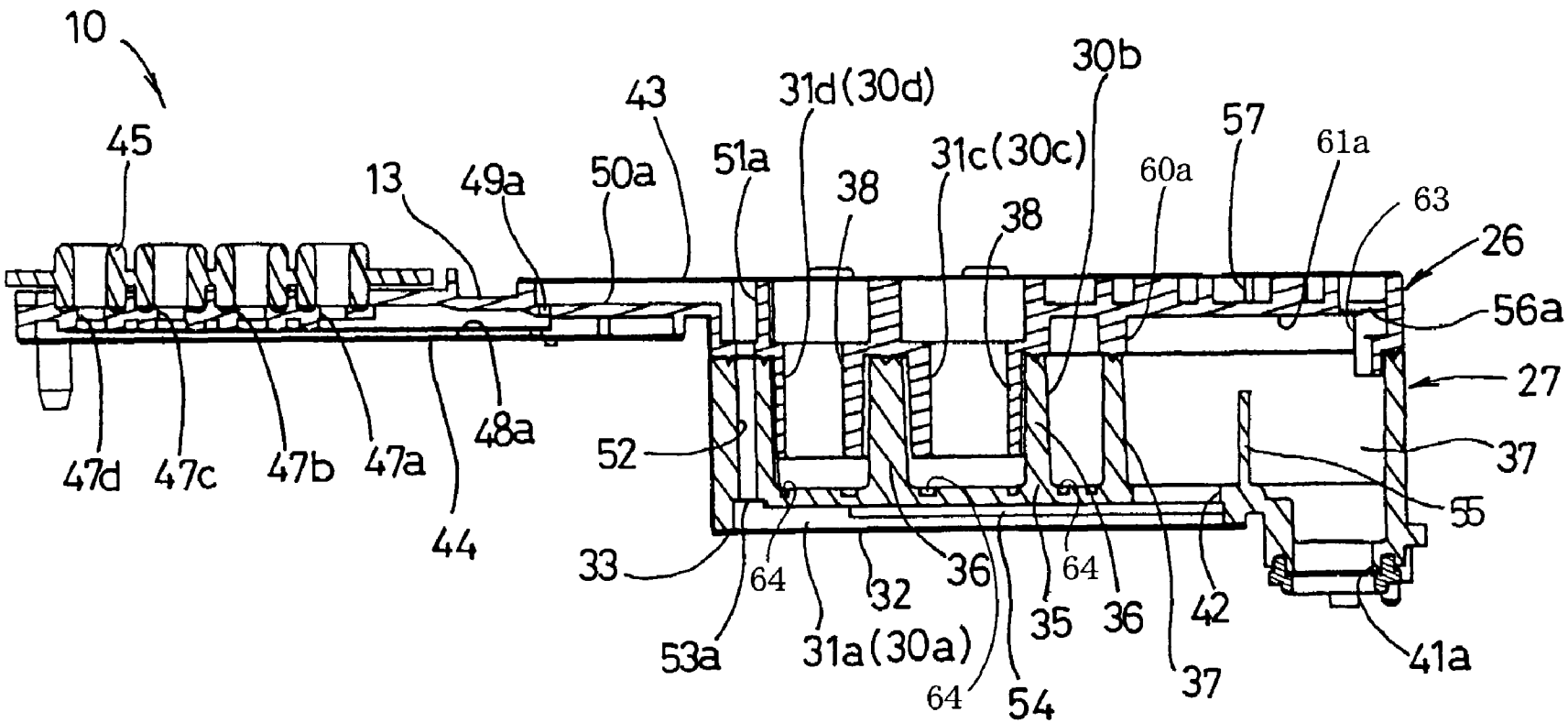
FIG. 12 is a cross sectional view taken along line 12-12 in FIG. 10.
Figure 13:
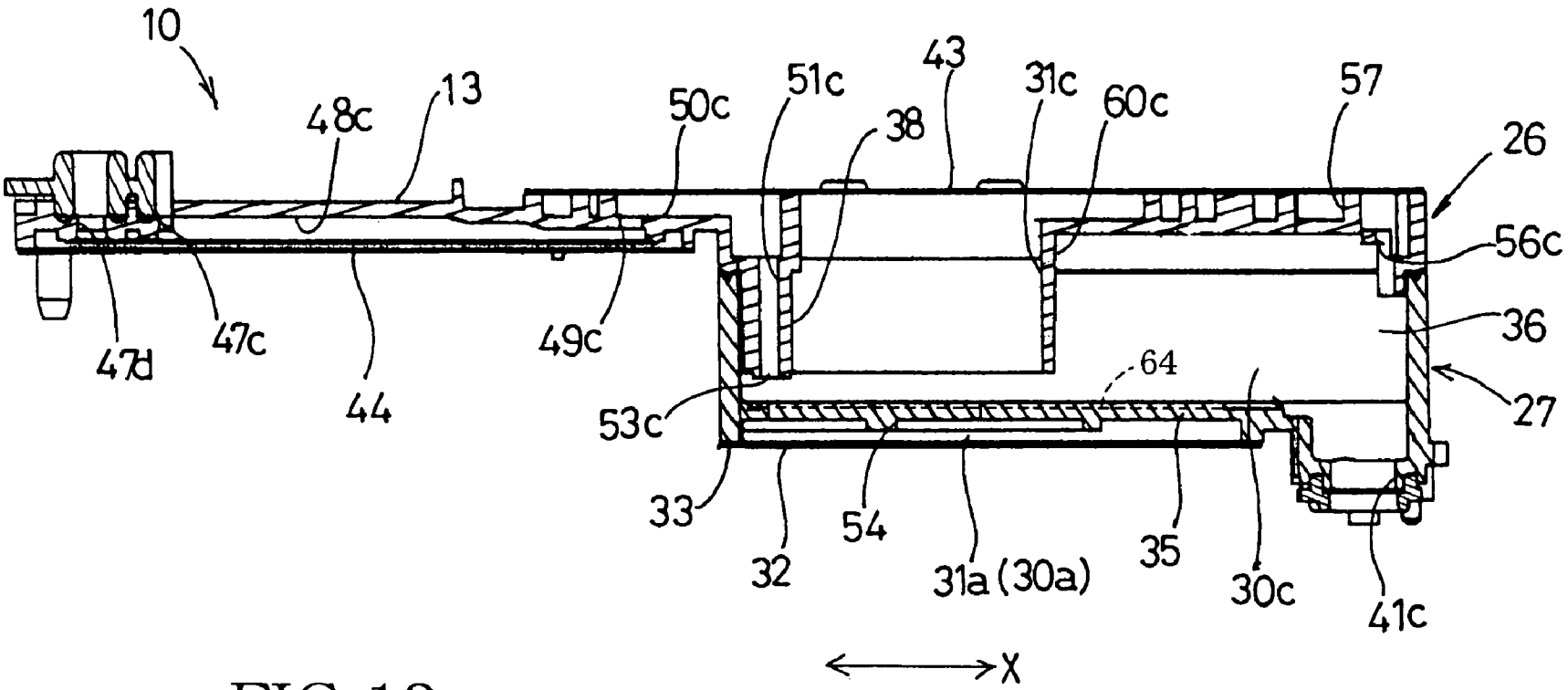
FIG. 13 is a cross sectional view taken along line 13-13 in FIG. 10.

Each of the air discharging holes 56*a*, 56*b*, 56*c*, 56*d* is surrounded by a tubular wall which extends downwardly from a corresponding one of the upper walls 61*a*, 61*b*, 61*c*, 61*d* (see FIGS. 6, 12 and 13). The tubular wall has cutout 63 located in its upstream-side portion and extending in its axial direction. The air discharging holes 56*a*, 56*b*, 56*c*, 56*d* are located substantially right above the outlets 41*a*, 41*b*, 41*c*, 41*d*. Each of the air discharging holes 56*a*, 56*b*, 56*c*, 56*d* is positioned in vicinity of a portion of the circumferential side wall defining a corresponding one of the ink storage chambers 30*a*, 30*b*, 30*c*, 30*d*, which portion faces or defines a downstream-side region of the inner space of the corresponding ink storage chamber. Further, a shortest route connecting each of the air discharging holes 56*a*, 56*b*, 56*c*, 56*d* and a corresponding one of the outlets 41*a*, 41*b*, 41*c*, 41*d* is provided by a straight passage which has neither a restricted portion nor a bent portion, so that upward movements of the bubbles away from the outlets 41*a*, 41*b*, 41*c*, 41*d* toward the air discharging holes 56*a*, 56*b*, 56*c*, 56*d* are not impeded.

Figure 15:
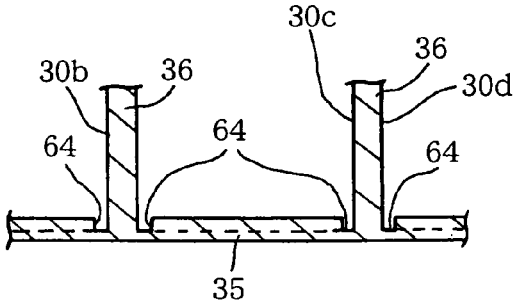
FIG. 15 is an enlarged view showing grooves formed in an inner surface of a bottom wall of each ink storage chamber which is defined by the ink delivery unit.

The bottom wall of each of the ink storage chambers 30*b*, 30*c*, 30*d* has at least one slot or groove 64 formed in its inside surface and extending in a direction away from a corresponding one of the ink inlets 53*b*, 53*c*, 53*d* toward a corresponding one of the ink outlets 41*b*, 41*c*, 41*d* (see FIGS. 13 and 15). In the present embodiment, each of the ink outlets 41*b*, 41*c*, 41*d* is formed through a portion of the bottom wall of a corresponding one of the ink storage chambers 30*b*, 30*c*, 30*d*, which portion is horizontally distant from the primary partition wall 35 and is located downwardly of the primary partition wall 35. The at least one groove 64, which is formed in the bottom wall of each ink storage chamber, preferably includes two grooves 64 which are formed in respective widthwise opposite end portions of the bottom wall of the ink storage chamber. In the present embodiment, each of the two grooves 64 is formed to extend along a proximal end of a corresponding one of the side walls defining the ink storage chamber, so that one of widthwise opposite side surfaces of the groove 64 is flush with a surface of the corresponding side wall (see FIG. 15). The two grooves 64, which are formed in the bottom wall of each ink storage chamber, are connected to each other at their respective ends which are adjacent to a corresponding one of the inlets 53*b*, 53*c*, 53*d*.

The above-described extension portion 13 of the ink delivery unit 10, which is provided by the downstream end portion of the upper casing member 27 as viewed in the feed direction indicated by arrow A (see FIG. 1), has connection ports 47*a*, 47*b*, 47*c*, 47*d* which are respectively connected to the black ink tank 9*a*, cyan ink tank 9*b*, yellow ink tank 9*c* and magenta ink tank 9*d* via the ink tubes 14 (see FIGS. 2, 7, 10 and 12). The connection portions 47*a*, 47*b*, 47*c*, 47*d* are located in one of widthwise opposite end portions of the extension portion 13 and are arranged in the X-axis direction.

The ink tubes 14 are connected to the respective connection ports 47*a*, 47*b*, 47*c*, 47*d* through a sealing member and an elbow joint member 45 which defines therein fluid passages for the respective color inks. Thus, the ink source unit 9 is held in communication with the ink storage chambers 30 through the ink tubes 14, elbow joint member 45, the connection ports 47 and ink supply channels which are defined by the upper and lower casing members 26, 27 (see FIGS. 3-6).

In the present embodiment, the black ink supply channel, which is formed to supply the black ink from the connection port 47*a* to the black ink storage chamber 30*a*, is constituted by a first recessed passage 48*a*, a first communication hole 49*a*, a second recessed passage 50*a*, a second communication hole 51*a* and a third communication hole 52 (see FIG. 12). The first recessed passage 48*a* is provided by a recess which is formed in a lower surface of the extension portion 13 so as to open in the lower surface of the extension portion 13. The first recessed passage 48*a* extends straightly and is connected at one of its opposite longitudinal end portions to the connection port 47*a* (see FIGS. 5 and 12). The first recessed passage 48*a* is connected at the other longitudinal end portion to the first communication hole 49*a* which is formed through the extension portion 13 and opens in upper and lower surfaces of the extension portion 13. The first communication hole 49*a* is connected to an end portion of the second recessed passage 50*a* which is provided by a generally L-shaped recess which is formed in an upper surface of the extension portion 13 so as to open in the upper surface of the extension portion 13 (see FIG. 4). The second recesses passage 50*a* is connected at another end portion to the second communication hole 51*a* which is formed through the extension portion 13 and opens in the upper and lower surfaces of the extension portion 13 (see FIG. 12). The third communication hole 52 is formed through a corner portion of the lower casing member 24 which portion is adjacent to the magenta ink storage chamber 30*d* and is remote from the outlet 41*d* (see FIG. 4). A lower opening end of the third communication hole 52 opens in the lower surface of the primary partition wall 35, and corresponds to the above-described damper chamber inlet 53*a* of the black ink damper chamber 31*a* (see FIG. 12). The upper and lower casing members 26, 27 are connected to each other such that the lower opening end of the second communication hole 51*a* and the upper opening end of the third communication hole 52 are held in close contact with each other, whereby the black ink supply channel is established.

The cyan, yellow and magenta ink supply channels, which are formed to supply the cyan, yellow and magenta inks from the respective connection ports 47*b*, 47*c*, 47*d* to the respective ink storage chambers 30*b*, 30*c*, 30*d*, are constituted by first recessed passage 48*b*, 48*c*, 48*d*, first communication holes 49*b*, 49*c*, 49*d*, second recessed passages 50*b*, 50*c*, 50*d* and second communication holes 51*b*, 51*c*, 51*d* (see FIG. 13). Each of the first recessed passages 48*b*, 48*c*, 48*d* is provided by a generally L-shaped recess which is formed in the lower surface of the extension portion 13 so as to open in the lower surface of the extension portion 13. Each of the first recessed passages 48*b*, 48*c*, 48*d* is connected at one of its opposite longitudinal end portions to a corresponding one of the connection ports 47*b*, 47*c*, 47*d* (see FIGS. 5 and 12). Each of the first recessed passages 48*b*, 48*c*, 48*d* is connected at the other longitudinal end portion to a corresponding one of the first communication holes 49*b*, 49*c*, 49*d* which are formed through the extension portion 13 and opens in upper and lower surfaces of the extension portion 13. Each of the first communication holes 49*b*, 49*c*, 49*d* is connected to an end portion of a corresponding one of the second recessed passages 50*b*, 50*c*, 50*d* each of which is provided by a recess which is formed in the upper surface of the extension portion 13 so as to open in the upper surface of the extension portion 13 (see FIG. 4).

Each of the second recessed passages 50*b*, 50*c*, 50*d* is connected at another end portion to a corresponding one of the second communication holes 51*b*, 51*c*, 51*d* which is formed through the extension portion 13 and opens in the upper and lower surfaces of the extension portion 13 (see FIG.

13). Between the opening of the L-shaped second recessed passage 50*a* of the black ink and the openings of the other second recessed passages 50*b*, 50*c*, 50*d*, an elongated groove or recess 90 is formed to separate the L-shaped second recessed passage 50*a* from the other second recessed passages 50*b*, 50*c*, 50*d*. This recess 90 has an upper opening and a longitudinal opening end which opens outwardly in a horizontal direction (see FIGS. 7 and 10).

Each of the second communication holes 51*b*, 51*c*, 51*d* is formed in one of the above-described ribs 38, and has a lower opening end located in a height position that is slightly lower than height positions of the ribs 38 (see FIG. 9). The lower opening end of each of the second communication holes 51*b*, 51*c*, 51*d* corresponds to a corresponding one of ink storage chamber inlets 53*b*, 53*c*, 53*d* of the respective ink storage chambers 30*b*, 30*c*, 30*d* (see FIGS. 5 and 6). The cyan, yellow and magenta ink supply channels are thus established.

The upper casing member 26 has the above-described air discharging holes 56*a*, 56*b*, 56*c*, 56*d* which are formed therethrough so as to face the buffer chamber 60*a* and the bubble trapper chambers 60*b*, 60*c*, 60*d*, respectively. The air discharging holes 56*a*, 56*b*, 56*c*, 56*d* are connected at their respective upper opening ends to respective discharging passages 57*a*, 57*b*, 57*c*, 57*d* as third delivery channels. The discharging passages 57*a*, 57*b*, 57*c*, 57*d* are provided by respective recesses which are formed independently of each other on the upper surface of the upper casing member 26 and which are located between a row of the air discharging holes 56*a*, 56*b*, 56*c*, 56*d* and the openings of the respective damper chambers 31*b*, 31*c*, 31*d* (i.e., openings of the respective ink storage chambers 30*b*, 30*c*, 30*d*). Each of the discharging passages 57*a*, 57*b*, 57*c*, 57*d*, which is connected at one of its opposite ends to a corresponding one of the air discharging holes 56*a*, 56*b*, 56*c*, 56*d*, extends generally in a direction perpendicular to the longitudinal direction of the upper casing member 26, and is connected at the other end to the above-described bubble discharger unit 11. It is noted that each of the discharging passages 57*a*, 57*b*, 57*c*, 57*d* has parts which are bent in the plan view although it extends generally in the direction perpendicular to the longitudinal direction of the upper casing member 26.

The above-described first recessed passages 48*a*, 48*b*, 48*c*, 48*d* formed in the lower surface of the extension portion 13 are commonly covered by a single film 44, which is fixed, for example, by an adhesive or ultrasonic welding, to lower end faces of peripheral walls defining the recesses providing the first recessed passages 48*a*, 48*b*, 48*c*, 48*d*. Thus, each of the first recessed passages 48*a*, 48*b*, 48*c*, 48*d* constitutes a part of a corresponding one of the ink supply channels. The second recessed passages 50*a*, 50*b*, 50*c*, 50*d* and the discharging passages 57*a*, 57*b*, 57*c*, 57*d*, together with the three damper chambers 31*b*, 31*c*, 31*d*, are commonly closed at their openings by the above-described upper flexible film 43 which is fixed, for example, by an adhesive or ultrasonic welding, to upper end faces of peripheral walls which define the passages 50*a*, 50*b*, 50*c*, 50*d*, 57*a*, 57*b*, 57*c*, 57*d* and the chambers 31*b*, 31*c*, 31*d*. Thus, each of the second recessed passages 50*a*, 50*b*, 50*c*, 50*d* constitutes another part of a corresponding one of the ink supply channels, while each of the discharging passages 57*a*, 57*b*, 57*c*, 57*d* constitutes a corresponding one of the third delivery channels (see FIGS. 12 and 13). It is noted that the elongated recess 90 (located between the second recessed passage 50*a* of the black ink and the other second recessed passages 50*b*, 50*c*, 50*d*) is held in communication with an atmosphere through its longitudinal opening end, although the recess 90 is also covered by the upper flexible film 43.

In the present embodiment, the discharging passage 57*d* (which is held in communication with the magenta ink storage chamber 30*d*) is connected to the air discharging hole 56*d* which is more distant from the bubble discharger unit 11 than the other discharging holes 56*a*, 56*b*, 56*c*. This discharging passage 57*d* is located to be closer to the openings of the respective damper chambers 31*b*, 31*c*, 31*d* (ink storage chambers 30*b*, 30*b*, 30*d*) in the upper casing member 26, than the other discharging passages 57*a*, 57*b*, 57*c*. This arrangement permits the other discharging passages 57*a*, 57*b*, 57*c* also to extend substantially in the Y-axis direction in which the damper chambers 30*b*, 30*c*, 30*d* are arranged, thereby making it possible to save the area required for the disposition of the plurality of discharging passages (see FIGS. 7 and 10).

Between the opening of the discharging passage 57*d* (which is held in communication with the magenta ink storage chamber 30*d*) and the opening of the cyan ink storage chamber 30*b*, an elongated groove or recess 91 is formed to separate from one of them from the other. In other words, the elongated recess 91 is formed in a portion of the upper surface of the main body 25, which portion is interposed between the openings of the respective passage 57*d* and chambers 30*b*, and separates the interposed portion of the upper surface of the main body 25 into two separated regions which are adjacent to the passage 67*d* and the chambers 30*b*, respectively. Like the above-described recess 90, this recess 91 has an upper opening and a longitudinal opening end which opens outwardly in a horizontal direction (see FIGS. 7 and 10). Owing to the longitudinal opening end, the recess 91 is held in communication with the atmosphere although the recess 91 is also covered by the upper flexible film 43.

The bubble discharger unit 11 has an accommodating portion 70 provided by a side portion of the lower casing member 27, which portion is adjacent to the cyan ink storage chamber 30*b* and the black ink buffer chamber 60*a*. This accommodating portion 70 has four vertically-extending communication holes 71 assigned to the four color inks and arranged in a direction perpendicular to the direction in which the ink storage chambers 30*b*, 30*c*, 30*d* are arranged. Each of the communication holes 71 is vertically elongated and opens in upper and lower surfaces of the accommodating portion 70. The accommodating portion 70 is covered at its upper end by a portion of the upper casing member 31 which portion is adjacent to the cyan ink damper chamber 31*b*. Each of the discharging passages 57*a*, 57*b*, 57*c*, 57*d* has an opening end portion 58 which is connected to an upper end portion of a corresponding one of the vertically-extending communication holes 71 (see FIGS. 4-6, 10 and 11).

Within each of the communication holes 71, there is disposed a valve member (not shown) which is similar in construction to that in a second embodiment of the invention described below. In this first embodiment, when the head unit 4 is moved to a position of a maintenance unit (not shown) of the inkjet printer, the valve member is placed in its open position so as to cause the communication hole 71 to be opened at its lower end, and a suction pump is brought into communication with the opened end of the communication hole 71. Thus, the bubbles accumulated in the ink storage chambers 30*a*, 30*b*, 30*c*, 30*d* are sucked so as to be discharged through the discharging holes 56*a*, 56*b*, 56*c*, 56*d*, discharging passages 57*a*, 57*b*, 57*c*, 57*d* and the communication holes 71, to the exterior of the ink delivery unit 10.

In the inkjet printer constructed as described above, the different color inks are supplied to the ink delivery unit 10 from the ink source unit 9 via the ink tubes 14 and the connection ports 47.

The black ink first passes through the connection port 47*a* and the first and second recessed passages 48*a*, 50*a* of the extension portion 13, and is then introduced through the inlet 53*a* into the damper chamber 31*a* which is located on the lower side of the primary partition wall 35. The black ink flowing into the damper chamber 31*a* through the inlet 53*a* is received directly by the flexible film 32 as the damper wall. In this instance, since the black ink is distributed over the entirety of the bottom of the damper chamber 31*a*, the dynamic pressure of the ink is reliably dumped by a wide surface. The black ink, together with the bubbles contained therein, is guided by the guide ribs 54 projecting downwardly from the upper wall of the damper chamber 31*a*, toward the outlet 42. Thus, the black ink rapidly flows out of the damper chamber 31*a* through the outlet 42 having a wide opening area.

The black ink then flows into the buffer chamber 60*a* which is located the upper side of the primary partition wall 35. In this instance, since the buffer chamber 60*a* is located upwardly of the damper chamber 31*a*, the bubbles are floated upwardly to flow into the buffer chamber 60*a*, without remaining in the damper chamber 31*a*. The buffer chamber 60*a* serves to temporarily store the ink in its inner space and also to gradually accumulate bubbles (which have been separated from the ink and floated upwardly) in the bubble trapper region of the inner space adjacent to the upper wall 61*a* of the buffer chamber 60*a*. The ink flowing into the buffer chamber 60*a* through the inlet 42 is made to flow upwardly along the partition rib 55 so as to pass through the bubble trapper region adjacent to the upper wall 61*a*, whereby the trapping of the bubbles contained in the ink is facilitated. After thus bypassing the partition rib 55, the black ink reaches the outlet 41*a* which is formed through the bottom wall of the buffer chamber 60*a*. The black ink flowing out of the buffer chamber 60*a* is then introduced into the recording head 21 through the inlet 81 of the recording head 21.

Meanwhile, The cyan, yellow and magenta inks first pass through the connection ports 47*b*, 47*c*, 47*d* and the first and second recessed passages 48*b*, 48*c*, 48*d*, 50*b*, 50*c*, 50*d*, and are then introduced into the ink storage chambers 30*b*, 30*c*, 30*d* through the inlets 53*b*, 53*c*, 53*d*. Each of the ink storage chambers 30*b*, 30*c*, 30*d* has a corresponding one of the damper sections or chambers 31*b*, 31*c*, 31*d* which stores a certain amount of air or bubbles and which has the upper wall provided by the flexible film 43. Since the damper chamber (31*b*, 31*c*, 31*d*) is located in an upstream-side part of the inner space of the ink storage chamber (30*b*, 30*c*, 30*d*), the dynamic pressure exerted by the ink flowing into the ink storage chamber (30*b*, 30*c*, 30*d*) can be damped by corporation of the bubbles and the flexible film 43. Then, while the ink is flowing along the bottom wall of the ink storage chamber (30*b*, 30*c*, 30*d*) toward the downstream-side region of the inner space, the bubbles are gradually separated from the flowing ink and then floated upwardly so as to be gradually accumulated in the bubble trapper sections or chambers (60*b*, 60*c*, 60*d*). Although the bubbles could be separated from the ink in a region right below the damper chamber (31*b*, 31*c*, 31*d*) (i.e., in a region surrounded by the annular rib 38), the separated bubbles are caught or trapped in the bubble trapped section or chamber (60*b*, 60*c*, 60*d*) rather than in the damper chamber (31*b*, 31*c*, 31*d*) which is filled with the air.

When the inks flow into the recording head 21 from the ink storage chambers 30*a*, 30*b*, 30*c*, 30*d*, the bubbles trapped in the filter 62 (see FIG. 9) is not impeded from being floated upwardly. The bubbles can be rapidly moved upwardly to be accumulated in the buffer chamber 60*a* and the bubble trapper chambers 60*b*, 60*c*, 60*d* which are located right above the outlets 41*a*, 41*b*, 41*c*, 41*d*.

When the head unit 4 is moved to the maintenance position in which the bubble discharger unit 11 is brought in connection with the suction pump, the bubbles accumulated in the buffer chamber 60*a* and the bubble trapper chambers 60*b*, 60*c*, 60*d* are discharged therefrom to the exterior of the head unit 4 through the discharging holes 56*a*, 56*b*, 56*c*, 56*d*, discharging passages 57*a*, 57*b*, 57*c*, 57*d* and the bubble discharger unit 11.

Figure 7:
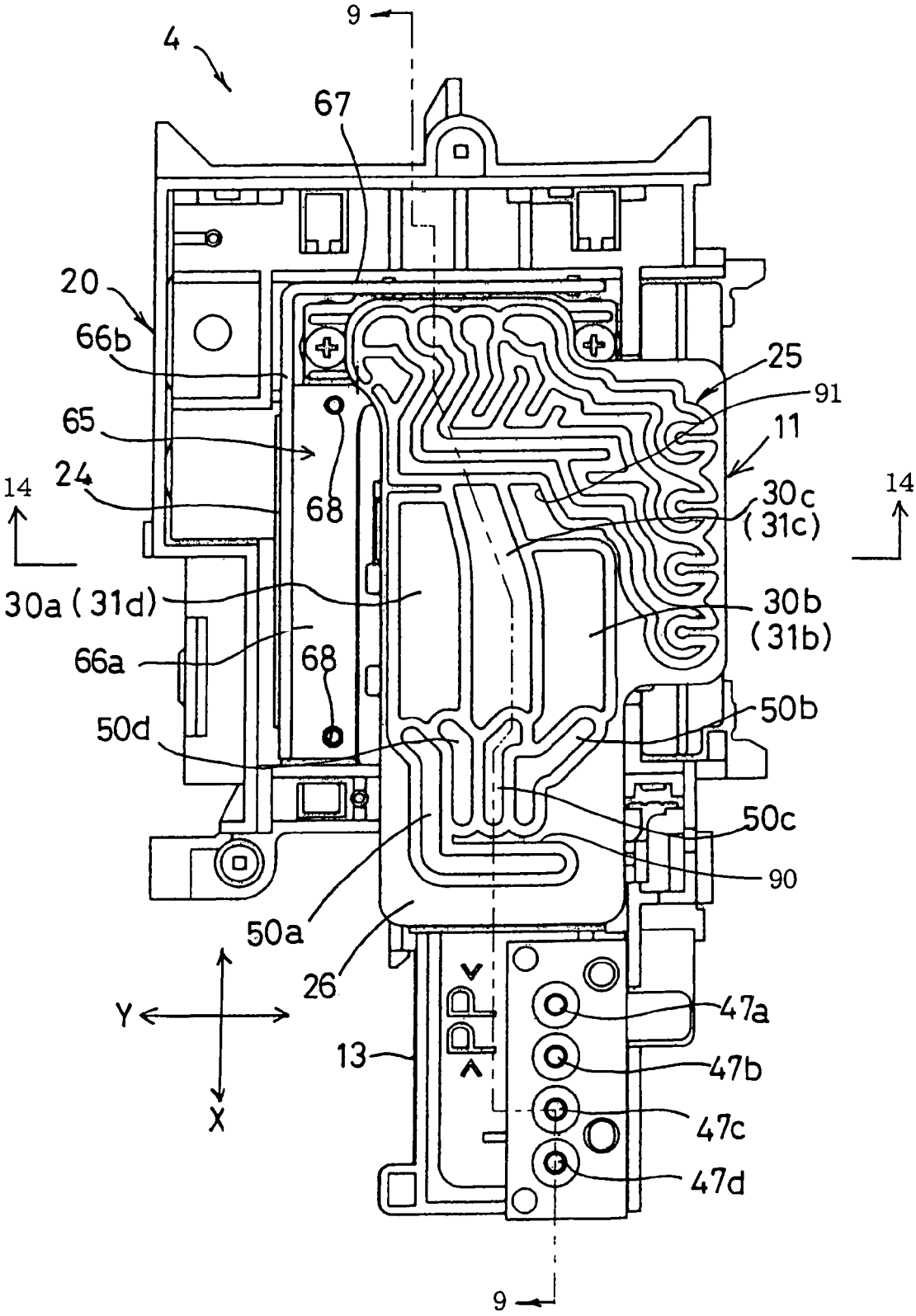
FIG. 7 is a top-plan view of the head unit of FIG. 3, in absence of an upper flexible film which is to be provided to cover an upper surface of a main body of the ink delivery unit.
Figure 14:
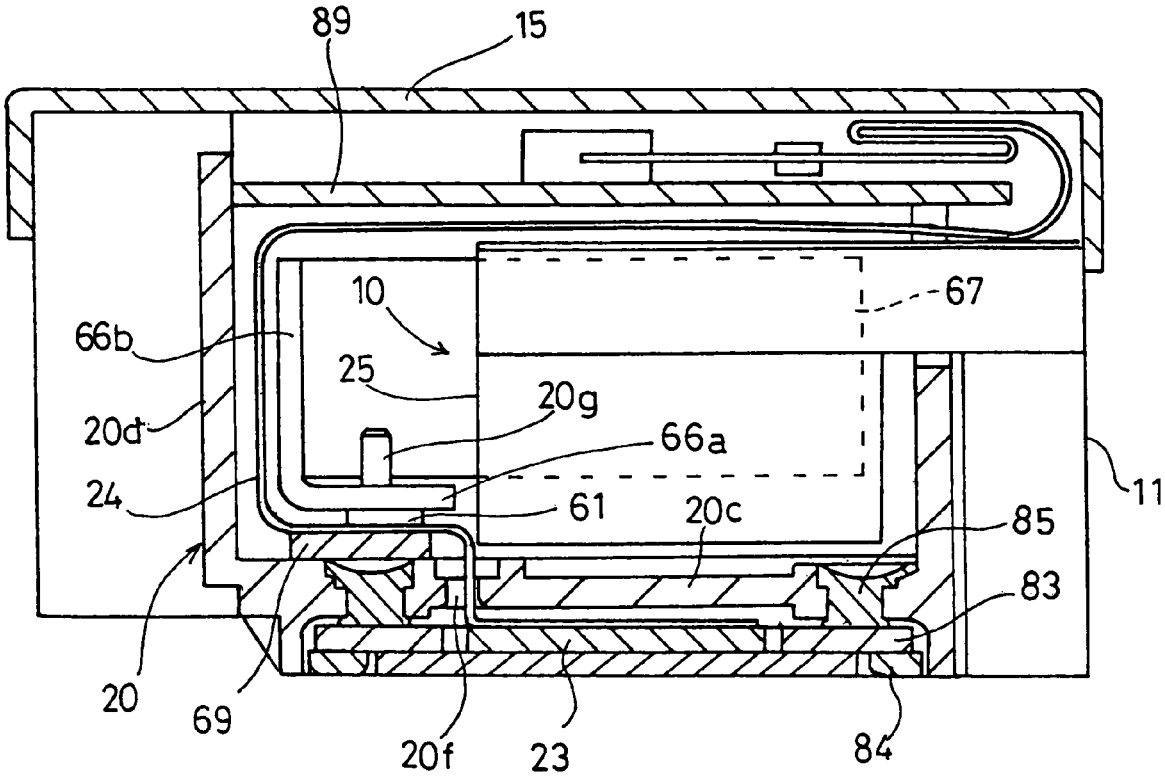
FIG. 14 is a cross sectional view taken along line 14-14 in FIG. 7.

Referring next to FIGS. 3, 7 and 14, there will be described a construction of the heat dissipation unit 65 which is principally constituted by a generally L-shaped member. The L-shaped member includes a bottom plate 66*a* positioned to be parallel with the bottom plate 20*c* of the head holder 20 with a gap spacing therebetween, and a primary side plate 66*b* positioned to be parallel with the side plate 20*d* of the head holder 20 with a gap spacing therebetween. These bottom and side plates 66*a*, 66*b* cooperate to each other to constitute a major portion of the heat dissipation unit 65. The L-shaped member further includes an auxiliary side plate 67 which extends from an end portion of the primary side plate 66*b* in a direction substantially perpendicular to a longitudinal direction of the primary side plate 66*b*, so that the L-shaped member has a substantially L shape also in the plan view. In the present embodiment, the L-shaped member of the heat dissipation unit 65 is provided by a bent plate member made of a metallic material such as aluminum which has a high degree of heat dissipation capacity (a high degree of heat conductivity).

The L-shaped member of the heat dissipation unit 65 has a pair of through-holes 68 formed through the bottom plate 20*c*. The L-shaped member is fixed to the head holder 20 which has a pair of projections 20*g* projecting from the bottom plate 20*c*, by introducing the projections 20*g* of the head holder 20 into the respective through-holes 68. Upper end portions of the projections 20*g* are heat-fused to have an increased diameter, for inhibiting removal of the L-shaped member from the head holder 20.

The L-shaped member is fixed to the head holder 20, such that the primary side plate 66*b* is positioned in vicinity of one of opposite side portions of the main body 25 that is remote from the bubble discharger unit 11, and such that the primary side plate 66*b* is held in substantially parallel with the one of the opposite side portions of the main body 25. In this arrangement, the auxiliary side plate 67 extends along a side portion of the main body 25 in which the ink inlets 41*a*, 41*b*, 41*c*, 41*d* are arranged. The primary side plate 66*b* is positioned relative to the magenta ink storage chamber 30*d* such that a wide surface of the primary side plate 66*b* is substantially parallel and opposed to the magenta ink storage chamber 30*d* with a small gap spacing therebetween (see FIGS. 7 and 14).

Meanwhile, the flexible flat cable 24 extends from the actuator unit 23 (which is disposed on the recording head 21) in the Y-axis direction in which the cyan, yellow and magenta ink storage chambers 30*b*, 30*c*, 30*d* and the black ink buffer chamber 60*a* are arranged. The flexible flat cable 24 is made to pass upwardly through an elongated hole or slit 20*f* which is formed through the bottom plate 20*c* of the head holder 20 and which is elongated in the X-axis direction (in the secondary scanning direction), and then made to extend along the side portion of the main body 25 which is portion is adjacent to the magenta ink storage chamber 30*d*.

The flexible flat cable 24 includes a portion interposed between the bottom plate 20*c* (of the head holder 20) and the bottom plate 66*a* (of the L-shaped member of the heat dissipation unit 65), a portion interposed between the side plate 20*d* and the primary side plate 66*b*, and a portion connected to a circuit board 89 which is disposed above the ink delivery unit 10. The driver chip 61 disposed on the flexible flat cable 24 is upwardly biased by an elastic rubber member 69 which is disposed under the flat cable 24, so as to be held in contact with a lower surface of the bottom plate 66*a* of the L-shaped member of the heat dissipation unit 65, namely, so as to be held in thermally conductive communication with the heat dissipation unit 65. In this arrangement, the driver chip 61 as the heat source is disposed in substantially parallel with the magenta ink storage chamber 30*d*, with the bottom plate 66*a* of the L-shaped member of the heat dissipation unit 65. It is noted that the slit 20*f* has a width larger than a thickness of the driver chip 61, so that the flat cable 24 together with the driver chip 61 can pass through the slit 20*f*. It is noted that the heat dissipation unit 65 as well as the driver chip 61 should be interpreted to correspond to the heat emitter or source, since the heat dissipation unit 65 emits heat when the unit 65 is heated by the driver chip 61 (although the unit 65 does not generate heat by itself).

Next, there will be described a process of checking the ink delivery unit 10 for leakage, by way of example.

Prior to initiation of the checking process, the plurality of channels defined by the ink delivery unit 10 are divided into groups, such that ones of the openings (or recesses) of the chambers 30*b*, 30*c*, 30*d* (as the first delivery channels), the discharging passages 57*a*, 57*b*, 57*c*, 57*d* (as the third delivery channels) and the second recessed passages 50*a*, 50*b*, 50*c*, 50*d* (as the ink supply channels) belonging to the same group are not positioned to be adjacent to each other. In the present first embodiment, the channels assigned to the cyan ink and those assigned to the magenta ink cooperate to form one group, while the channels assigned to the black ink and those assigned to the yellow ink cooperate to form another group. That is, the delivery cannels for the cyan and magenta inks are checked together, while the delivery channels for the black and yellow inks are checked together.

A step of checking the delivery channels for the cyan and magenta inks is implemented by supplying a pressurized fluid in the form of a pressurized or vacuumed air into the delivery channels for the cyan ink (i.e., the cyan ink storage chamber 30*b* and the discharging passage 57*b* that is held in communication with the chamber 30*b*) via the connecting port 47*b* and also into the delivery channels for the magenta ink (i.e., the magenta ink storage chamber 30*d* and the discharging passage 57*d* that is held in communication with the chamber 30*d*) via the connecting port 47*d*, such that a predetermined amount of pressure is given into the delivery channels for the cyan ink and also into the delivery channels for the magenta ink. In this instance, the communication holes 71 held in communication with the delivery channels subjected to the leakage check are closed by the valve bodies.

Then, the air pressure in the delivery channels for the cyan ink is measured at the connecting port 47*b*, while that in the delivery channels for the magenta ink is measured at the connecting port 47*d*, for checking if there is a leakage between the upper surface of the upper casing member 26 and the upper flexible film 43 which should be fluid-tightly bonded to each other and also between the lower surface of the extension portion 13 of the upper casing member 26 and the film 44 which should be fluid-tightly bonded to each other.

If there is a defect in bonding connection between the flexible film 43 and an upper end surface of an outer peripheral wall defining the discharging passage 57*d* for the magenta, namely, if there is a leakage therebetween, the air is leaked from the discharging passage 57*d* to the exterior of the ink delivery unit 10 via its adjacent region such as the yellow ink storage chamber 30*c*, discharging passage 57*c* and the recess 91, or directly to the exterior.

If there is a defect in bonding connection between the flexible film 43 and an upper end surface of an outer peripheral wall surrounding the magenta ink storage chamber 30*d*, the air is leaked from the ink storage chamber 30*d* to the exterior of the ink delivery unit 10 via its adjacent region such as the yellow ink storage chamber 30*c* and the second recessed passage 50*a* for the black ink, or directly to the exterior.

If there is a defect in bonding connection between the flexible film 43 and an upper end surface of an outer peripheral wall defining the second recessed passage 50*d* for the magenta ink, the air is leaked from the second recessed passage 50*d* to the exterior of the ink delivery unit 10 via its adjacent region such as the yellow ink storage chamber 30*c* and the second recessed passage 50*c* for the yellow ink and recess 90, or directly to the exterior. Although a leakage could be formed also between the flexible film 43 and an upper surface of a wall separating the magenta ink storage chamber 30*d* from the second recessed passage 50*d* for the magenta ink, this leakage would affect the recording quality very little since the same color ink flows in the chamber 30*d* and passage 50*d*.

Meanwhile, if there is a defect in bonding connection between the flexible film 43 and an upper end surface of an outer peripheral wall defining the discharging passage 57*b* for the cyan ink, namely, if there is a leakage therebetween, the air is leaked from the discharging passage 57*b* to the exterior of the ink delivery unit 10 via its adjacent region such as the discharging passage 57*c* for the yellow ink and the discharging passage 57*a* for the black ink, or directly to the exterior.

If there is a defect in bonding connection between the flexible film 43 and an upper end surface of an outer peripheral wall surrounding the cyan ink storage chamber 30*b*, the air is leaked from the ink storage chamber 30*b* to the exterior of the ink delivery unit 10 via its adjacent region such as the yellow ink storage chamber 30*c*, the second recessed passage 50*b* for the cyan ink and the recess 91, or directly to the exterior.

If there is a defect in bonding connection between the flexible film 43 and an upper end surface of an outer peripheral wall defining the second recessed passage 50*b* for the cyan ink, the air is leaked from the second recessed passage 50*b* to the exterior of the ink delivery unit 10 via its adjacent region such as the second recessed passage 50*c* for the yellow ink and recess 90, or directly to the exterior. Although a leakage could be formed also between the flexible film 43 and an upper surface of a wall separating the cyan ink storage chamber 30*b* from the second recessed passage 50*b* for the cyan ink, this leakage would affect the recording quality very little since the same color ink flows in the chamber 30*b* and passage 50*b*.

As is clear from the above description, by detecting change in the pressure in the delivery channels for the cyan ink at the connecting port 47*b* and detecting change in the pressure in the delivery channels for the magenta ink at the connecting port 47*d*, it is possible to determine if there is a leakage in the peripheries of the discharging passage 57*b* for the cyan ink, the cyan ink storage chamber 30*b* and the second recessed passage 50*b* for the cyan ink, and at the same time to determine if there is a leakage in the peripheries of the discharging passage 57*d* for the magenta ink, the magenta ink storage chamber 30*d* and the second recessed passage 50*d* for the magenta ink.

A step of checking the delivery channels for the black and yellow inks can be implemented substantially in the same manner as in the above-described step of checking those for the cyan and magenta inks.

In the inkjet printer constructed as described above, the black ink damping chamber 31*a* is formed to have a relatively small height and is positioned on the lower side of the primary partition wall 35, while the three damping chambers 31*b*, 31*c*, 31*d* for the cyan, yellow and magenta inks are positioned to be parallel with each other on the upper side of the primary partition wall 35. The black ink damping chamber 31*a* is defined between the primary partition wall 35 and the lower flexible film 32 as the damper wall which is opposed to the primary partition wall 35, while the other damping chambers 31*b*, 31*c*, 31*d* are defined between the primary partition wall 35 and upper flexible film 43 as the damper wall which is opposed to the primary partition wall 35. This arrangement is effective to enable the ink delivery unit 10 to be made compact in size, even where the ink delivery unit has to be equipped with a large number of damper chambers for achieving a full-color recording operation.

In the damper chamber 31*a* whose height dimension has to be minimized, the inlet 53*a* and the outlet 42 are positioned in the respective positions which are substantially diagonal relative to each other. This positional relationship between the inlet and outlet 53*a*, 42 stabilizes the flow of the ink within the damper chamber 31*a*, and remarkably reduces delay of the flow of the ink and bubbles in the chamber 31*a*.

Further, in the damper chamber 31*a*, the guide rib 54 defines the ink path through which the ink is to flow in the direction away from the inlet 53*a* toward the outlet 42, so that the ink and the bubbles can further rapidly flow out of the chamber 31*a*. Still further, the provision of the guide rib 54 on the upper wall of the chamber 31*a* is technically significant in view of a characteristic of a gas, due to which the bubbles separated from the ink is moved upwardly or toward the upper wall. That is, the bubbles floated up can be reliably guided by the guide rib 54 which is provided on the upper wall, toward the outlet 42, whereby accumulation of the bubbles in the buffer chamber 60*a* is facilitated. Therefore, the bubbles can be satisfactorily removed through the buffer chamber 60*a*, with execution of a discharging operation to discharge the bubbles therefrom, thereby making it possible to avoid problematic introduction of the bubbles into the recording head 21 which could adversely affect an ink ejection performance of the inkjet printer.

In the inkjet printer constructed as described above, the ink delivery unit 10 further has the partition rib 55 which projects upwardly from the bottom wall of the buffer chamber 60*a*, so as to completely divide at least the lower part of the inner space of the buffer chamber 60*a* into the upstream-side region and the downstream-side region which the inlet 42 and the outlet 41*a* of the buffer chamber 60*a* face, respectively. The partition rib 55 is provided by a solid wall having no through-hole or aperture, rather than a filter wall having a network structure, so that the ink flowing into the chamber 60*a* through the inlet 42 formed through the bottom wall can not reach the outlet 41*a* formed through the bottom wall, without passing over the partition rib 55. This arrangement avoids the bubbles vigorously flowing into the buffer chamber 60*a*, from being delivered directly from the inlet 42 to the outlet 41*a*, irrespective of sizes of the bubbles. Since the bubbles together with the ink are once elevated along the partition rib 55, the bubbles separated from the ink are easily accumulated in the bubble trapper region adjacent to the upper wall 61*a*. It is therefore possible to reliably prevent the bubbles from causing a defect in the ejection of the ink by the recording head 21.

Further, the black ink storage chamber 30*a* is sectioned into the damper section or chamber 31*a* serving to damp the dynamic pressure and the buffer section or chamber 60*a* serving to accumulate therein the bubbles contained in the ink. In general, the black ink is supplied more than the other color inks in amount due to its more frequent use, so that the pressure wave transmitted through the black ink is relatively large in amplitude. The damper chamber 31*a*, which is formed to be substantially independent from the buffer chamber 60*a*, can be shaped to exhibit a high performance of damping the dynamic pressure exerted by the ink.

Although the damper chamber 31*a* and the buffer chamber 60*a* are formed to be substantially independent from each other, these chambers 31*a*, 60*a* are arranged to partially defined by the common wall, i.e., the primary partition wall 35 and to partially overlap with each other in the plan view, so that the ink storage chamber 30*a* as a whole can be made compact in size.

Further, the partition rib 55 projecting upwardly from the bottom wall of the buffer chamber 60*a* is formed integrally with the lower casing member 27 having a portion providing the bottom wall, so that the ink delivery unit 10 having the buffer chamber 60*a* which has the partition rib 55 in its inner space can be easily formed by simply fixedly superposing the upper and lower casing members 26, 27 on each other.

In the ink delivery unit, the cyan, yellow and magenta ink storage chambers 30*b*, 30*c*, 30*d* and the black ink buffer chamber 60*a* are arranged substantially in parallel with each other and have the respective bottom walls which are provided by the primary partition wall 35 as the common bottom wall. Among the theses chambers 30*b*, 30*c*, 30*d*, 60*a*, the bubbles within the magenta ink storage chamber 30*d*, which is closer to the driver chip 61 as the heat source than the other chambers 30*b*, 30*c*, 60*a*, are likely to grow rapider than those within the other chambers 30*b*, 30*c*, 60*a*. However, since the magenta ink storage chamber 30*d* is given a larger volume than the other chambers 30*b*, 30*c*, 60*a*, it is possible to substantially equalize all of these chambers 30*a*, 30*b*, 30*c*, 60*a* to each other in ratio of an amount of bubbles generated therein with respect to the volume thereof. That is, if a larger amount of bubbles are generated in the magenta ink storage chamber 30*d* closer to the driver chip 61, the larger amount of generated bubbles can be accumulated in the ink storage chamber 30*d* which has a relatively large volume.

This arrangement is effective to enable the magenta ink storage chamber 30*d* to be substantially equalized to the other chambers 30*b*, 30*c*, 60*a* in point of time at which a predetermined amount of the bubbles are accumulated in the chamber, thereby making it possible to reduce the required number of times of the execution of the discharging operation simultaneously made by the bubble discharger unit 11 to the chambers 30*b*, 30*c*, 30*d*, 60*a*, and accordingly resulting in an improved maneuverability of the inkjet printer. In addition, the reduced number of times of the execution of the bubble discharging operation by the bubble discharger unit 11 leads to a reduction in an amount of the ink which is wasted or lost rather than being used for a recording operation.

Further, the driver chip 61 is disposed to be held substantially in parallel with the magenta ink storage chamber 30*d*, with the bottom plate 66*a* of the L-shaped member of the heat dissipation unit 65 being interposed therebetween. Further, the L-shaped member of the heat dissipation unit 65 is arranged to bridge a side portion of the main body 25 of the ink delivery unit 10 (in which portion the magenta ink storage chamber 30*d* extends) and another side portion of the main body 25 (in which portion the outlets 41*a*, 41*b*, 41*c*, 41*d* are arranged). These arrangements are effective to avoid the main body 25 from being influenced directly by the heat generated by the driver chip 61 and also to assemble the recording head 21, the main body 25, the heat dissipation unit 65 and the driver chip 61 into an assembly made compact in size which contributes to a reduction in size of the entirety of the inkjet printer. In other words, the arrangements enable the maneuverability of the inkjet printer to be improved without increasing the size of the apparatus (i.e., the inkjet printer).

Further, since the driver chip 61 disposed on the flexible flat cable 24 is held in contact with the lower or outside surface of the bottom plate 66*a* of the L-shaped member of the heat dissipation unit 65, the heat generated by the driver chip 61 is assuredly transmitted to the heat dissipation unit 65 so as to be dissipated or radiated to the atmosphere through the dissipation unit 65. Further, since the primary side plate 66*b* of the L-shaped member of the heat dissipation unit 65 is spaced apart from the side portion of the main body 25 in which the magenta ink storage chamber 30*d* is located, by a certain amount of gap spacing, the heat dissipation unit 65 is capable of minimizing or reducing transfer of the heat (generated by the driver chip 61) to the magenta ink storage chamber 30*d* which is closer to the driver chip 61 and the primary side plate 66*b*, while assuring its own function to dissipate the heat generated by the driver chip 61 to the exterior of the ink delivery unit 10, thereby contributing to a reduction in the required number of times of the execution of the discharging operation by the bubble discharger unit 11 and an improvement in the maneuverability of the inkjet printer.

The L-shaped member of the heat dissipation unit 65 includes the auxiliary side plate 67 which extends from primary side plate 66*b* in the direction substantially perpendicular to the primary side plate 66*b*, so that the heat dissipation unit 65 is given a large surface area while being disposed along the outer periphery of the main body 25 without requiring a large space for the disposition of the dissipation unit 65. Thus, the heat dissipation unit 65 has a high heat dissipation capacity in spite of simplicity in its construction.

Further, in the present embodiment, the heat dissipation unit 65, the ink delivery unit 10 and the bubble discharger unit 11 are arranged in the Y-axis direction (i.e., in the primary scanning direction) as seen in the plan view. In other words, the three units are arranged in a direction in which a space (required for allowing the reciprocating motion of the head unit 4) is elongated, thereby eliminating a need of providing another space exclusively for the dispositions of the heat dissipation unit 65 and the bubble discharger unit 11. Consequently, the head unit 4 can be made small in its dimension as measured in the secondary scanning direction, whereby the inkjet printer in its entirety can be made compact in size.

As described above, in the ink storage chambers 30*a*, 30*b*, 30*c*, 30*d*, each of the bubble trapper sections 60*a*, 60*b*, 60*c*, 60*d* and each of the air discharging holes 56*a*, 56*b*, 56*c*, 56*d* are disposed substantially right above a corresponding one of the outlets 41*a*, 41*b*, 41*c*, 41*d*. The shortest route connecting each of the air discharging holes 56*a*, 56*b*, 56*c*, 56*d* and a corresponding one of the outlets 41*a*, 41*b*, 41*c*, 41*d* is provided by the straight passage which has neither a restricted portion nor a bent portion, so that the bubbles trapped in the filter 62 (which is disposed below each of the outlets 41*a*, 41*b*, 41*c*, 41*d*) is not impeded from being floated upwardly. The bubbles can be rapidly moved upwardly to be accumulated in the buffer chamber 60*a* and the bubble trapper chambers 60*b*, 60*c*, 60*d* which are located right above the outlets 41*a*, 41*b*, 41*c*, 41*d*. It is therefore possible to prevent the outlets 41*a*, 41*b*, 41*c*, 41*d* from being clogged with the bubbles, thereby enabling the ink to be delivered to the recording head 21 without delay.

Further, a certain amount of the air can be reliably stored in each of the cyan, yellow and magenta ink damper chambers 31*b*, 31*c*, 31*d*, owing to the simple arrangement in which the annular rib 38 projects downwardly from the upper wall of the chamber. The amount of the air storable in the chamber can be defined by a cross sectional area surrounded by the annular rib 38 and a vertical distance by which the annular rib 38 projects downwardly from the upper wall. Still further, since the upper walls of the damper chambers 31*b*, 31*c*, 31*d* are provided by the upper flexible film 43, each of the damper chambers 31*b*, 31*c*, 31*d* can constantly exhibit a high degree of damping performance owing to the corporation of the upper flexible film 43 and the stored bubbles.

In addition, since each of the air discharging holes 56*a*, 56*b*, 56*c*, 56*d* is positioned in vicinity of the downstream-side portion of the circumferential side wall defining a corresponding one of the ink storage chambers 30*a*, 30*b*, 30*c*, 30*d*, the bubbles accumulated in the in the buffer chamber 60*a* and the bubble trapper chambers 60*b*, 60*c*, 60*d* can be efficiently discharged out in the discharging operation made by the bubble discharger unit 11, thereby making it possible to save the space for accommodating the ink. Thus, a large amount of the ink can be stored in the ink storage chambers 30*a*, 30*b*, 30*c*, 30*d*.

It is common that the ink channels of the inkjet printer constructed as described above are, prior to its use by an user, filled with a solution that is temporally stored during transportation of the inkjet printer. Further, there is a case where the inkjet printer is subjected to a test which is made prior to delivering to market, so as to confirm its ink ejecting performance. Therefore, before the delivering, the inkjet printer is subjected to an operation in which a liquid such as the solution and the ink is initially introduced into the empty ink channels. In process of the operation, the air is discharged through the air discharging holes 56*a*, 56*b*, 56*c*, 56*d* by activating the bubble discharger unit 11, and is then discharged through nozzles 22 by a suction cap brought into contact with the nozzle opening surface of the recording head 21, for thereby reducing the pressure in the ink channels defined by the ink delivery unit 10 and the recording head 21. With the reduction in the pressure in the ink channels, the liquid is introduced into the ink channels from a liquid source through the ink tubes 14.

The ink delivery channels for cyan, yellow and magenta inks are constituted by the ink storage chambers 30*b*, 30*c*, 30*d* which are arranged in parallel with each other so as to have respective widths that are made small. Further, in each of the ink storage chambers 30*b*, 30*c*, 30*d*, a part of the storage chamber (30*b*, 30*c*, 30*d*) located on a lower side of the damper chamber (31*b*, 31*c*, 31*d*) has a height that is made small by the downwardly projecting rib 38, and a certain amount of air is stored in the damper chamber (31*b*, 31*c*, 31*d*), so that an ink passage defined by that part of the ink storage chamber (30*b*, 30*c*, 30*d*) has a reduced width, height or cross sectional area. The liquid initially introduced into the ink storage chamber (30*b*, 30*c*, 30*d*) is likely to be affected by a surface tension thereof, particularly, in the above-described part of the storage chamber (30*b*, 30*c*, 30*d*). Therefore, the initially introduced liquid is impeded from flowing rapidly, and is likely to be stopped before reaching the downstream end of the ink channel. However, such a failure in the initial introduction of the liquid can be prevented by the arrangement in which the above-described at least one groove 64 is formed in the bottom wall of the ink storage chamber (30*b*, 30*c*, 30*d*) such that the groove 64 extends throughout the above-described part which defines the ink passage having the reduced width, height or cross sectional area. The liquid introduced into the ink storage chamber (30*b*, 30*c*, 30*d*) is made to enter the groove 64, whereby the surface tension impeding the flow of the liquid can be reduced. The liquid can be moved through the groove 64 at a speed increased owing to a capillary action, in a direction away from the inlet (53*b*, 53*c*, 53*d*) toward the outlet (41*b*, 41*c*, 41*d*). Thus, the initial introduction of the liquid can be made quickly.

In the inkjet printer constructed according to the present embodiment, the elongated recess 90 held in communication with the exterior of the ink delivery unit 10 is provided between the L-shaped second recessed passage 50*a* (for the black ink) and the other second recessed passages 50*b*, 50*c*, 50*d*, while the elongated recess 91 held in communication with the exterior of the ink delivery unit 10 is provided between the discharging passage 57*d* (for the magenta ink) and the cyan ink storage chamber 30*b*. Owing to the provision of the recesses 90, 91, the outer periphery of each one of the openings of the channels belonging to the same group (which is formed in the above-described leakage checking process) is not contiguous to that of any other of the openings of them.

In the present embodiment in which the plurality of channels each one of which is assigned to the four different color inks are divided into the two groups, the process for checking the ink delivery unit 10 for leakage can be made by implementing two checking steps. Thus, the number of the checking steps to be implemented can be made smaller than where the plurality of channels are divided into groups whose number corresponds to the number of the colors of the inks. Thus, a length of time required to carry out the process of checking the ink delivery unit 10 for leakage can be remarkably reduced, and the checking process can be easily carried out, even where the channel such as the ink storage chambers 30*a*-30*d* and the discharging passages 57*a*-57*d* are arranged with high density so as to make the entirety of the ink delivery unit 10 compact in size to meet a demand for reduction in a floor space required for installation of the inkjet printer. Further, the leakage checking process can be carried out, even if the number of channels defined in the ink delivery unit is further increased to meet a demand for increase in the number of colors of the inks.

While each of the elongated recesses 90, 91 has the longitudinal opening end so as to be held in communication with the atmosphere in the present embodiment, it may be arranged to be isolated from the atmosphere. In this arrangement, too, it is possible to avoid the outer periphery of each one of the openings of the channels belonging to the same group, from being contiguous to any other of the openings of them. However, if ones of the channels belonging to the same group are brought into leakage communication via the recess 90 or 91, there is a risk that the different color inks might be mixed with each other in use of the inkjet printer. In this sense, it is preferable that each of the recesses 90, 91 is held in communication with the atmosphere as in the present embodiment. In this preferable arrangement, as long as there is a leakage communication between the recess and any one of the channels, the pressure in the channel in question exhibits a detectable change such as a pressure reduction to the atmospheric level in the leakage checking process, making it possible to reliably detect the presence of such a leakage, i.e., a defect in the bonding connection.

Referring next to FIGS. 16-21, there will be described an inkjet printer constructed according to a second embodiment of the invention, which is different from the above-described first embodiment, in respect to construction of the ink delivery unit. The same reference numerals as used in the first embodiment will be used in this second embodiment, to identify the functionally corresponding or structurally similar elements, which will not be described in detail to avoid redundancy of description.

In this second embodiment, the ink delivery unit 10' has a primary (horizontal) partition wall 35' and secondary (vertical) partition walls 36', 37' which cooperate with each other to define a total of four mutually-independent storage chambers 30*a*', 30*b*', 30*c*', 30*d*' which are assigned to the respective four colors.

In the present embodiment, a damper section or chamber (first sub-chamber) 31*a*' of the black ink (BK) storage chamber 30*a*' is located on a lower side of the primary partition wall 35', while the cyan ink (C) storage chamber 30*b*', yellow ink (Y) storage chamber 30*c*' and magenta ink (M) storage chamber 30*d*' (which are separated from each other by the secondary partition walls 36', 37') are located on an upper side of the primary partition wall 35'. Thus, the four storage chambers 30*a*', 30*b*', 30*c*', 30*d*' are provided in two layers, i.e., in upper and lower layers.

More specifically described, a main body 25' of the ink delivery unit 10' has a generally rectangular, box-like outer wall, and is constituted by an upper casing member 26' and a lower casing member 27' are fluid-tightly fixed to each other, for example, by ultrasonic welding. The lower casing member 27' has a lower opening and an upper opening which is closed by the upper casing member 26' fixedly disposed on the lower casing member 27'. It is noted that each of the upper and lower casing members 26', 27' is formed, by injection, of a synthetic resin.

The above-described primary partition wall 35' is provided by a portion of the lower casing member 27', and is distant from and parallel with each of upper and lower surfaces of the lower casing member 27'. The lower opening of the lower casing member 27' is defined by a recess which is formed in a major portion of the lower surface of the lower casing member 27'. The lower opening of the lower casing member 27' is fluid-tightly closed by a lower flexible film 32' (see FIGS. 21A, 21B and 21C) which is provided by a thin film formed of synthetic resin and inhibiting permeation of air or liquid therethrough. Described specifically, the lower flexible film 32' is fixed at its outer peripheral portion, for example, by an adhesive or ultrasonic welding, to a lower end face of a peripheral wall 33' of the lower casing member 27' which defines the lower opening of the lower casing member 27' (see FIGS. 21B and 21C). The lower flexible film 32' and the primary partition wall 35' cooperate with each other to define the above-described damper chamber 31*a*' of the black ink storage chamber 30*a*'.

Figure 21A:
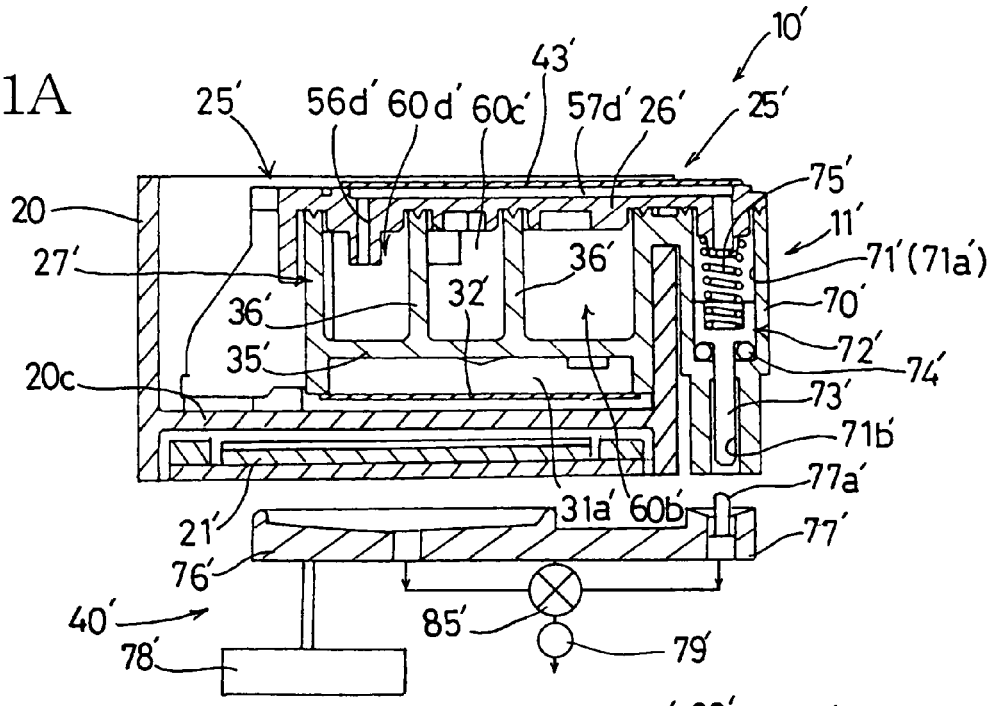
FIG. 21A is a cross sectional view taken along line 21A-21A in FIG. 16.
Figure 21B:
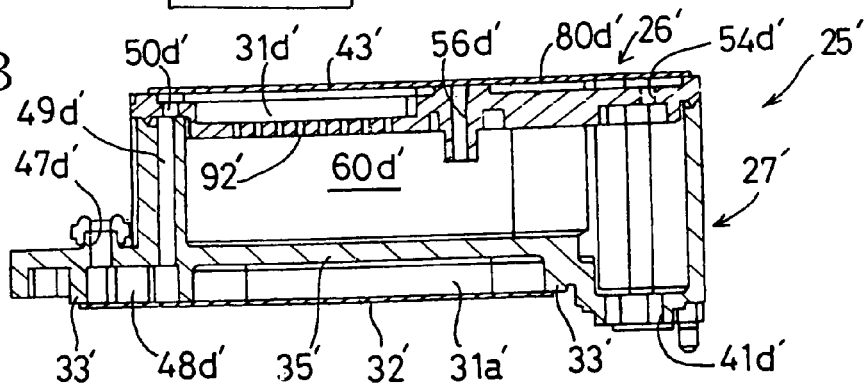
FIG. 21B is a cross sectional view taken along line 21B-21B in FIG. 16.
Figure 21C:
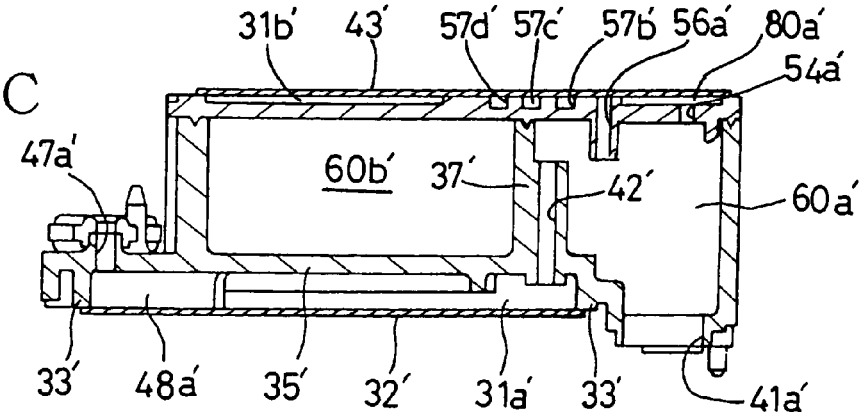
FIG. 21C is a cross sectional view taken along line 21C-21C in FIG. 17.

The two secondary partition walls 36' and the one secondary partition wall 37' extend upwardly from the upper surface of the primary partition wall 35' (see FIGS. 21A and 21C). Thus, an upper portion of the lower casing member 27' (which portion is located on the upper side of the primary partition wall 35') cooperates with the upper casing member 26' to define bubble trapper sections or chambers (second sub-chambers) 60*a*', 60*b*', 60*c*', 60*d*' of the four storage chambers 30.

Figure 18:
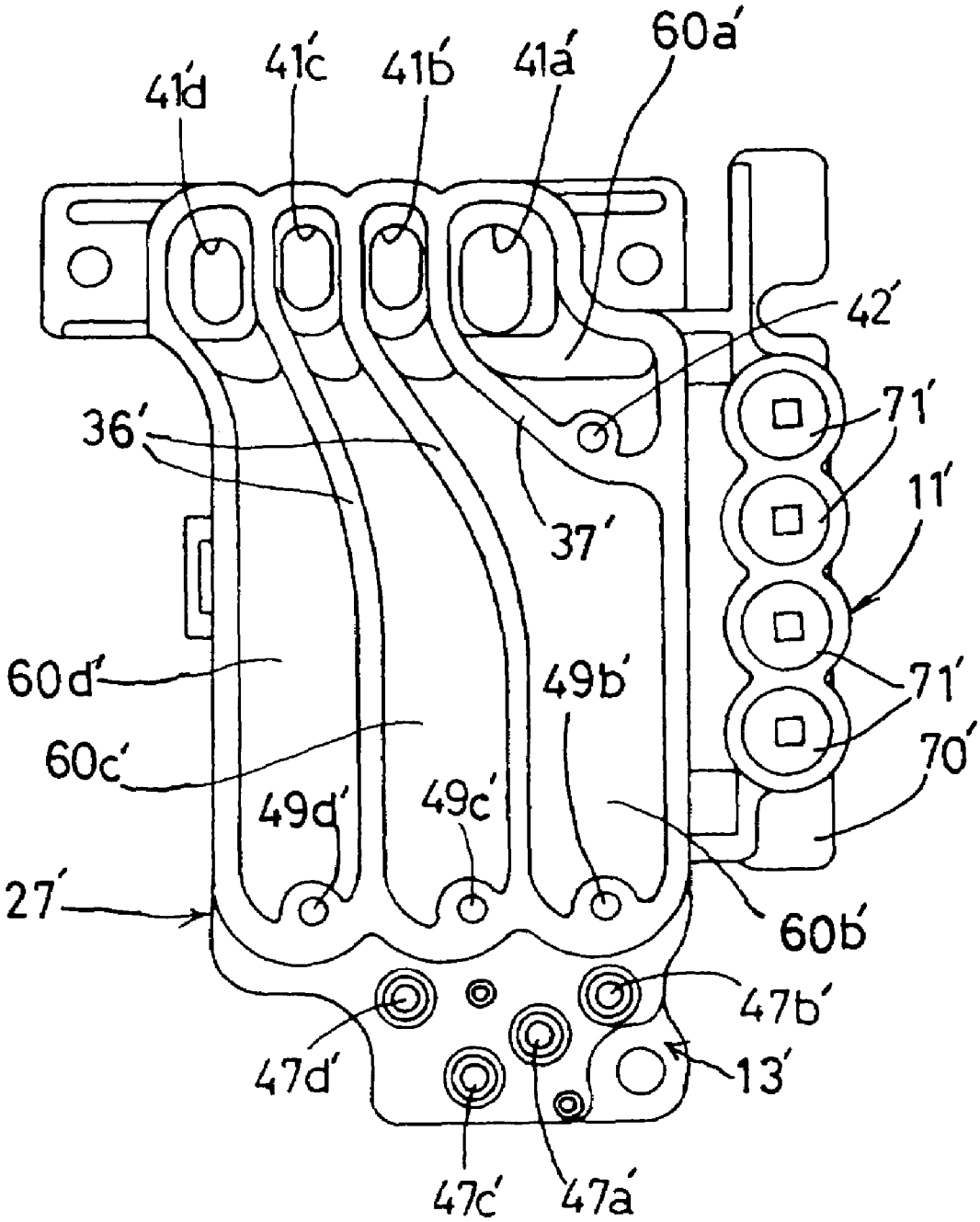
FIG. 18 is a top-plan view of a lower casing member of the main body of the ink delivery unit of FIG. 16.
Figure 19:
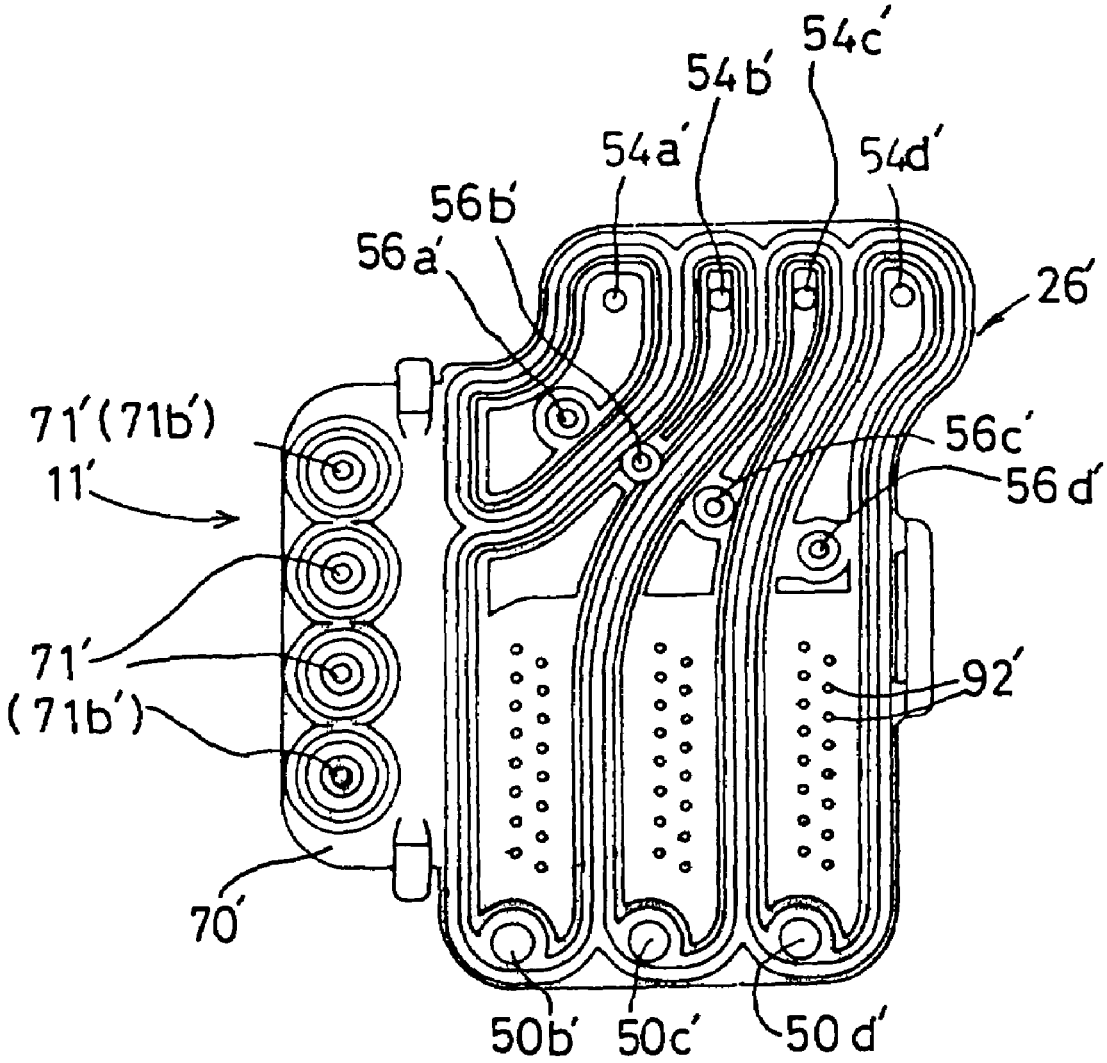
FIG. 19 is a top-plan view of an upper casing member of the main body of the ink delivery unit of FIG. 16.

In the present embodiment, the two secondary partition walls 36' which are distant from each other cooperate with a side wall of the lower casing member 27' and the secondary partition wall 37' to define the bubble trapper chambers 60*b*', 60*c*', 60*d*' of the cyan ink, yellow ink, and magenta ink storage chambers 30*b*', 30*c*', 30*d*' (see FIG. 18).

As shown in FIG. 18, the secondary partition walls 36' extend horizontally over substantially an entire length of the lower casing member 27'. The bubble trapper chambers 60*b*', 60*c*', 60*d*' of the three storage chambers 30*b*', 30*c*', 30*d*' are held in communication, at respective portions horizontally distant from the upper surface of the primary partition wall 35', with the respective ink outlets 41*b'*, 41*c'*, 41*d'* which are assigned to the cyan ink, yellow ink, and magenta ink, respectively.

The secondary partition wall 37' cooperates with the side wall of the lower casing member 27' to define the bubble trapper chamber 60*a'* of the black ink storage chamber 30*a'* (see FIG. 18). That is, the black ink storage chamber 30*a'* is constituted by the above-described damper chamber 31*a'* and the bubble trapper chamber 60*a'* which are positioned on the lower and upper sides of the primary partition wall 35'. The secondary partition wall 37' extends horizontally to a position which is horizontally distant from the upper surface of the primary partition wall 35' and is near to the ink outlets 41*b'*, 41*c'*, 41*d'*. The bubble trapper chamber 60*a'* of the black ink storage chamber 30*a'* is held in communication at it lower end portion with an ink outlet 41*a'* (see FIG. 14B). It is noted that the storage chambers 30*b'*, 30*c'*, 30*d'* for the cyan, yellow and magenta inks and the bubble trapper chamber 60*a'* for the black ink having the respective bottom walls which are commonly provided by the primary partition wall 35' (see FIGS. 21A-21C) correspond to the first delivery channels.

Figure 17:
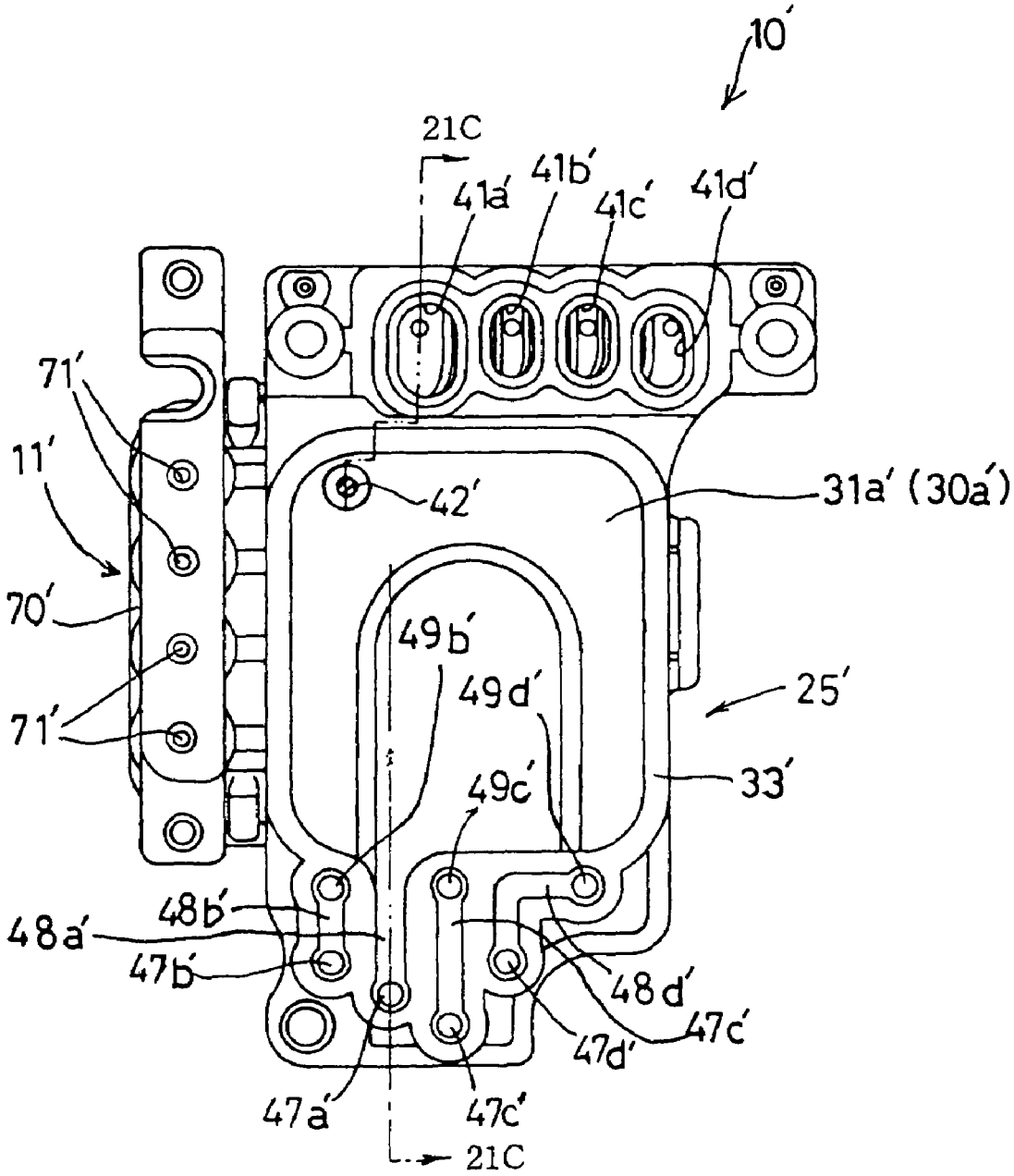
FIG. 17 is a bottom-plan view of the ink delivery unit of FIG. 16, in absence of a lower flexible film which is to be provided to cover a lower surface of the main body of the ink delivery unit.

The damper chamber 31*a'* of the black ink storage chamber 30*a'* communicates with the bubble trapper chamber 60*a'* of the black ink storage chamber 30*a'*, via a vertically-extending ink flow passage 42' defined by a cylindrical wall which is formed along the secondary partition wall 37' (see FIGS. 17, 18 and 21B). The ink flow passage 42' serving as a flow restrictor has a cross sectional area smaller than that of the damper chamber 31*a'*, and accordingly provides a higher resistance to flow of the ink passing therethrough than that of the damper chamber 31*a'*.

The upper casing member 26' is provided by a plate-like member, and has a plurality of recesses formed in an upper surface thereof. The recesses provide damper chambers 31*b'*, 31*c'*, 31*d'* of the cyan ink, yellow ink, and magenta ink storage chambers 30*b'*, 30*c'*, 30*d'*, which are defined or surrounded by three rectangular-shaped annular ribs 38' (see FIG. 16). The three damper chambers 31*b'*, 31*c'*, 31*d'* are located substantially right above the above-described damper chamber 31*a'* of the black ink storage chamber 30*a'*, and open upwardly.

The annular ribs 38' of the upper casing member 26' generally extend in longitudinal directions of the damper chambers 31*b'*, 31*c'*, 31*d'*, and lie on respective vertically-extending planes on which the two secondary partition walls 36' of the lower casing member 27' respectively lie on. Lower ends of the respective damper chambers 31*b'*, 31*c'*, 31*d'* of the storage chambers 30*b'*, 30*c'*, 30*d'* are defined by a bottom wall which has a plurality of vertically-extending communication holes 92' formed therethrough. The communication holes 92' cooperate with each other to function as a flow restrictor, like the above-described ink flow passage 42'. Each of the three damper chambers 31*b'*, 31*c'*, 31*d'* is held in communication, via the communication holes 92', with a chamber located right below each of the damper chambers, namely, with a corresponding one of the three bubble trapper chambers 60*b'*, 60*c'*, 60*d'* which are defined by the secondary partition walls 36' in the lower casing member 27'.

Upper open ends of the three damper chambers 31*b'*, 31*c'*, 31*d'* of the of the cyan ink, yellow ink, and magenta ink storage chambers 30*b'*, 30*c'*, 30*d'* are commonly closed by an upper flexible film 43' which is provided by a single thin film formed of synthetic resin and inhibiting permeation of air or liquid therethrough. Described specifically, the upper flexible film 43' is fixed, for example, by an adhesive or ultrasonic welding, to upper end faces of a peripheral wall and the ribs 38' which define the three damper chambers 31*b'*, 31*c'*, 31*d'*.

As shown in FIG. 17, the above-described four ink outlets 41*a'*, 41*b'*, 41*c'*, 41*d'* are arranged in a row in the lower surface of the lower casing member 27', and have respective openings which open downwardly and which are located in a height position lower than a height position of the lower flexible film 32' (see FIGS. 21A and 21B).

As shown in FIG. 18, the lower casing member 27' includes a flange-like projecting portion 13' located in one of opposite end portions thereof that is remote from the ink outlets 41*a'*, 41*b'*, 41*c'*, 41*d'*. The projecting portion 13' has four ink inlets 47*a'*, 47*b'*, 47*c'*, 47*d'* which open upwardly and which are assigned to the black ink, the cyan ink, the yellow ink, and the magenta ink, respectively. To each of the four ink inlets 47*a'*, 47*b'*, 47*c'*, 47*d'*, the ink tube 14' having a certain degree of flexibility is connected at its distal end portion.

The ink inlet 47*a'* assigned to the black ink is held in communication with the damper chamber 31*a'* of the black ink storage chamber 30*a'* via a corresponding one of horizontal connection passages 48' which are provided by respective downwardly-opening recesses formed in the lower surface of the lower casing member 27' (see FIGS. 17 and 21B). The other three ink inlets 47*b'*, 47*c'*, 47*d'* assigned to the other colors of inks are held in communication with the respective damper chambers 31*b'*, 31*c'*, 31*d'* of the other three storage chambers 30*b'*, 30*c'*, 30*d'* via the other horizontal connection passages 48*b'*, 48*c'*, 48*d'*, respective three vertical communication passages 49*b'*, 49*c'*, 49*d'* formed within the side wall of the lower casing member 27' and extending in the vertical direction (i.e., in a direction substantially perpendicular to the primary partition wall 35'), and respective three vertical communication passages 50*b'*, 50*c'*, 50*d'* formed through the upper casing member 26' and extending in the vertical direction (see FIGS. 17 and 21A). The downwardly-opening recesses providing the horizontal connection passages 48*a'*-48*d'* (which communicate with the ink inlets 47*a'*-47*d'*) are covered by the lower flexible film 32' (see FIGS. 21A and 21B).

The upper casing member 26' has, in its upper surface, four recesses which provide respective damper chambers 80*a'*, 80*b'*, 80*c'*, 80*d'* of the four storage chambers 30*a'*, 30*b'*, 30*c'*, 30*d'*, in respective positions that are vertically aligned with portions of the respective bubble trapper chambers 60*a*, 60*b*, 60*c*, 60*d* which are close to the four ink outlets 41*a'*, 41*b'*, 41*c'*, 41*d'*, such that the four damper chambers 80*a'*, 80*b'*, 80*c'*, 80*d'* are independent of each other.

The damper chambers 80*a'*, 80*b'*, 80*c'*, 80*d'* communicate with the respective bubble trapper chambers 60*a'*, 60*b'*, 60*c'*, 60*d'* through respective air holes 54 formed through the upper casing member 26'. That is, each of the four storage chambers 30*a'*, 30*b'*, 30*c'*, 30*d'* assigned to the respective four color inks is sectioned into three sections or chambers, i.e., the first damper chamber 31', the bubble trapper chamber 60' and the second damper chamber 80'.

Figure 16:
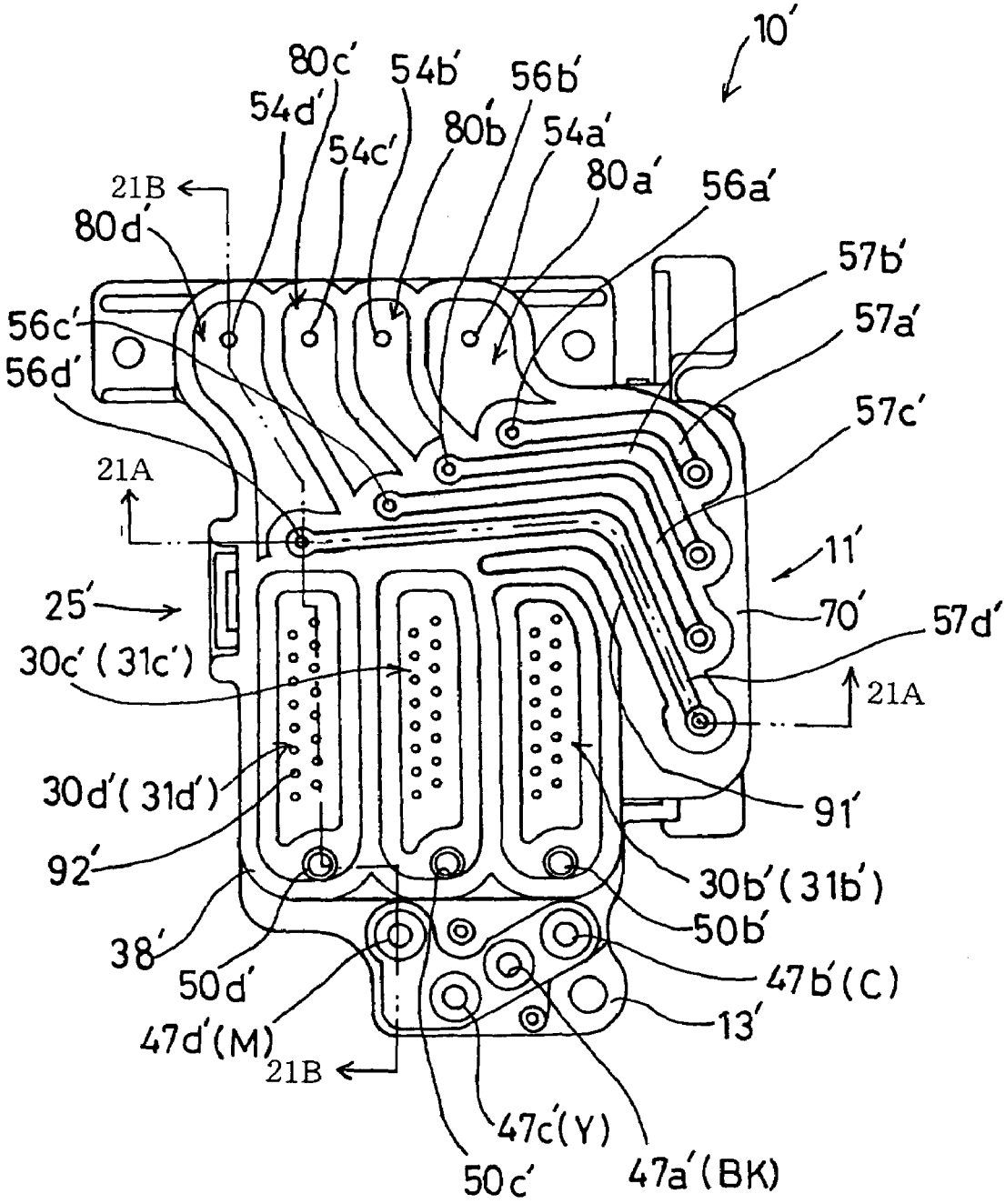
FIG. 16 is a top-plan view of an ink delivery unit of a head unit of an inkjet printer constructed according to a second embodiment of the invention, in absence of an upper flexible film which is to be provided to cover an upper surface of a main body of the ink delivery unit.

In addition, in the upper surface of the upper casing member 26', there are formed four air discharging holes 56*a'*, 56*b'*, 56*c'*, 56*d'* which are located between the three first damper chambers 31*b'*, 31*c'*, 31*d'* and the four second damper chambers 80*a'*, 80*b'*, 80*c'*, 80*d'*, as seen in the plan view of the upper casing member 26 (see FIG. 16). The four air discharging holes 56*a'*, 56*b'*, 56*c'*, 56*d'* are formed through the upper casing member 26' so as to be held in communication at their respective lower ends with the respective four bubble trapper chambers 60*a'*, 60*b'*, 60*c'*, 60*d'*.

Figure 20:
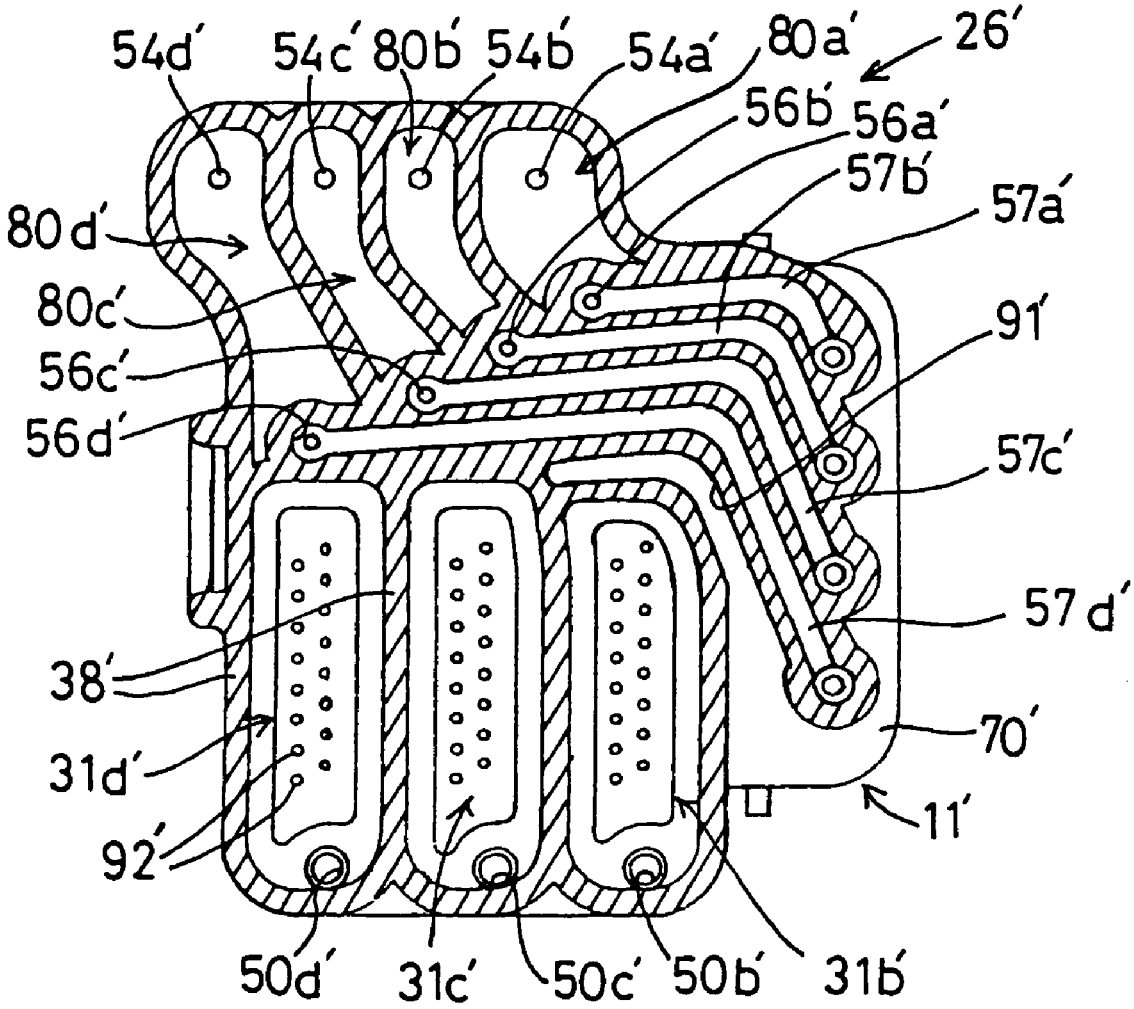
FIG. 20 is a horizontal cross section view of the upper casing member of FIG. 19.

As shown in FIGS. 16 and 20, each of the four air discharging holes 56*a'*, 56*b'*, 56*c'*, 56*d'* is held in communication at its upper end with a corresponding one of four air discharging passages 57a', 57b', 57c', 57d' which are provided by respective recesses formed in the upper casing members 26'.

Each of the air discharging passages 57a', 57b', 57c', 57d' has an upstream-side part located a portion of the upper surface of the upper casing member 26' which portion is located between openings of the second damper chambers 80a'-80d' and openings (defined by the ribs 38') of the cyan, yellow and magenta ink storage chambers 30b'-30d'. This upstream-side part of each air discharging passage (57a', 57b', 57c', 57d') extends substantially in a direction in which the cyan, yellow and magenta ink storage chambers 30b'-30d' are arranged. Each of the air discharging passages 57a', 57b', 57c', 57d' has, in addition to the upstream-side part, a downstream-side portion which is inclined with respect to the upstream-side part, so that each air discharging passage (57a', 57b', 57c', 57d') has a generally L shape in the plan view of the upper casing member 26'. Each of the air discharging passages 57a', 57b', 57c', 57d' is connected at one of its opposite ends with a corresponding one of the air discharging holes 56a', 56b', 56c', 56d', and is connected at the other end with a corresponding one of vertically-extending communication holes 71' of a bubble discharger unit 11' provided by one of side portions of the lower casing member 27' which are opposite to each other as viewed in the direction in which the cyan, yellow and magenta ink storage chambers 30b'-30d' are arranged. In the present second embodiment, the air discharging passages 57a', 57b', 57c', 57d' correspond to the third delivery channels.

The air discharging passage 57d' for the magenta ink, which is connected to the air discharging hole 56d' that is more distant from the bubble discharger unit 11' than the other air discharging holes 56a', 56b', 56c', is closer to the openings of the ink storage chambers 30b', 30c', 30d' (formed through the upper casing member 26') than the other air discharging passages 57a', 57b', 57c' for the black, cyan and yellow inks. Therefore, like in the above-described first embodiment, the other air discharging passages 57a', 57b', 57c' can be also arranged to extend substantially in the direction in which the cyan, yellow and magenta ink storage chambers 30b'-30d' are arranged, thereby making it possible to save the area required for the disposition of the plurality of discharging passages (see FIGS. 16 and 20).

Between the opening of the discharging passage 57d' for the magenta ink and the opening of the cyan ink storage chamber 30b', an elongated groove or recess 91' is formed to separate from one of them from the other. Like the above-described recess 91 in the above-described first embodiment, this recess 91' has an upper opening and a longitudinal opening end which opens outwardly in a horizontal direction (see FIGS. 16 and 20).

The four second damper chambers 80a', 80b', 80c', 80d' and the four discharging passages 57a', 57b', 57c', 57d', together with the three damper chamber 31b', 31c', 31d', are commonly closed at their openings by the above-described upper flexible film 43', so that each of the damper chambers 80a', 80b', 80c', 80d' and discharging passages 57a', 57b', 57c', 57d' provides a part of the corresponding channel. It is noted that the elongated recess 91' (located between the discharging passage 57'd for the magenta ink and the cyan ink storage chamber 30b') is held in communication with an atmosphere through its longitudinal opening end, although the recess 91' is also covered by the upper flexible film 43'.

The bubble discharger unit 11' has an accommodating portion 70' provided by a side portion of the lower casing member 27', which portion is adjacent to the cyan ink storage chamber 30b' and the black ink buffer chamber 60a'. This accommodating portion 70' has four vertically-extending communication holes 71' assigned to the four color inks and arranged in a direction perpendicular to the direction in which the ink storage chambers 30b', 30c', 30d' are arranged. Each of the communication holes 71' is vertically elongated and opens in upper and lower surfaces of the accommodating portion 70' (see FIGS. 16-21).

The accommodating portion 70' is covered at its upper end by a portion of the upper casing member 31' which portion is adjacent to the cyan ink damper chamber 31b'. Each of the discharging passages 57a', 57b', 57c', 57d' has an opening end portion which is connected to an upper end portion of a corresponding one of the vertically-extending communication holes 71' (see FIGS. 16-21).

Each of the four communication holes 71' has an upper large-diameter portion 71a' and a lower small-diameter portion 71b' (see FIG. 21A). Within each of the communication holes 71', there is disposed a valve member 72' including a large-diameter valve head portion and a small-diameter valve stem portion 73' which extends downwardly from the head portion. A sealing member 74', which is preferably provided by an annular elastic member, is disposed on a lower side of the valve head portion of the valve member 72'.

Further, a biaser 75' such as a coil spring is disposed within the upper large-diameter portion 71a' of each communication hole 71', so as to bias the valve member 72' in such a direction that causes the lower small-diameter portion 71b' of the communication hole 71' to be closed. The valve stem portion 73' of the valve member 72' is received in the lower small-diameter portion 71b', such that a lower end of the valve stem portion 73' is located in the vicinity of a lower opening end of the small-diameter portion 71b' of the communication hole 71' (see FIG. 21A).

Each valve member 72' including the head portion and the stem portion 73' is constantly biased in the downward direction by the biaser 75', so that the sealing member 74' is pressed or gripped by and between the valve head portion and a valve seat which is provided by a bottom surface of the upper large-diameter portion 71a' of the communication hole 71', whereby the valve member is held in its closed state (see FIG. 21A). It is noted that each valve member 72' is placed in its open state, when the valve member 72' is lifted up by a projection portion 77a' of a cap member 77' which is brought into contact with the valve stem portion 73'.

FIG. 21A shows a maintenance unit 40' including a covering member 76' which is operable to cover the nozzle opening surface of the recording head 21' so as to cover all the nozzles 22; and four cap members 77' which are operable independently of each other to cover the lower opening ends of the respective four lower small-diameter portions 71b' of the communication holes 71'. The maintenance unit 40' further includes an elevating and lowering device 78' that is employed in a known maintenance unit. When the head unit 4 is positioned in its home position (i.e., maintenance position), the covering member 76' and the cap members 77' are elevated by this elevating and lowering device 78', so as to be brought into close contact with the nozzle opening surface of the recording head 21 and the lower end surface of the bubble discharger unit 11', for closing the openings of the nozzles 22 and the lower openings of the communication holes 71'. When the head unit 4 is away from its home position, the covering member 76' and the cap members 77' are lowered by the elevating and lowering device 78' so as to be separated from those surfaces. The covering member 76' is operatively connected to a suction pump 79', like in the known maintenance unit, so that thickened ink and foreign matters can be sucked, with activation of the suction pump 79', through the covering member 76', so as to be removed from the nozzles 22.

The four cap members 77' have the respective projection portions 77*a*' projecting upwardly from main bodies of the respective cap members 77. When the cap members 77' are brought into contact with the lower end surface of the bubble discharger unit 11', the projection portions 77*a*' push the valve stem portions 73' of the valve members 72' upwardly against biasing forces generated by the biasers 75', whereby the sealing members 74' are moved, together with the valve members 72', away from the valve seats (i.e., the bottom surfaces of the upper large-diameter portions 71*a*' of the communication holes 71'), namely, whereby the valve members 72' are placed in their open states. The four cap members 77' are operatively connected to the suction pump 79' via a common flow passage, so that the air bubbles collected or retained in the bubble trapper chambers 60*a*', 60*b*', 60*c*', 60*d*' of the respective four storage chambers 30*a*', 30*b*', 30*c*', 30*d*' are concurrently sucked and discharged with activation of the suction pump 79'. In the ink delivery unit 10' constructed according to the present embodiment, while the four color inks supplied from the ink source unit via the flexible ink tubes 14 are temporarily stored in the bubble trapper chambers 60*a*'-60*d*', the air bubbles are separated from the inks and floated on upper surfaces of the inks. The thus separated air bubbles are collected or retained in the upper portions of the bubble trapper chambers 60*a*'-60*d*', and the retained air bubbles are then sucked and discharged by the suction pump 79'.

A selector valve 85' is provided to selectively connects the covering member 76' or the cap members 77', to the suction pump 79'. Although the covering member 76' and the cap members 77' are concurrently elevated by the elevating and lowering device 78' so as to be brought into close contact with the outside surface of the recording head 21' and the lower surface of the bubble discharger unit 11', it is preferable that the air bubbles retained in the upper portions of the bubble trapper chambers 60*a*', 60*b*', 60*c*', 60*d*' are first discharged via the cap members 77', and the thickened inks are then discharged from nozzles 22 via the covering member 76'. If the air bubbles retained in the bubble trapper chambers 60*a*'-60*d*' were intended to be discharged through only the covering member 76', considerably large amounts of inks would have to be discharged. However, in the present embodiment, the discharge of the air bubbles and the recovery of the recording head 21 can be made by discharging reduced amounts of inks.

It is noted that the operation of sucking the inks from the nozzles 22 and the operation of discharging the air bubbles from the bubble trapper chambers 60*a*'-60*d*' may be performed either together with each other or independently of each other.

In the ink delivery unit 10' constructed as described above, it is possible to check a leakage in the same manner as in the above-described first embodiment of the invention. That is, the channels assigned to the cyan ink and those assigned to the magenta ink cooperate to form one group, while the channels assigned to the black ink and those assigned to the yellow ink cooperate to form another group. That is, the delivery cannels for the cyan and magenta inks are checked together, while the delivery channels for the black and yellow inks are checked together.

Since the recess 91' held in communication with the exterior of the ink delivery unit 10' is provided between the opening of the discharging passage 57*d*' (for the magenta ink) and the opening of the cyan ink storage chamber 30*b*', the outer periphery of each one of the openings of the channels belonging to the same group (which is formed in the leakage checking process) is not contiguous to that of any other of the openings of them. In the present embodiment in which the plurality of channels each one of which is assigned to the four different color inks are divided into the two groups, the process for checking the ink delivery unit 10' for leakage can be made by implementing two checking steps. Thus, the number of the checking steps to be implemented can be made smaller than where the plurality of channels are divided into groups whose number corresponds to the number of the colors of the inks.

Therefore, like in the first embodiment, a length of time required to carry out the process of checking the ink delivery unit 10' for leakage can be remarkably reduced, and the checking process can be easily carried out, even where the channel such as the ink storage chambers 30*a*'-30*d*' and the discharging passages 57*a*'-57*d*' are arranged with high density so as to make the entirety of the ink delivery unit 10' compact in size to meet a demand for reduction in a floor space required for installation of the inkjet printer. Further, the leakage checking process can be carried out, even if the number of channels defined in the ink delivery unit is further increased to meet a demand for increase in the number of colors of the inks.

Figure 22:
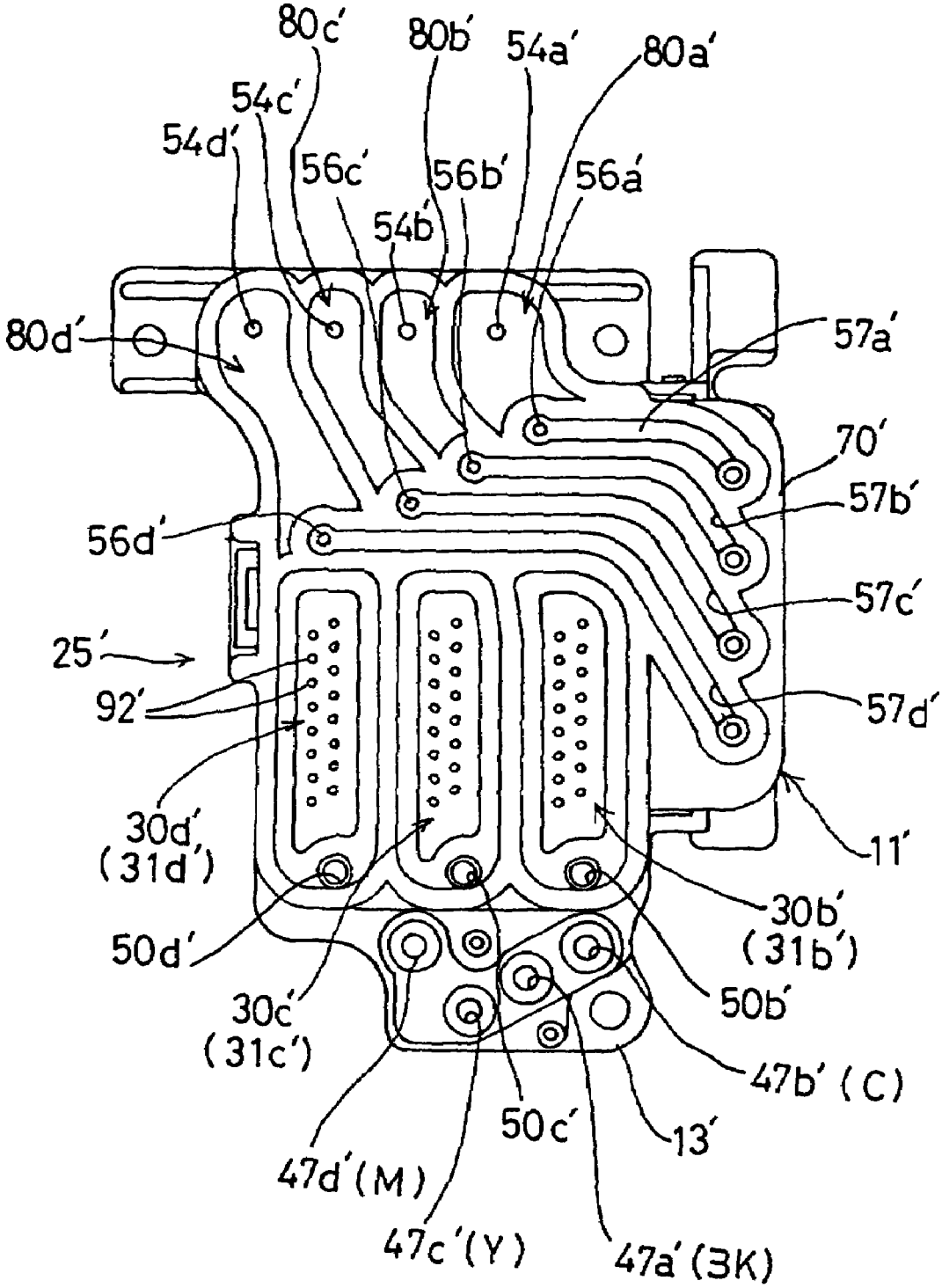
FIG. 22 is a top-plan view of an ink delivery unit which is to be compared with the ink delivery unit of FIG. 16.

FIG. 22 shows an ink delivery unit that is to be compared with the ink delivery unit 10' of FIG. 16 which is constructed according to the second embodiment of the invention. In this ink delivery unit, due to the absence of the above-described recess 91' (which is provided between the opening of the discharging passage 57*d*' and the opening of the ink storage chamber 30*b*' in the ink delivery unit 10'), the outer periphery of the opening of the discharging passage 57*d*' and that of the opening of the ink storage chamber 30*b*' are contiguous or intersected to each other. Therefore, if there is a defect in the bonding connection at that intersected part, the pressurized air supplied into the delivery cannels for the cyan and magenta inks does not exhibit a change in the checking step. That is, the defect can not be defect. In the ink delivery unit of FIG. 22, the delivery channels for the cyan and magenta inks have to be checked individually from each other, thereby leading to an increase in the required number of the checking steps. This is contrast to the arrangement of the above-described first and second embodiments in which the delivery channels for the cyan and magenta inks can be concurrently checked.

While the presently preferred embodiments of this invention have been described in detail, for illustrative purpose only, it is to be understood that the present invention is not limited to the details of the illustrated embodiments, but may be otherwise embodied.

For example, while the recording head unit 4 of the inkjet printer constructed according to each of the above-described embodiments is of a type using the piezoelectric elements, the principle of the present invention is equally applicable to an inkjet printer equipped with a recording head unit of other type such as a type using electrostatic attraction and a type using electric thermal transfer. Where the principle of the present invention is applied to the inkjet printer of electric thermal transfer type, an element provided to heat the ink corresponds to a heat emitter or heat source, like the above-described driver chip 61 and heat dissipation unit 65.

Further, while the ink source unit 9 is disposed in the stationary body of the inkjet printer in each of the above-described embodiments, it may be disposed on the carriage.

While the ratio among the volumes of the respective chambers 30*b*, 30*c*, 30*d*, 60*a* is about 5:5:6:4 in the first embodiment, the ratio may be suitably changed as needed. That is, as long as one of the chambers closest to the heat source has the largest volume, the relationship among the other chambers with respect to the volume is not particularly limited. However, it is preferable that any one of the chambers is given a lager volume than the other chamber which is more distant from the heat source than the chamber in question.

In each of the above-described embodiments, each of the ribs 38 is provided by an annular wall, so that the damper chambers 31*b*, 31*c*, 31*d* are defined at their peripheries by the respective annular ribs 38. However, each of the ribs 38 may be provided by first and second partition walls which project downwardly from the upper wall of a corresponding one of the ink storage chamber 30*b*, 30*c*, 30*d* and which have respective distal ends spaced apart from the bottom wall of the corresponding ink storage chamber (30*b*, 30*c*, 30*d*), such that the first partition wall is disposed between the ink storage chamber inlet (53*b*, 53*c*, 53*d*) and the damper chamber (31*b*, 31*c*, 31*d*), while the second partition wall is disposed between the damper chamber (31*b*, 31*c*, 31*d*)section and the bubble trapper chamber (60*b*, 60*c*, 60*d*), whereby the damper chamber (31*b*, 31*c*, 31*d*) is defined by and between the first and second partition walls. In this arrangement, too, a certain amount of air can be stored in the damper chamber (31*b*, 31*c*, 31*d*).

While the above-described third delivery channels are provided by the air discharging passages 57*a*, 57*b*, 57*c*, 57*d* in each of the above-described embodiments, the third delivery channels are provided by ink chambers or channels each of which is located an upstream side of a corresponding one of the chambers 30*b*, 30*c*, 30*d*, 60*a* as the first delivery channels. For example, where the present invention is applied to an inkjet printer equipped having an arrangement in which the ink is circulated between the ink source unit and the bubble trapper unit (manifold), each of the third delivery channels may be provided by an ink channel through which the ink is returned from the trapper unit to the ink source unit.

In each of the above-described embodiments, the leakage checking process includes the step of supplying the pressurized fluid into the two first delivery channels (30*b*, 30*d*) which are located on opposite sides of the one first delivery channel (30*c*). That is, between the two first delivery channels (30*b*, 30*d*) belonging to the same group, there is interposed the one first delivery channel (30*c*) belonging to another group. However, the number of the first delivery channels of another group to be interposed between the first delivery channels of the same group may be two or more.

Figure 23:
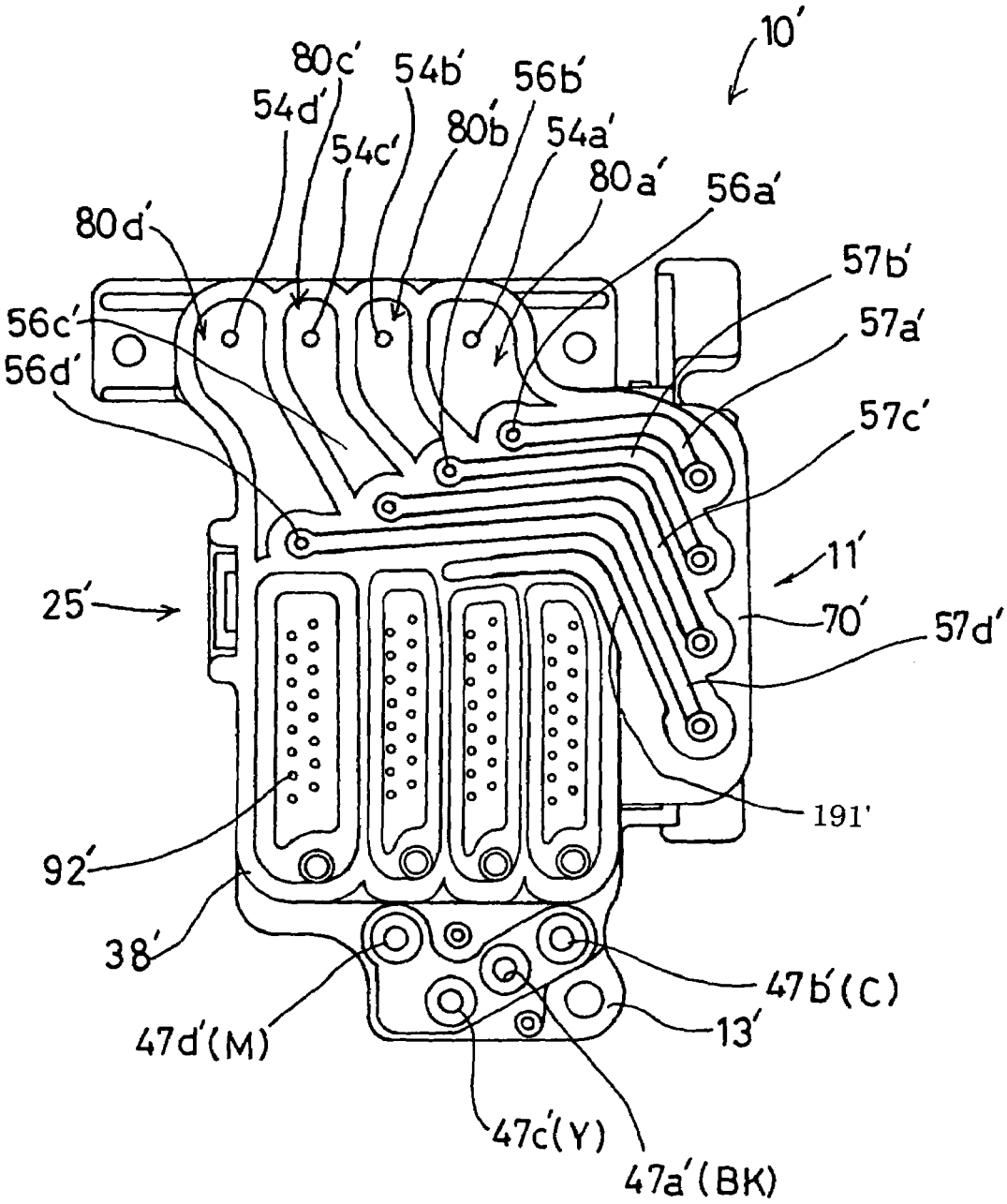
FIG. 23 is a top-plan view of an ink delivery unit which is modification of the ink delivery unit of FIG. 16.

In each of the above-described embodiments, the air discharging passage 57*d* for the magenta ink is located to be closer to the openings of the respective ink storage chambers 30*b*, 30*c*, 30*d* in the upper casing member 26, than the other discharging passages 57*a*, 57*b*, 57*c*, and belongs to the same group as the cyan ink storage chamber 30*b* in the leakage checking process so that the air discharging passage 57*d* and the cyan ink storage chamber 30*b* are concurrently checked. In this case, the cyan ink storage chamber 30*b* is an endmost one of the ink storage chambers 30*b*, 30*c*, 30*d*. However, one of the ink storage chambers (as the first delivery channels), which belongs to the same group as one of the air discharging passages (as the third delivery channels) that is the closest to the openings of the ink storage chambers, is not necessary an endmost one of the ink storage chambers. For example, where the four ink storage chambers open in the upper surface of the main body of the ink delivery unit, as shown in FIG. 23, the above-described one of the ink storage chambers (which belongs to the same group as the closest one of the air discharging passages) could be the second endmost ink storage chamber (as counted from the right side in FIG. 23). In this case, a recess 191' is formed to have a part located between the opening of the closest air discharging passage and the opening of the second endmost ink storage chamber. This recess 191' preferably extends over such a distance that enables the recess 191' to have a longitudinal opening end, so that the recess 191' is held in communication with the atmosphere although the recess 191' is covered by the upper flexible film 43'.

As the fluid to be used in the leakage checking process, a liquid may be used in place of an air.

Further, while the cover member provided to cover the upper surface of the upper casing member 26 is provided by the flexible film 43 in each of the above-described embodiments, the cover member may be provided by a rigid member where the chambers opening in the upper surface of the upper casing member 26 do not have to be given a damping capacity.

While the presently preferred embodiments of this invention have been described above in detail by reference to the accompanying drawings, for illustrative purpose only, it is to be further understood that the present invention may be embodied with various other changes, modifications and improvements, such as those described in the SUMMARY OF THE INVENTION, which may occur to those skilled in the art, without departing from the spirit and scope of the invention defined in the following claims:

What is claimed is:

1. An inkjet printer comprising:

a recording head operable to eject an ink onto a recording medium so as to perform a recording operation on the recording medium;

an ink source unit provided to store the ink that is to be supplied to said recording head; and an ink delivery unit provided to delivery the ink supplied from said ink source unit, to said recording head, wherein said ink delivery unit has a delivery chamber which has a delivery chamber inlet and a delivery chamber outlet, such that the ink can be delivered through said delivery chamber inlet from said ink source unit, and such that the ink can be delivered through said delivery chamber outlet toward said recording head, wherein said delivery chamber is defined by mutually opposed walls that are held in substantially parallel with a horizontal plane, and is a flat chamber elongated in a direction parallel with said mutually opposed walls, wherein said delivery chamber inlet and outlet of said delivery chamber are positioned in respective positions which are substantially diagonal relative to each other, wherein said ink delivery unit includes a damper unit defining at least a part of an ink delivery channel through which the ink is to be delivered from said ink source unit to said recording head, so as to damp pressure fluctuation in the ink delivered through said ink delivery channel, wherein said damper unit has a damper chamber as said delivery chamber which has a damper chamber inlet as said delivery chamber inlet and a damper chamber outlet as said delivery chamber outlet, wherein one of said mutually opposed walls of said damper chamber is provided by a flexible film that is deformable by the pressure fluctuation in the ink, so as to serve as a damper wall, wherein said damper unit has a guide rib which projects from other of said mutually opposed walls toward said one of said mutually opposed walls that is provided by said flexible film such that said rib has a distal end that is spaced apart from said flexible film, and wherein said guide rib extends away from said damper chamber inlet toward said damper chamber outlet, without any portion of said guide rib intersecting an ink path along which the ink is to flow from said damper chamber inlet toward said damper chamber outlet.

2. The inkjet printer according to claim 1, wherein said damper chamber inlet and outlet of said damper chamber are formed through said other of said mutually opposed walls of said damper chamber which is opposed to said damper wall, and wherein said damper chamber inlet and outlet of said damper chamber are positioned in the respective positions which cooperate with each other to maximize a distance between said damper chamber inlet and outlet.

3. The inkjet printer according to claim 1, wherein said guide rib defines the ink path along which the ink is to flow in a direction away from said damper chamber inlet toward said damper chamber outlet.

4. The inkjet printer according to claim 1, wherein said damper chamber is defined by rigid walls as upper and circumferential side walls thereof, and said damper wall as a bottom wall thereof, and wherein said rib projects from said upper wall and is formed integrally with said upper wall.

5. The inkjet printer according to claim 1, wherein said damper chamber outlet has an opening area larger than that of said damper chamber inlet.

6. The inkjet printer according to claim 1, wherein said ink delivery unit includes a buffer unit having a buffer chamber which accumulates, in a bubble trapper region of an inner space thereof, bubbles contained in the ink, wherein said buffer chamber has a buffer chamber inlet and a buffer chamber outlet formed through said mutually opposed walls, such that the ink can be delivered through said buffer chamber inlet into said buffer chamber, and such that the ink can be delivered through said buffer chamber outlet from said buffer chamber toward said recording head, wherein said ink delivery unit further has a partition rib which projects inwardly from said other wall of said buffer chamber, and wherein said partition rib divides a part of an inner space of said buffer chamber into an upstream-side region and a downstream-side region which said buffer chamber inlet and outlet face, respectively.

7. The inkjet printer according to claim 6, wherein said buffer chamber is disposed in a downstream side of said damper chamber, so as to accumulate, in said bubble trapper region of said inner space thereof, the bubbles contained in the ink having passed through said damper chamber, and wherein said buffer chamber inlet of said buffer chamber serves as said delivery chamber outlet of said delivery chamber.

8. The inkjet printer according to claim 7, wherein said wall of said buffer chamber is provided by said other of said mutually opposed walls which separates said buffer chamber and said damper chamber from each other.

9. The inkjet printer according to claim 8, wherein said wall of said buffer chamber provided by said other of said mutually opposed walls corresponds to a bottom wall of said buffer chamber which is parallel with the horizontal plane, and wherein said bubble trapper region of said inner space of said buffer chamber is a region adjacent to an upper wall of said buffer chamber.

10. The inkjet printer according to claim 8, wherein at least a part of said buffer chamber overlaps said damper chamber in a plan view of said ink damper unit, and wherein said buffer chamber is smaller in cross sectional area as measured along the horizontal plane, than said damper chamber.

11. The inkjet printer according to claim 6, wherein said ink delivery unit is provided by a lower casing member having an upper opening, and an upper casing member covering said upper opening of said lower casing member, wherein said lower and upper casing members of said ink delivery unit cooperate with each other to define said buffer chamber and said delivery chamber, wherein said buffer chamber inlet and said buffer chamber outlet are formed through a bottom wall of said buffer chamber, and wherein said partition rib inwardly projecting from said bottom wall of said buffer chamber has a distal end that is spaced from said upper casing member.

12. The inkjet printer according to claim 11, wherein said recording head has a nozzle opening surface in which nozzles open, such that the ink can be ejected through said nozzles onto the recording medium, wherein said ink delivery unit has said delivery chamber which is held in communication with said ink source unit and which is located on a lower side of said bottom wall of said buffer chamber, wherein at least a part of said delivery chamber overlaps said upstream-side region of the divided part of said inner space of said buffer chamber in a plan view of said ink delivery unit, and wherein at least a portion of said recording head overlaps said downstream-side region of the divided part of said inner space of said buffer chamber in said plan view, such that said nozzle opening surface is held in parallel with said bottom wall of said buffer chamber.

13. The inkjet printer according to claim 12, wherein said delivery chamber is defined by said bottom wall of said buffer chamber and said flexible film which is spaced apart from said bottom wall, such that pressure fluctuation in the ink is damped in said delivery chamber serving as said damper chamber.

14. The inkjet printer according to claim 1, further comprising a heat source which generates heat when operated in association with ink ejecting action of said recording head, wherein said ink delivery unit has a main body defining a plurality of first delivery channels each of which is held in communication with a corresponding one of a plurality of second delivery channels defined in said recording head, wherein said first delivery channels extend substantially in parallel with each other and are separated from each other by partition walls, wherein said heat source is disposed on a side of said main body of said ink delivery unit, and wherein one of said first delivery channels, which is closer to said heat source than the other of said first delivery channels, is larger in volume than said other of said first delivery channels.

15. The inkjet printer according to claim 14, wherein a ratio of the volume of said one of said first delivery channels to the volume of each of said other of said first delivery channels is at least 110%.

16. The inkjet printer according to claim 14, wherein said heat source includes a driver chip having a driver circuit which is operable to generate an electric signal for causing the ink to be ejected through at least one of nozzles of said recording head.

17. The inkjet printer according to claim 16, further comprising a flexible wiring cable which is connected to said recording head, wherein said driver chip is disposed on said flexible wiring cable such that said electric signal generated by said driver circuit of said driver chip is supplied to said recording head through said flexible wiring cable, wherein said main body of said ink delivery unit is disposed on one of opposite sides of said recording head that is remote from a nozzle opening surface of said recording head in which said nozzles open, such that said main body is held substantially in parallel with said recording head, wherein said flexible wiring cable extends from said recording head substantially in a direction in which said first delivery channels are arranged, and wherein said driver chip is held substantially in parallel to a direction in which said first delivery channels extend.

18. The inkjet printer according to claim 16, further comprising a heat dissipation unit which is disposed in thermally conductive communication with said driver chip and which includes a major portion held substantially in parallel to a direction in which said first delivery channels extend.

19. The inkjet printer according to claim 18, further comprising a bubble discharger unit which is operable to bring each of said first delivery channels into communication with an exterior of said main body of said ink delivery unit, for discharging bubbles accumulated in each of said first delivery channels, and which is positioned relative to said heat dissipation unit such that said first delivery channels are located between said bubble discharger unit and said heat dissipation unit.

20. The inkjet printer according to claim 14, wherein said first delivery channels defined in said main body have respective parts serving as damper chambers which damp pressure fluctuation in the ink that is to be delivered to said recording head, and wherein one of said damper chambers is provided by said damper chamber.

21. The inkjet printer according to claim 1, wherein said recording head is disposed on a carriage which is movable relative to the recording medium, wherein said ink source unit is disposed in a stationary body of said inkjet printer, wherein said ink delivery unit is disposed on said carriage, such that the ink can be delivered to said ink delivery unit through an ink tube from said ink source unit, and such that the ink can be delivered to said recording head from said ink delivery unit, wherein said ink delivery unit has an ink storage chamber sectioned into a damper section and a bubble trapper section which is held in communication with said damper section and which accumulates bubbles contained in the ink, wherein said ink storage chamber has an air discharging hole such that the bubbles accumulated in said bubble trapper section can be discharged through said discharging hole to an exterior of said ink delivery unit, wherein said ink storage chamber has an ink storage chamber inlet and an ink storage chamber outlet, such that the ink can be delivered through said ink storage chamber inlet into said damper section from said ink tube, and such that the ink can be delivered through said ink storage chamber outlet from said bubble trapper section toward said recording head, and wherein said bubble trapper section and said air discharging hole are located substantially right above said ink storage chamber outlet.

22. The inkjet printer according to claim 21, wherein said damper section of said ink storage chamber serves as said delivery chamber.

23. The inkjet printer according to claim 21, wherein said damper section of said ink storage chamber is defined by said damper unit which is included in said ink delivery unit.

24. The inkjet printer according to claim 21, wherein said damper section of said ink storage chamber retains air, and is defined by a flexible film which provides an upper wall thereof.

25. The inkjet printer according to claim 21, wherein said air discharging hole is positioned in vicinity of a portion of a circumferential side wall defining said ink storage chamber, which portion defines a downstream-side region of said ink storage chamber.

26. The inkjet printer according to claim 21, wherein said ink delivery unit has an air retainer rib which projects downwardly from an upper wall of said ink storage chamber and which surrounds at least a part of said damper section, and wherein said air retainer rib has a distal end which is spaced apart from a bottom wall of said ink storage chamber.

27. The inkjet printer according to claim 21, wherein said ink delivery unit has first and second partition walls which project downwardly from an upper wall of said ink storage chamber and which have respective distal ends spaced apart from a bottom wall of said ink storage chamber, and wherein said first partition wall is disposed between said ink storage chamber inlet and said damper section, while said second partition wall is disposed between said damper section and said bubble trapper section, such that said damper section is defined by and between said first and second partition walls.

28. The inkjet printer according to claim 21, wherein said ink delivery unit has a plurality of ink storage chambers each of which corresponds to said ink storage chamber and each of which stores a corresponding one of different inks, wherein said ink storage chambers extend substantially in parallel with each other, wherein said ink storage chambers have respective ink storage chamber outlets each of which corresponds to said ink storage chamber outlet and each of which is formed through a bottom wall of a corresponding one of said ink storage chambers, and wherein each of said ink storage chamber outlets is located in one of opposite end portions of a corresponding one of said ink storage chambers, such that said ink storage chamber outlets are adjacent to each other so as to be connected to respective ink inlets of said recording head.

29. The inkjet printer according to claim 1, wherein said recording head is disposed on a carriage which is movable relative to a recording medium, wherein said ink source unit is disposed in a stationary body of said inkjet printer, wherein said ink delivery unit is disposed on said carriage, such that the ink can be delivered to said ink delivery unit through an ink tube from said ink source unit, and such that the ink can be delivered to said recording head from said ink delivery unit, wherein said ink delivery unit defines an ink storage chamber having, in an upper part thereof, a damper section which retains air, wherein said ink storage chamber has an ink storage chamber inlet which is located on an upstream side of said damper section, wherein said ink storage chamber has an ink storage chamber outlet which is located on a downstream side of said damper section and which is formed through a bottom wall of said ink storage chamber, and wherein said bottom wall of said ink storage chamber has at least one groove formed in an inside surface thereof and extending in a direction away from said ink storage chamber inlet toward ink storage chamber outlet.

30. The inkjet printer according to claim 29, wherein said damper section of said ink storage chamber is defined by said damper unit which is included in said ink delivery unit, and wherein said ink delivery unit defines, in addition to said ink storage chamber having said ink storage chamber inlet and outlet, said delivery chamber having said delivery chamber inlet and outlet.

31. The inkjet printer according to claim 29, wherein said ink delivery unit has an air retainer rib which projects from an upper wall of said ink storage chamber toward a bottom wall of said ink storage chamber, and which defines said damper section of said ink storage chamber.

32. The inkjet printer according to claim 29, wherein said at least one groove includes a pair of grooves which are formed in respective opposite end portions of said inside surface of said bottom wall of said ink storage chamber.

33. The inkjet printer according to claim 29, wherein said ink storage chamber has, in said upper part thereof, a bubble trapper section which is located on a downstream side of said damper section and which accumulates bubbles contained in the ink, and wherein at least a portion of each of said at least one groove is located right below said damper section.

34. The inkjet printer according to claim 1, wherein said ink delivery unit has a main body defining at least three first delivery channels which extend substantially in parallel with each other and which are separated from each other by partition walls, wherein said ink delivery unit further has a cover member which is fixed to a surface of said main body, wherein said recording head defines at least three second delivery channels, wherein said first delivery channels are held in communication with the respective second delivery channels and respective third delivery channels which are defined in said main body of said ink delivery unit, wherein said first and third delivery channels open in said surface of said main body which is covered by said cover member, wherein one of said third delivery channels held in communication with one of said first delivery channels is closer to said first delivery channels than the other of said third delivery channels, wherein said main body has a recess formed in said surface thereof, such that said recess has a part which is located between said one of said third delivery channels and another one of said first delivery channels, and wherein at least one of said first delivery channels, which is other than said one and another one of said first delivery channels, is located between said one and another one of said first delivery channels.

35. The inkjet printer according to claim 34, wherein said recess is held in communication with an atmosphere.

36. The inkjet printer according to claim 34, wherein said one of said first delivery channels held in communication with said one of said third delivery channels is an endmost one of said first delivery channels as viewed in an arrangement direction in which said first delivery channels are arranged, and wherein said one of said third delivery channels extends, at least at a part thereof closer to said first delivery channels than the other part thereof, in said arrangement direction.

37. The inkjet printer according to claim 34, wherein said first casing member has, in a portion thereof, a plurality of openings which are defined by said partition walls, such that at least a part of each of said first delivery channels opens through a corresponding one of said openings, wherein each of said third delivery channels is held in communication at an end part thereof with a corresponding one of said first delivery channels, wherein each of at least one of said third delivery channels has a closer part which is closer to said openings than said end part thereof and which extends in an arrangement direction in which said first delivery channels are arranged.

38. The inkjet printer according to claim 34, wherein said main body of said ink delivery unit is provided by first and second casing members which are connected to cooperate with each other to define said first delivery channels, wherein said first casing member has, in a portion thereof, a plurality of openings which are defined by said partition walls, such that a part of each of said first delivery channels opens through a corresponding one of said openings, and such that another part of each of said first delivery channels is covered by another portion of said first casing member, wherein said third delivery channels are provided by respective grooves which open in said another portion of said first casing member, and wherein said openings and said grooves are covered by a single cover member as said cover member.

39. The inkjet printer according to claim 34, wherein each of said first delivery channels defined in said main body has a part serving as a damper chamber which damps pressure fluctuation in the ink that is to be delivered from said ink source unit to said second delivery channels of said recording head.

40. The inkjet printer according to claim 39, wherein said cover member is provided by a flexible film which is deformable by the pressure fluctuation in the ink.

41. The inkjet printer according to claim 39, wherein each of said third delivery channels is a discharging passage which is provided to discharge bubbles accumulated in said damper chamber.

42. The inkjet printer according to claim 41, further comprising a bubble discharger unit which is operable to bring said discharging passage into communication with an exterior of said main body of said ink delivery unit, and which is provided in an end portion of said main body as viewed in an arrangement direction in which said first delivery channels are arranged.

43. The inkjet printer according to claim 34, wherein each of said first delivery channels is an ink delivery channel through which the ink is to be delivered from said ink source unit to said second delivery channels of said recording head.

44. A method of checking if there is a leakage in the delivery unit of the inkjet printer defined in claim 34, said method comprising:

a step of supplying a positively or negatively pressurized fluid into at least two of said first delivery channels and the third delivery channels each of which is held in communication with a corresponding one of said at least two of said first delivery channels, wherein said at least two of said first delivery channels are located on opposite sides of at least one of said first delivery channels which is other than said at least two of said first delivery channels.

45. The method according to claim 44, wherein each of said first delivery channels has first, second and third opening ends, wherein each of said first delivery channels is connected at said second opening end with a corresponding one of said second delivery channels, wherein each of said first delivery channels is connected at said third opening end with one of opposite opening ends of a corresponding one of said third delivery channels, and wherein said step is implemented by supplying said pressurized fluid simultaneously into said at least two of said first delivery channels and said third delivery channels, through said first opening end of each of said at least two of said first delivery channels, while said second opening end of each of said at least two of said first delivery channels and the other of said opposite opening ends of each of said third delivery channels are closed.

46. The inkjet printer according to claim 1, wherein said damper unit has a plurality of second damper chambers in addition to said damper chamber as a first damper chamber that is elongated in the direction parallel with said mutually opposed walls, such that a corresponding one of different inks can be delivered through each of said first damper chamber and said plurality of second damper chambers, and wherein said first damper chamber is disposed on one of opposite sides of a partition wall that is provided by said other of said mutually opposed walls, while said second damper chambers are arranged in parallel with each other and are disposed on the other of said opposite sides of said partition wall.

47. The inkjet printer according to claim 1, wherein said guide rib is provided by a pair of rib walls that are located on respective opposite sides of the ink path along which the ink is to flow from said damper chamber inlet toward said damper chamber outlet.

48. The inkjet printer according to claim 1, wherein said guide rib is arranged such that flow of the ink from said damper chamber inlet toward said damper chamber outlet is assured even when said flexible film is in contact with said distal end of said rib.

* * * * *